US011361896B2

(12) United States Patent
Zhang et al.

(10) Patent No.: US 11,361,896 B2
(45) Date of Patent: Jun. 14, 2022

(54) ULTRA-HIGH COUPLING FACTOR MONOLITHIC TRANSFORMERS FOR INTEGRATED DIFFERENTIAL RADIO FREQUENCY AMPLIFIERS IN SYSTEM-ON-CHIP DEVICES

(71) Applicant: SKYWORKS SOLUTIONS, INC., Irvine, CA (US)

(72) Inventors: Lisette L. Zhang, Irvine, CA (US); Oleksandr Gorbachov, Irvine, CA (US)

(73) Assignee: SKYWORKS SOLUTIONS, INC., Irvine, CA (US)

( * ) Notice: Subject to any disclaimer, the term of this patent is extended or adjusted under 35 U.S.C. 154(b) by 283 days.

(21) Appl. No.: 16/554,794

(22) Filed: Aug. 29, 2019

(65) Prior Publication Data

US 2019/0385781 A1 Dec. 19, 2019

Related U.S. Application Data

(62) Division of application No. 14/805,368, filed on Jul. 21, 2015, now Pat. No. 10,438,735.

(60) Provisional application No. 62/027,636, filed on Jul. 22, 2014.

(51) Int. Cl.
*H01F 27/28* (2006.01)
*H01F 19/04* (2006.01)

(52) U.S. Cl.
CPC ..... *H01F 27/2804* (2013.01); *H01F 19/04* (2013.01); *H01F 2027/2809* (2013.01)

(58) Field of Classification Search
USPC ..... 336/173, 220, 223, 192, 225, 226
See application file for complete search history.

(56) References Cited

U.S. PATENT DOCUMENTS

| | | | |
|---|---|---|---|
| 6,198,374 | B1 | 3/2001 | Abel |
| 6,396,362 | B1 | 5/2002 | Mourant et al. |
| 7,446,626 | B2 | 11/2008 | Gorbachov |
| 10,438,735 | B2 | 10/2019 | Zhang et al. |
| 2003/0071706 | A1 | 4/2003 | Christensen |
| 2006/0077028 | A1 | 4/2006 | Huang |
| 2008/0284552 | A1 | 11/2008 | Lim et al. |

(Continued)

OTHER PUBLICATIONS

Bahl, Inder J.; "Improved Quality Factor Spiral Inductors on GaAs Substrates"; IEEE Microwave and Guided Wave etters, vol. 9, No. 10, Oct. 1999.

(Continued)

*Primary Examiner* — Shawki S Ismail
*Assistant Examiner* — Kazi S Hossain
(74) *Attorney, Agent, or Firm* — Lando & Anastasi, LLP

(57) ABSTRACT

An ultra-high coupling factor transformer has a plurality of conductive layers, a primary winding inductor, and a secondary winding inductor. The primary winding inductor is defined by a plurality of turns and disposed on a first one of the plurality of conductive layers and extends to a second one of the plurality of conductive layers. The secondary winding inductor is defined by a plurality of turns and disposed on the first one of the plurality of conductive layers and extends to the second one of the plurality of conductive layers. The primary winding is vertically and horizontally cross coupled with the secondary winding inductor, and defines a mutual coupling inductance from surrounding directions.

18 Claims, 40 Drawing Sheets

(56) References Cited

U.S. PATENT DOCUMENTS

| | | | | |
|---|---|---|---|---|
| 2010/0060402 | A1* | 3/2010 | Chen | H03H 7/422 336/200 |
| 2010/0156194 | A1 | 6/2010 | Navid et al. | |
| 2011/0050379 | A1 | 3/2011 | Kim | |
| 2012/0146757 | A1* | 6/2012 | Tsai | H01F 17/0013 336/200 |
| 2013/0147592 | A1 | 6/2013 | Yoo et al. | |
| 2014/0125445 | A1 | 5/2014 | Sim et al. | |
| 2014/0306778 | A1 | 10/2014 | Gorbachov | |
| 2015/0270053 | A1* | 9/2015 | Cha | C25D 5/02 336/192 |
| 2015/0310980 | A1* | 10/2015 | Yen | H01F 27/2804 336/200 |

OTHER PUBLICATIONS

Cheung, Dickson T.S.; Long, John R.; Hadaway, R.A.; Harame, D.L.; "Monolithic Transformers for Silicon RF IC Design"; University of Toronto, Toronto, Ontario, Canada; IEEE BCTM 1998.

Kamogawa, Kenji; Nishikawa, Kenjiro; Tokumitsu, Tsuneo; Tanaka, Masayoshi; "A Novel High-Q Inductor Based on Si 3D MMIC Technology and Its Application"; NTT Network Innovation Laboratories, Japan; IEEE MTT-S Digest; 1999.

Khan, Muhammad Abdullah; "Design and Implementation of Common Drain Class-B RF Power Amplifier in 90 CMOS Technology"; Master of Science Thesis in System-on-Chip Design; RWTH Aachen University; Jan. 19, 2011.

Koutsoyannopoulos, Yorgos K.; "Systematic Analysis and Modeling of Integrated Inductors and Transformers in RF IC Design"; IEEE Transactions on Circuits and Systems-II: Analog and Digital Signal Processing, vol. 47, No. 8, Aug. 2000.

Lakdawala, Hasnain; Zhu, Xu; Luo, Hao; Santhanam, Suresh; Carley, L. Richard; Fedder, Gary K.; "Micromachined High-Q Inductors in a 0.18-mm Copper Interconnect Low-K Dielectric CMOS Process"; IEEE Journal of Solid-State Circuits, vol. 37, No. 3, Mar. 2002.

Niknejad, Ali M.; "Analysis, Design, and Optimization of Spiral Inductors and Transformers for Si RF IC's"; IEEE Journal of Solid-State Circuits, vol. 33, No. 10, Oct. 1998.

Park, Min; Lee, Seonghearn; Kim, Cheon Soo; Yu, Hyun Kyu; Nam; Kee Soo; The Detailed Analysis of High Q CMOS-Compatible Microwave Spiral Inductors in Silicon Technology; IEEE Transactions on Electron Devices, vol. 45, No. 9, Sep. 1998.

Tan, Yulin; Xu, Hongtao; El-Tanani, Mohammed A; Taylor, Stewart; Lakdawala, Hasnain; "A Flip-Chip-Packaged 1.8V 28dBm Class-AB Power Amplifier with Shielded Concentric Transformers in 32nm Soc CMOS"; EEE International Solid-Slate Circuits Conference; Intel, Hillsboro, OR (USA); 2011.

Tang, Chih-Chun; Wu, Chia-Hsin; Liu, Shen-Iuan; "Miniature 3-D Inductors in Standard CMOS Process"; IEEE Journal of Solid-State Circuits, vol. 37, No. 4, Apr. 2002.

Yue, Patrick C.; "Physical Modeling of Spiral Inductors on Silicon"; IEEE Transactions on Electron Devices, vol. 47, No. 3, Mar. 2000.

Zhou, Jianjun J.; Allstot, David J.; "Monolithic Transformers and Their Application in a Differential CMOS RF Low-Noise Amplifier"; IEEE Journal of Solid-Slate Circuits, vol. 33, No. 12, Dec. 1998.

Zolfaghari, Alireza; Chan, Andrew; Razavi, Behzad; "Slacked Inductors and Transformers in CMOS Technology"; IEEE Journal of Solid-State Circuits, vol. 36, No. 4, Apr. 2001.

* cited by examiner

ULTRA-HIGH COUPLING FACTOR MONOLITHIC TRANSFORMERS FOR INTEGRATED DIFFERENTIAL RADIO FREQUENCY AMPLIFIERS IN SYSTEM-ON-CHIP DEVICES

CROSS-REFERENCE TO RELATED APPLICATIONS

This application is a divisional patent application of U.S. patent application Ser. No. 14/805,368 filed Jul. 21, 2015 and entitled ULTRA-HIGH COUPLING FACTOR MONOLITHIC TRANSFORMERS FOR INTEGRATED DIFFERENTIAL RADIO FREQUENCY AMPLIFIERS IN SYSTEM-ON-CHIP DEVICES, which relates to and claims the benefit of U.S. Provisional Application No. 62/027,636 filed Jul. 22, 2014 and entitled ULTRA-HIGH COUPLING FACTOR MONOLITHIC TRANSFORMERS FOR INTEGRATED DIFFERENTIAL RF AMPLIFIERS IN SYSTEM-ON-CHIP, the entirety of the disclosure of each of which is hereby wholly incorporated by reference.

STATEMENT RE: FEDERALLY SPONSORED RESEARCH/DEVELOPMENT

Not Applicable

BACKGROUND

1. Technical Field

The present disclosure relates generally to radio frequency (RF) devices, and more particularly, to ultra-high coupling factor monolithic transformers for integrated differential RF amplifiers in system-on-chip (SoC) devices.

2. Related Art

Generally, wireless communications involve a radio frequency (RF) carrier signal that is variously modulated to represent data, and the modulation, transmission, receipt, and demodulation of the signal conform to a set of standards for coordination of the same. Many different mobile communication technologies or air interfaces exist, including GSM (Global System for Mobile Communications), EDGE (Enhanced Data rates for GSM Evolution), and UMTS (Universal Mobile Telecommunications System) W-CDMA (Wideband Code Division Multiple Access). More recently, 4G (fourth generation) technologies such as LTE (Long Term Evolution), which is based on the earlier GSM and UMTS standards, are being deployed. Besides these mobile communications modalities, local area data networking modalities such as Wireless LAN (WLAN)/WiFi, WiMax, and so forth.

A fundamental component of any wireless communications system is the transceiver, that is, the combined transmitter and receiver circuitry. The transceiver encodes the data to a baseband signal and modulates it with an RF carrier signal. Upon receipt, the transceiver down-converts the RF signal, demodulates the baseband signal, and decodes the data represented by the baseband signal. An antenna connected to the transmitter converts the electrical signals to electromagnetic waves, and an antenna connected to the receiver converts the electromagnetic waves back to electrical signals.

Depending on the particulars of the communications modality, single or multiple antennas may be utilized. The output of the transmitter is connected a power amplifier, which amplifies the RF signals prior to transmission via the antenna. The receiver is connected the output of a low noise amplifier, the input of which is connected to the antenna and receives inbound RF signals. Thus, the power amplifier and the low noise amplifier, along with the antenna switch that selectively connects the antennas to a respective one of the output of the power amplifier or the input of the low noise amplifier, serves as key building blocks in RF transceiver circuitry. These components may be referred to as a front end circuit.

Conventionally, in order to lower manufacturing costs and allow full integration of a complete RF System-on-Chip (SoC), a complimentary MOSFET (metal oxide semiconductor field effect transistor) technology is utilized for the power amplifier and the antenna switch circuitry. SoC devices with integrated front end circuits intended for mobile communications applications require both a high sensitivity receiver, a power amplifier with a low error vector magnitude (EVM) floor, and a local oscillator, all on a single semiconductor die. Local oscillator pulling and substrate noise coupling render differential amplifiers a robust choice, and small form factor integrated circuits suitable for mobile applications are possible with differential circuits that incorporate coupled inductors.

One challenge associated with differential power amplifiers and low noise amplifiers is in the design of baluns for differential to single-ended signal lines and regular transformers for differential to differential signal lines, with high coupling factors in a standard CMOS (complementary metal oxide semiconductor) process. Currently, an edge coupled transformer is utilized, where the typical coupling factor is approximately 0.7 or lower. A further challenge relates to the increases in insertion loss of the balun and the transformer at the input of the low noise amplifier or the output of the power amplifier. As the number of inductive coils in the printed circuit structures increases for the high levels of coupling that are needed, there is understood to be a commensurate increase in insertion loss. This may result in an increased noise figure of the low noise amplifier, along with a decreased linear output power of the power amplifier. As a consequence, increased current consumption may follow, as well as decreased gain for the low noise amplifier and/or the power amplifier chain.

Accordingly, there is a need in the art for improved geometries and winding structures of the printed balun and transformer that meet the foregoing challenges.

BRIEF SUMMARY

The present disclosure contemplates improved geometries and winding structures of the balun and transformer with an ultra-high coupling factor. Furthermore, a large inductance in a small geometric area is contemplated, and high-Q inductors, baluns, and transformers with low insertion loss are possible. Front end circuits, that is, the low noise amplifiers, power amplifiers, and RF switches implemented together with the contemplated balun/transformer are understood to exhibit minimal noise figures, and coexist with power amplifiers characterized by low EVM and high efficiency.

According to one embodiment of the present disclosure, a high coupling factor transformer may generally include a plurality of conductive layers, a primary winding inductor, and a secondary winding inductor. The primary winding inductor may be defined by a plurality of turns and may be disposed on a first one of the plurality of conductive layers and extending to a second one of the plurality of conductive layers. The secondary winding inductor may be defined by a plurality of turns and may be disposed on the first one of the plurality of conductive layers and extending to the second one of the plurality of conductive layers. The primary winding may be vertically and horizontally cross coupled with the secondary winding inductor, and define a mutual coupling inductance from surrounding directions.

Another embodiment of the present disclosure is directed to a balun transformer. There may be a primary winding inductor that is defined by a primary conductive trace with a plurality of turns. Additionally, there may be a secondary winding inductor that is defined by a secondary conductive trace with a plurality of turns. The balun transformer may further include a double bridge interconnect of a segment of the primary conductive trace crossing over a segment of the secondary conductive trace. The primary conductive trace may be electrically isolated from the secondary conductive trace while being electromagnetically coupled.

Still another embodiment of the present disclosure contemplates a transformer. There may be a first conductive layer and a second conductive layer. The transformer may further include a primary winding that is defined by a primary spiral trace with one or more turns. The primary winding may further define an outer rim portion and an inner rim portion. The primary spiral trace may be on the first conductive layer. The transformer may also include a secondary winding that is defined by a first segment on the first conductive layer and a second segment on the second conductive layer. The first segment of the secondary winding may have a first sub-segment adjacent to and in a spaced relation with the outer rim of the primary spiral trace, and a second sub-segment adjacent to and in a spaced relation with the inner rim of the primary spiral trace. The second segment of the secondary winding may be defined by a secondary spiral trace with one or more turns in a spaced relation to the primary winding.

The present disclosure will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings.

Common reference numerals are used throughout the drawings and the detailed description to indicate the same elements.

DETAILED DESCRIPTION

The detailed description set forth below in connection with the appended drawings is intended as a description of the presently preferred embodiments of ultra-high coupling factor monolithic transformers for integrated differential radio frequency (RF) amplifiers in System-on-Chip (SoC) device. It is not intended to represent the only form in which the present invention may be developed or utilized, and the same or equivalent functions may be accomplished by different embodiments that are also intended to be encompassed within the scope of the invention. It is further understood that the use of relational terms such as first and second and the like are used solely to distinguish one from another entity without necessarily requiring or implying any actual such relationship or order between such entities.

The coupled inductor structure transformers of the present disclosure are envisioned to have coupling factors greater than 0.9, and close to 1, the upper limit. As will be described in further detail below, the conductor of the primary winding is at least partially surrounded by the conductor of the secondary winding, and vice versa for each turn, thereby maximizing electromagnetic coupling between the windings. It will be recognized by those having ordinary skill in the art that a transformer is an important building block for balanced to unbalanced signal conversion, impedance transformation, and power delivery to the appropriate nodes of an RF system. It is noted that the best rejection of substrate noise and local oscillator noise is possible where the low noise amplifier and the power amplifier chains in the SoC devices are differential or pseudo-differential amplifiers. Furthermore, baluns are utilized at the interface of a single-ended antenna, and transformers are utilized in various other parts of the circuit for impedance transformation, matching networks, and the like. The compact coupled inductors of the present disclosure may also be utilized in DC biasing circuits, RF power amplifier core circuitry, power supply circuitry such as DC-to-DC converters and buck-boost converters that are needed for high output power levels and efficiency. The transformers may be adapted to small form factor circuits, and is contemplated to be particularly advantageous in mobile devices that are constantly being reduced in size.

Figure 1B:
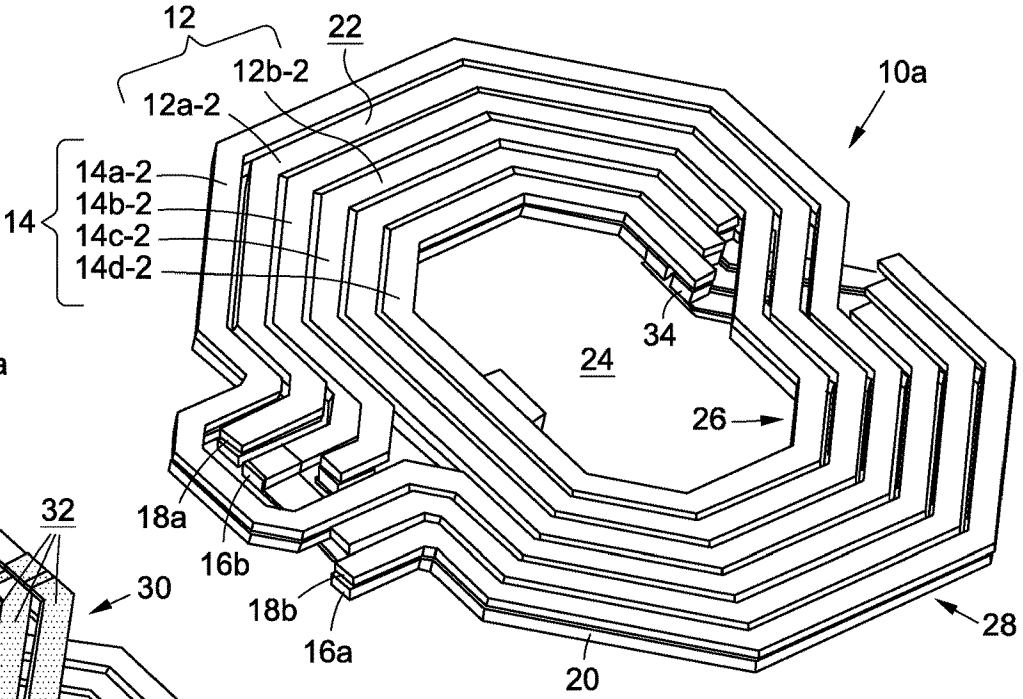
FIGS. 1A-1B are top and bottom perspective views, respectively, of a first embodiment of a transformer with an ultra high coupling factor.
Figure 1A:
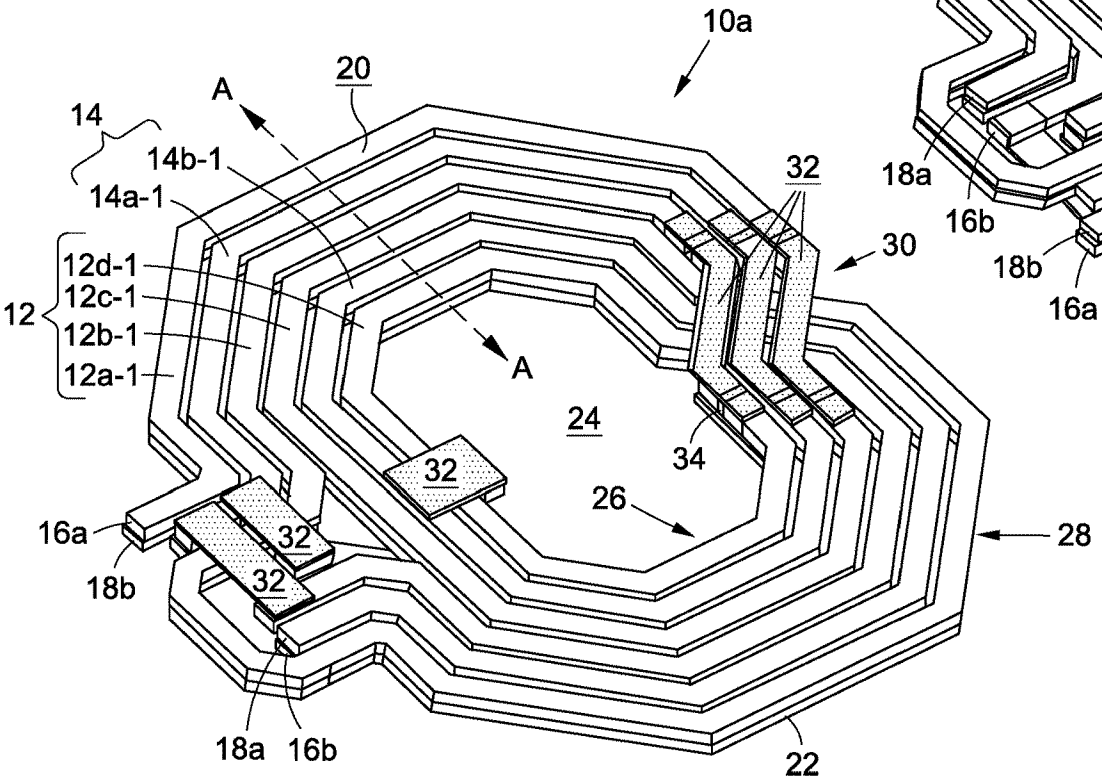

Referring now to FIGS. 1A and 1B, a first embodiment of a transformer 10*a* includes a primary winding inductor 12 and a secondary winding inductor 14. FIG. 1A depicts a top or first side of the transformer 10*a*, and FIG. 1B depicts a bottom or second side of the transformer 10*a*. One end of the primary winding inductor 12 is a first terminal 16*a*, and on the opposite end of the same is a second terminal 16*b*. Similarly, one end of the secondary winding inductor 14 is a first terminal 18*a*. As shown in FIG. 1A, the primary winding inductor 12 is disposed on a first conductive layer 20, though as also shown in FIG. 1B, the primary winding inductor 12 extends to a second conductive layer 22. Moreover, as shown in FIG. 1B, the secondary winding inductor 14 is disposed on the second conductive layer 22, and extends to the first conductive layer 20 as best depicted in FIG. 1A.

Both the primary winding inductor 12 and the secondary winding inductor 14 are defined by a plurality of turns, and are routed in a generally spiral pattern. Although the spiral pattern is generally defined by multiple straight segments angled relative to each other in an octagonal configuration, this is by way of example only and not of limitation. Any other suitable geometric shape of the turns may be readily substituted without departing from the present disclosure. Along these lines, as also illustrated in FIG. 1A and FIG. 1B, the combined structure of the primary winding inductor 12 and the secondary winding inductor 14 has a generally annular configuration, with an interior opening 24, an inner rim 26 that defines the interior opening 24, and an outer rim 28.

As best shown in FIG. 1A, the portion of the primary winding inductor 12 that is disposed on the first conductive layer 20 includes a first turn 12*a*-1, a second turn 12*b*-1, a third turn 12*c*-1, and a fourth turn 12*d*-1. Furthermore, the portion of the secondary winding inductor 14 that is disposed on the first conductive layer 20 includes a first turn 14*a*-1 and a second turn 14*b*-1. It is understood that the suffix reference number -1 designates the first conductive layer 20. In accordance with various embodiments of the present disclosure, the primary winding inductor 12 may be horizontally cross-coupled with the secondary winding inductor 14. In further detail, the successive turns 12*a*-1, 12*b*-1, 12*c*-1, and 12*d*-1 of the primary winding inductor are adjacently positioned to corresponding successive turns 14*a*-1 and 14*b*-1 of the secondary winding inductor 14.

Figure 2:
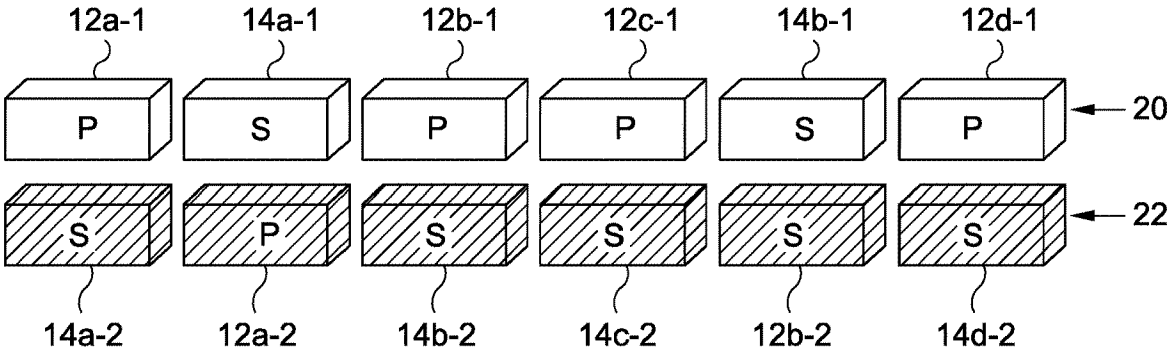
FIG. 2 is a cross-sectional view of the first embodiment of the transformer taken along axis A-A of FIG. 1A.

FIG. 2, which is a cross-sectional view of the primary winding inductor 12 and the secondary winding inductor 14 taken along axis A-A of FIG. 1A, also illustrates this configuration. The first turn 12*a*-1 of the primary winding inductor 12, which is the outer turn, is adjacent to the first turn 14*a*-1 of the secondary winding inductor 14. Further, the second turn 12*b* of the primary winding inductor 12 is adjacent to the first turn 14*a*-1 of the secondary winding inductor 14. Although the second turn 12*b*-1 and the third turn 12*c*-1 of the primary winding inductor 12 are adjacent to each other, the third turn 12*c*-1 of the primary winding inductor 12 is adjacent to the second turn 14*b*-1 of the secondary winding inductor 14. The second turn 14*b*-1 of the secondary winding inductor 14 is adjacent to the fourth turn 12*d*-1 of the primary winding inductor 12.

In addition to the horizontal cross-coupling, various embodiments of the present disclosure contemplate a vertical cross-coupling between the primary winding inductor 12 and the secondary winding inductor 14. As indicated above, there are portions of both the primary winding inductor 12 and the secondary winding inductor 14 that are disposed on the second conductive layer 22. With the first conductive layer 20 being generally parallel to the second conductive layer 22, it is understood that the successive windings of the primary winding inductor 12 and the secondary winding inductor 14 disposed on the first conductive layer 20 are vertically offset from and axially aligned with corresponding ones of the secondary winding inductor 14 and the primary winding inductor 12, respectively, disposed on the second conductive layer 22.

Referring now to FIG. 1B as well as FIG. 2, those portions of the secondary winding inductor 14 on the second conductive layer 22 include a first turn 14*a*-2, a second turn

14*b*-2, a third turn 14*c*-2, and a fourth turn 14*d*-2, where the -2 suffix is understood to designate the second conductive layer 22. The first turn 12*a*-1 of the primary winding inductor 12 disposed on the first conductive layer 20 is aligned with but vertically offset from the first turn 14*a*-2 of the secondary winding inductor 14 disposed on the second conductive layer 22.

The primary winding inductor 12 and the secondary winding inductor 14 on the second conductive layer 22 are similarly horizontally cross-coupled, so the successive turns 14*a*-2, 14*b*-2, 14*c*-2, and 14*d*-2 disposed on the second conductive layer 22 are adjacently positioned to corresponding successive turns 12*a*-2 and 12*b*-2 of the primary winding inductor 12 disposed on the second conductive layer 22. That is, the first turn 14*a*-2 of the secondary winding inductor 14, which is the outer turn, is horizontally adjacent to the first turn 12*a*-2 of the primary winding inductor 12. The second turn 14*b*-2 of the secondary winding inductor 14 is adjacent to the first turn 12*a*-2 of the primary winding inductor 12 as well as the third turn 14*c*-2 of the secondary winding inductor 14. The second turn 12*b*-2 of the primary winding inductor 12 is horizontally adjacent to the third turn 14*c*-2 and the fourth turn 14*d*-2 of the secondary winding inductor 14.

Based on this configuration of the primary winding inductor 12 and the secondary winding inductor 14 on the second conductive layer 22, and the axially aligned but vertically offset relationship between the first turn 12*a*-1 of the primary winding inductor 12 disposed on the first conductive layer 20 and the first turn 14*a*-2 of the secondary winding inductor 14 disposed on the second conductive layer 22, the relationship between the other turns follows. In further detail, the first turn 12*a*-2 of the primary winding inductor 12 is axially aligned with but vertically offset from the first turn 14*a*-1 of the secondary winding inductor 14. Additionally, the second turn 14*b*-2 of the secondary winding inductor 14 is vertically offset from the second turn 12*b*-1 of the primary winding inductor 12, and the third turn 14*c*-2 of the secondary winding inductor 14 is vertically offset from the third turn 12*c*-1 of the primary winding inductor 12. Along these lines, the second turn 12*b*-2 of the primary winding inductor 12 is vertically offset from the second turn 14*b*-1 of the secondary winding inductor 14. The fourth turn 14*d*-2 of the secondary winding inductor 14 is vertically offset from fourth turn 12*d*-1 of the primary winding inductor 12.

The routing of the transmission lines in the foregoing configuration may incorporate a crossover segment 30 that interconnects the respective one of the primary winding inductor 12 and the secondary winding inductor 14 on the first conductive layer 20 to its counterparts disposed on the second conductive layer 22. In this regard, there may be segments of the primary winding inductor 12 and the secondary winding inductor 14 that extend into a third conductive layer 32 that overlaps the first conductive layer 20. Between the various conductive layers, interlayer couplings 34 may be utilized. Additional details pertaining to these structures will be described in further detail below.

Figure 3:
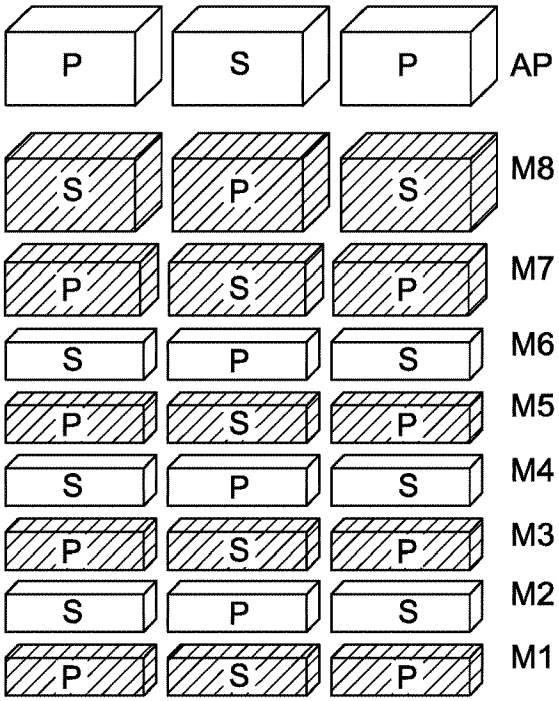
FIG. 3 is a cross-sectional view of an exemplary transformer with primary and secondary windings routed on multiple conductive layers.

The disclosed balun/transformers 10 may be fabricated with bulk-CMOS processes, as well as silicon-on-insulator (SOI), silicon-germanium heterojunction bipolar transistor (HBT), gallium arsenide (GaAs) and other semiconductor process technologies. The transformer 10 in accordance with various embodiments of the present disclosure need not be limited to the two-layer configuration described above in relation to the first embodiment 10*a*. As best illustrated in FIG. 3, the primary winding inductor 12 and the secondary winding inductor 14 may be routed on multiple conductive layers M1-M8, as well as the Aluminum layer (AP), alternating between primary and secondary, both vertically and horizontally.

With the above-described configuration of the transformer 10, it is contemplated that the primary winding inductor 12 is mutually coupled to or otherwise defines a mutual coupling inductance with the secondary winding inductor 14 in multiple surrounding directions, both horizontally and vertically. As a result, coupling factors above 0.9, and closer to 1, are understood to be possible. Generally, the greater the number of layers utilized, the higher the coupling factor. The various conductive layers in conventional semiconductor fabrication processes may be fully utilized, and transformers of maximum Q factor and minimum insertion loss are contemplated. It will be recognized by those having ordinary skill in the art that these characteristics are important for high power added efficiency, high linear output power (as pertinent to RF front end module power amplifiers) and low noise figures (as pertinent to RF front end module low noise amplifiers).

Figure 4A:
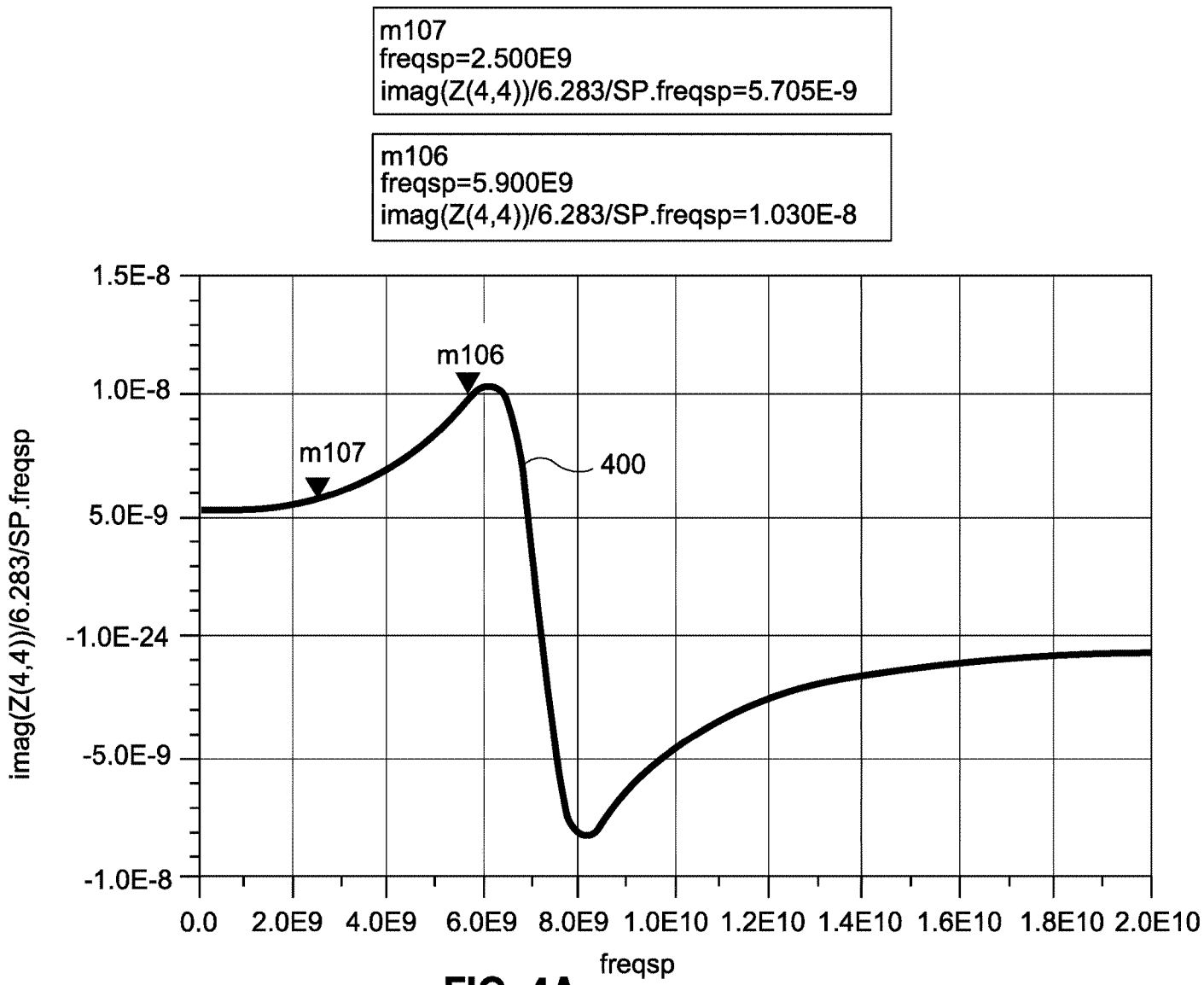
FIGS. 4A-4D are graphs showing simulation results of a primary winding inductance, a secondary winding inductance, a mutual inductance, and a coupling factor, respectively, of the first embodiment of the transformer depicted in FIGS. 1A and 1B across a frequency sweep.
Figure 4B:
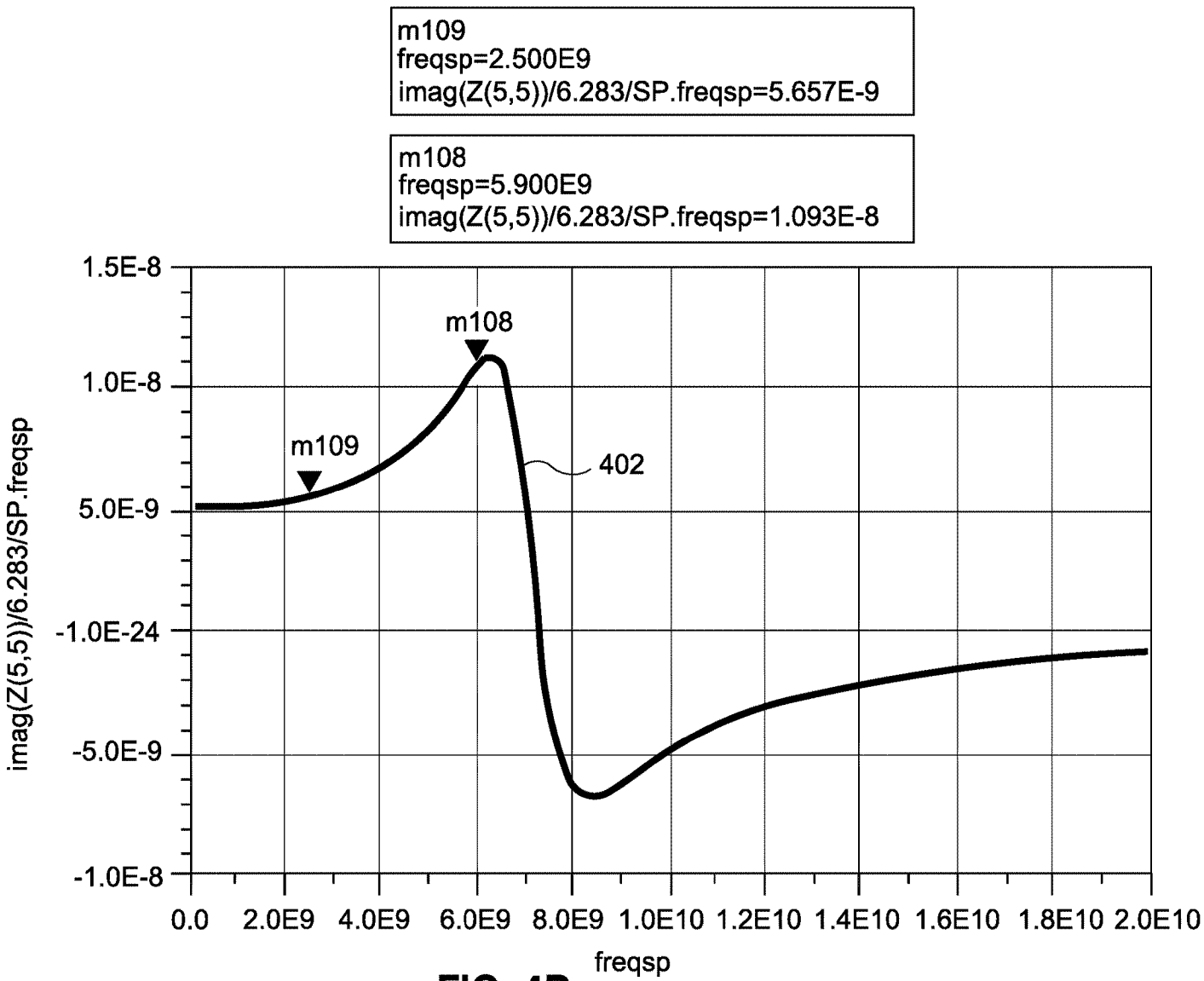
Figure 4C:
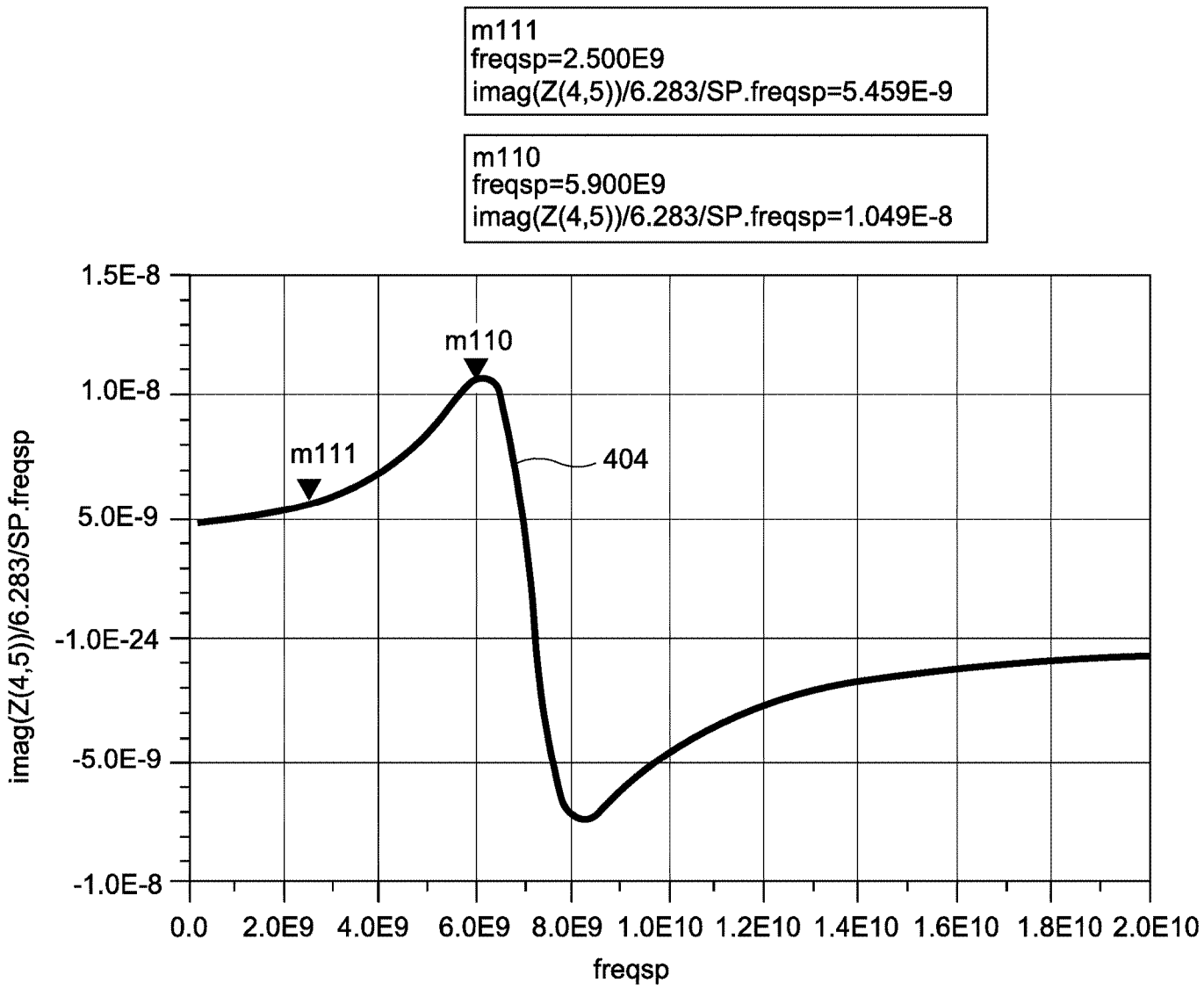
Figure 4D:
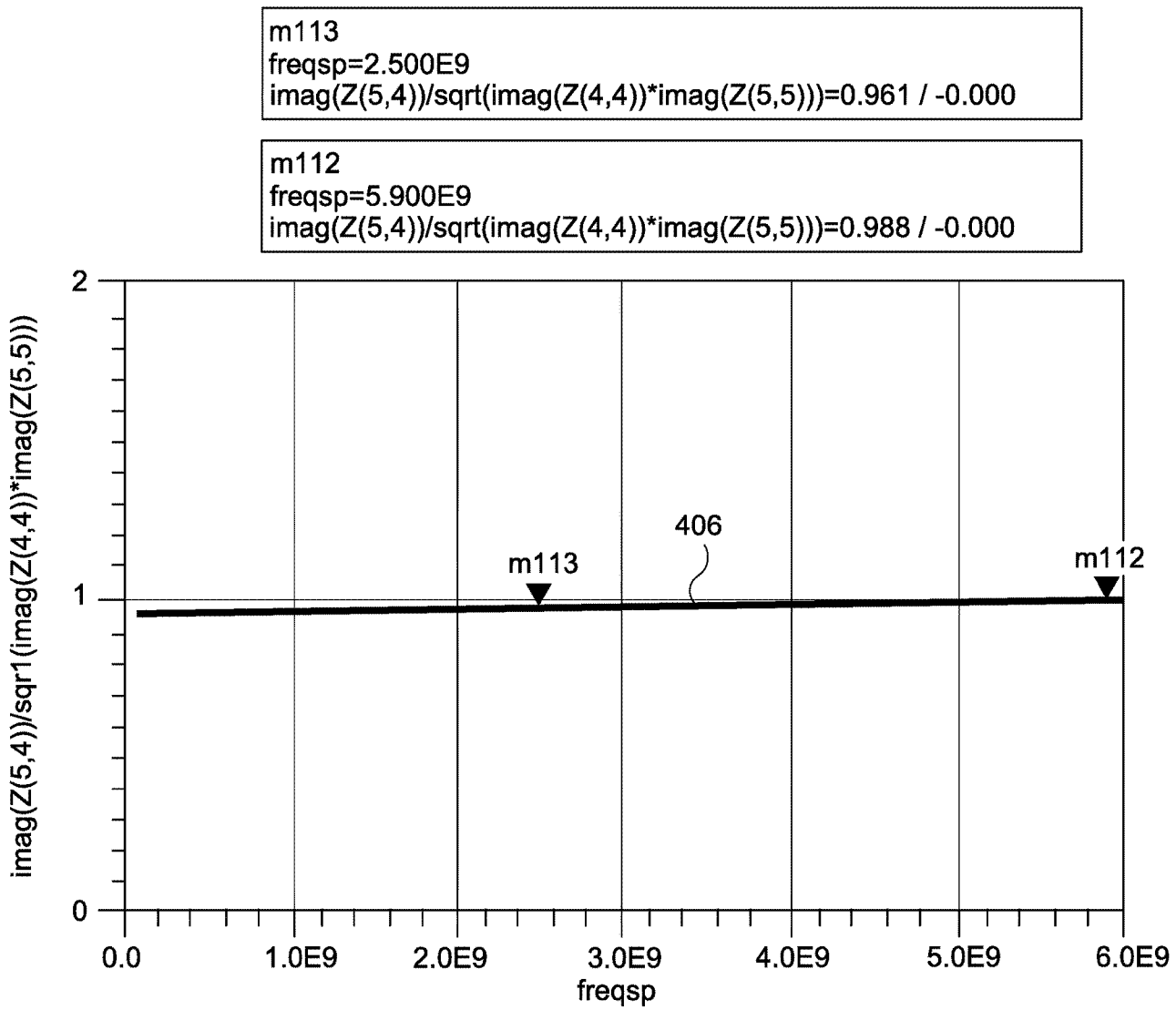

The graphs of FIGS. 4A-4D plot simulated inductance characteristics of the first embodiment of the transformer 10*a* at different operating frequencies. This simulation, as well as the other simulations discussed herein with respect to the other embodiments of the transformer 10, has been performed with Momentum EM and Golden Gate simulation tools. In further detail, FIG. 4A includes a first plot 400 of the inductance of the primary winding inductor 12. A marker m106 shows that at approximately 5.9 GHz, the inductance is approximately 10.30 nH, and a marker m107 shows that at approximately 2.5 GHz, the inductance is approximately 5.7 nH. The graph of FIG. 4B includes a second plot 402 of the inductance of the secondary winding inductor 14. A marker m108 shows that at approximately 5.9 GHz, the inductance is approximately 10.93 nH, and a marker m109 shows that at approximately 2.5 GHz, the inductance is approximately 5.6 nH. The graph of FIG. 4C includes a plot 404 of a mutual inductance of the primary winding inductor 12 and the secondary winding inductor 14. A marker m110 indicates that at approximately 5.9 GHz, the mutual inductance is approximately 10.5 nH, and a marker m111 indicates that at approximately 2.5 GHz, the mutual inductance is approximately 10.49 nH. Furthermore, the graph of FIG. 4D is of the coupling factor of the first embodiment of the transformer 10*a*, which is shown on plot 406. A marker m112 shows that the coupling factor k is 0.988 at 5.9 GHz, while a marker m113 shows that the coupling factor k is 0.961 at 2.5 GHz. In FIGS. 4A-4C, the vertical axis plots the inductance in Henries [H] and the horizontal axis is the frequency in Hertz [Hz].

Figure 5A:
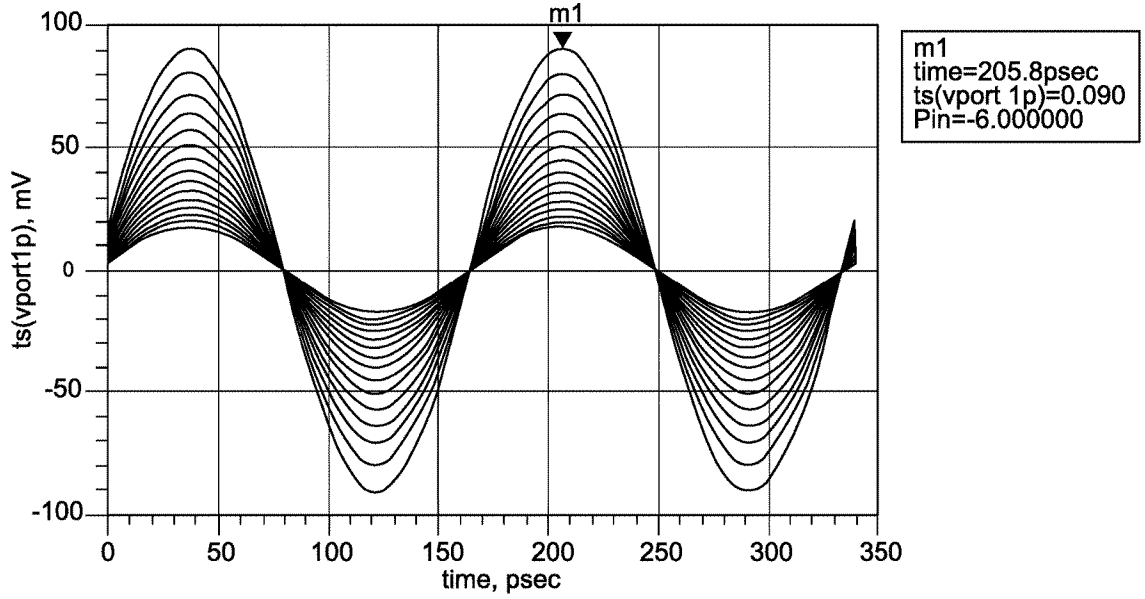
FIG. 5A is a graph plotting a single ended input to the first embodiment of the transformer shown in FIGS. 1A and 1B over a power sweep from −20 dBm to −6 dBm.
Figure 5B:
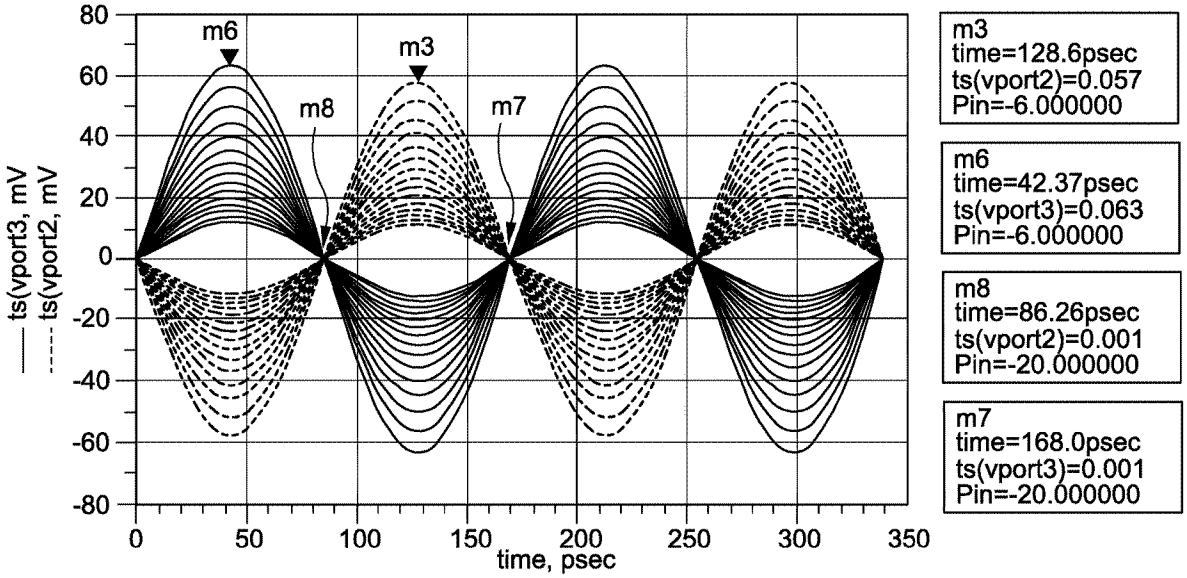
FIG. 5B is a graph plotting a differential output from the first embodiment of the transformer shown in FIGS. 1A and 1B over the power sweep from −20 dBm to −6 dBm.

The graph of FIG. 5A shows time-domain waveform plots across a sweep of −20 dBm to −6 dBm of an example single ended input to the first embodiment of the transformer 10*a*. The frequency of the input waveform is 5.9 GHz, at which the first embodiment of the transformer 10*a* is understood to have a coupling factor k of 0.988. The graph of FIG. 5B shows the differential output of the first embodiment of the transformer 10*a* across the aforementioned power sweep.

Figure 6A:
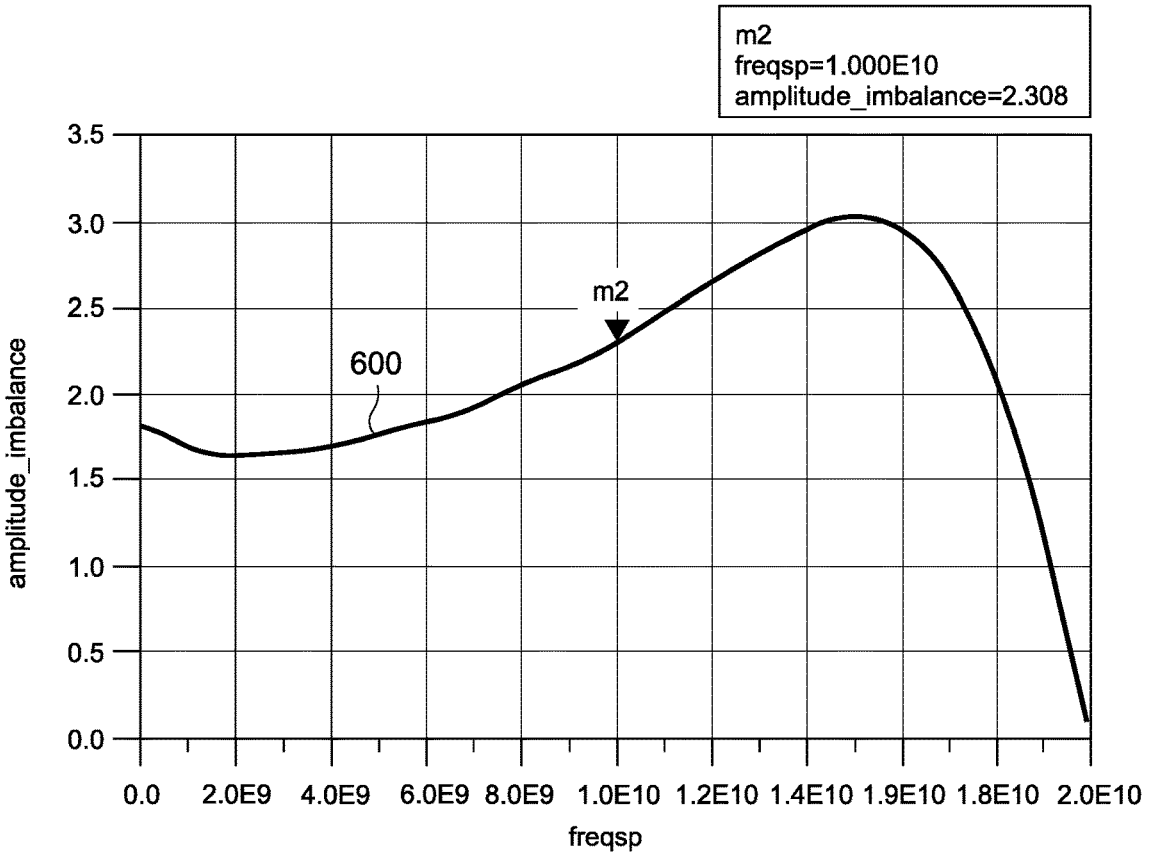
FIGS. 6A-6B are graphs plotting small signal amplitude imbalance and phase imbalance, respectively, of the first embodiment of the transformer shown in FIGS. 1A and 1B.
Figure 6B:
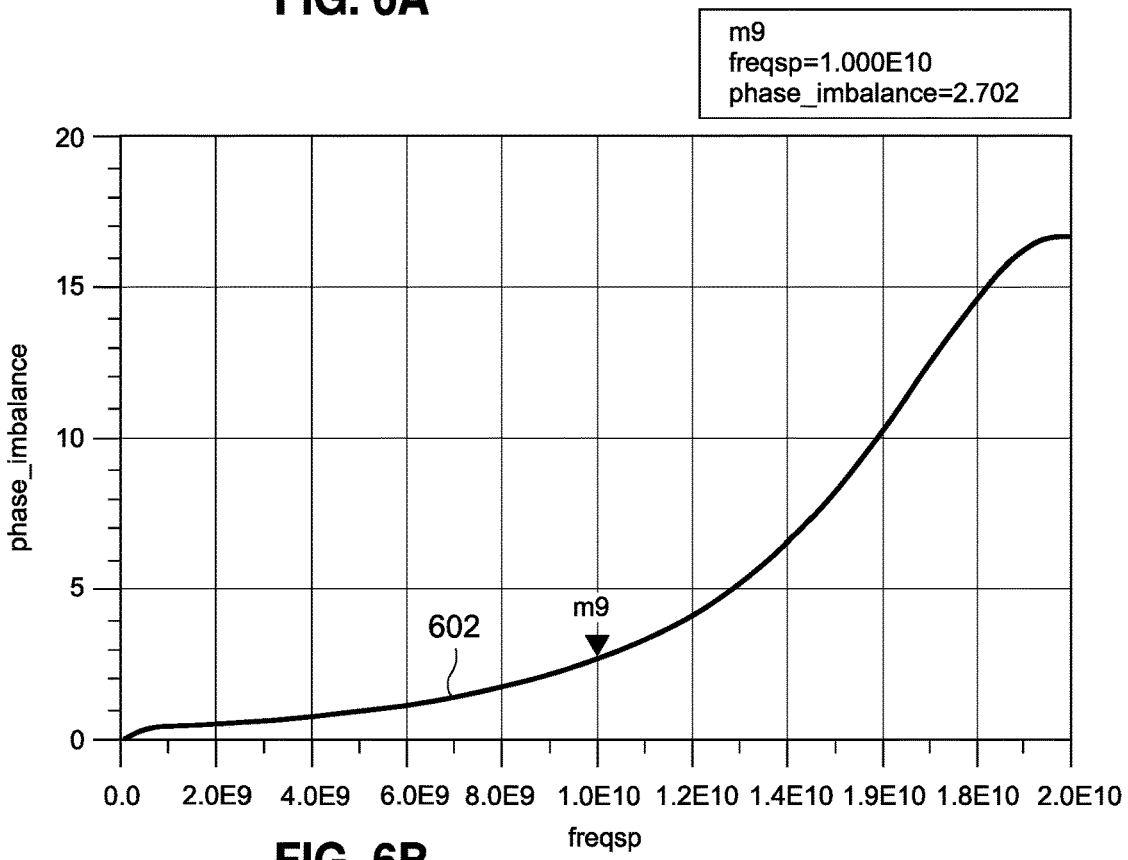

The graphs of FIGS. 6A and 6B show that the small signal amplitude imbalance in [dB] and the phase imbalance in [degrees] of the first embodiment of the transformer 10*a* are minimal. More particularly, the graph of FIG. 6A includes a plot 600 of an amplitude imbalance over different frequencies derived from the S-parameters of a three-port network in which the input port is designated as port P1, the first differential output port is designated as port P2, and the second differential output port is designated as port P3. The amplitude balance is defined as 20 log (S(3,1)/S(2/1)), and a marker m2 indicates that up to 10 GHz, this value remains lower than 2.3 dB. The graph of FIG. 6B includes a plot 602 of a phase imbalance over multiple frequencies, which is defined as the angular component of (S(3,1)/S(2,1)). As shown by a marker m9, up to 10 GHz, phase imbalance remains lower than 2.7 degrees.

Figures 7A, 7B:
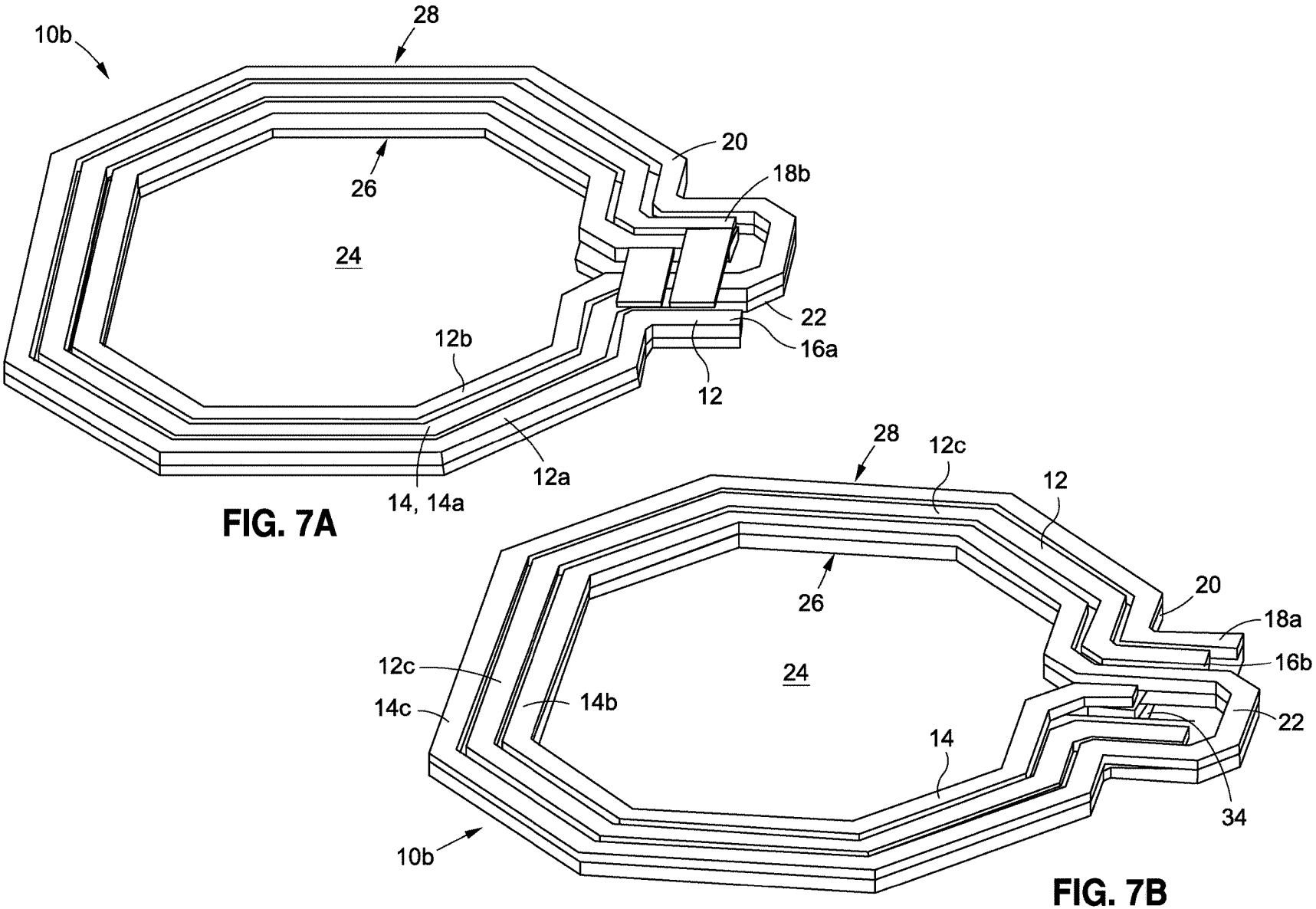
FIGS. 7A-7B are top and bottom perspective view, respectively, of a second embodiment of the transformer with a high coupling factor.

Referring to FIGS. 7A and 7B, a second embodiment of the transformer 10*b* also includes the primary winding inductor 12 and the secondary winding inductor 14. This embodiment is understood to be a simplified variation of the first embodiment of the transformer 10*a* with fewer turns, and without a crossover segment 30. The second embodiment of the transformer 10*b* also has an annular configuration including the interior opening 24 that is defined by an inner rim 26, as well as an outer rim 28. Each of the primary and secondary winding inductors 12, 14 are understood to have a spiral configuration, and are cross-coupled horizontally as well as vertically. The primary winding inductor 12 includes the first terminal 16*a* and the second terminal 16*b*, while the secondary winding inductor 14 includes the first terminal 18*a* and the second terminal 18*b*.

The primary winding inductor 12 and the secondary winding inductor 14 are disposed on both the first conductive layer 20 and the second conductive layer 22. As particularly illustrated in FIG. 7A, the primary winding inductor is defined by a first turn 12*a*, which represents the outer loop on the first conductive layer 20 that defines a part of the outer rim 28, and a second turn 12*b*, which represents the inner loop on the first conductive layer 20 that defines a part of the inner rim 26. A first turn 14*a* of the secondary winding inductor 14 disposed on the first conductive layer 20 is enclosed by the first turn 12*a* and the second turn 12*b*.

From an end of the second turn 12*b* of the primary winding inductor 12, the interlayer coupling 34 interconnects the first conductive layer 20 to the second conductive layer 22, that is, between the respective segments of the primary winding inductor 12 disposed thereon. Along these lines, from an end of the first turn 14*a* of the secondary winding inductor 14 on the first conductive layer 20, there is also the interlayer coupling 34 that interconnects the first conductive layer 20 to the second conductive layer 22. With reference to FIG. 7B, on the second conductive layer 22, there is a second turn 14*b* of the secondary winding inductor 14, as well as a third turn 14*c* of the secondary winding inductor 14. On the second conductive layer 22, the second turn 14*b* and the third turn 14*c* enclose the primary winding inductor 12, which has a third turn 12*c*.

Again, the various turns of the primary winding inductor 12 are axially aligned with and vertically offset from corresponding turns of the secondary winding inductor 14. In more detail, the first turn 12*a* of the primary winding inductor 12 is axially aligned with and vertically offset from the secondary winding inductor 14, specifically, the third turn 14*c* thereof. The second turn 12*b* of the primary winding inductor 12 is also axially aligned with and vertically offset from the secondary winding inductor 14, specifically, the second turn 14*b* thereof. Finally, the third turn 12*c* of the primary winding inductor 12 is axially aligned with and vertically offset from the first turn 14*a* of the secondary winding inductor 14.

Figure 8A:
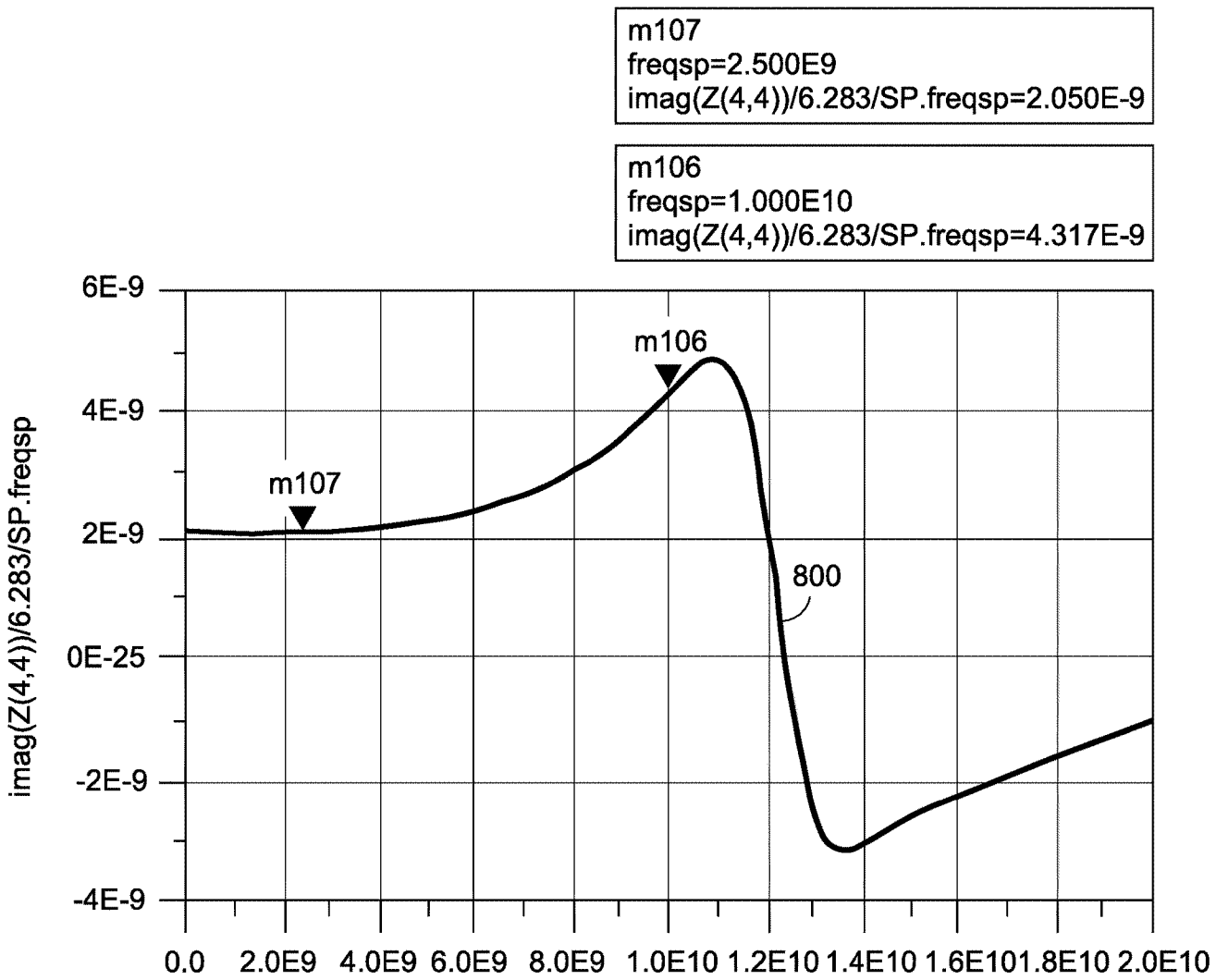
FIGS. 8A-8D are graphs showing simulation results of a primary winding inductance, a secondary winding inductance, a mutual inductance, and a coupling factor, respectively, of the second embodiment of the transformer depicted in FIGS. 7A and 7B across a frequency sweep.
Figure 8B:
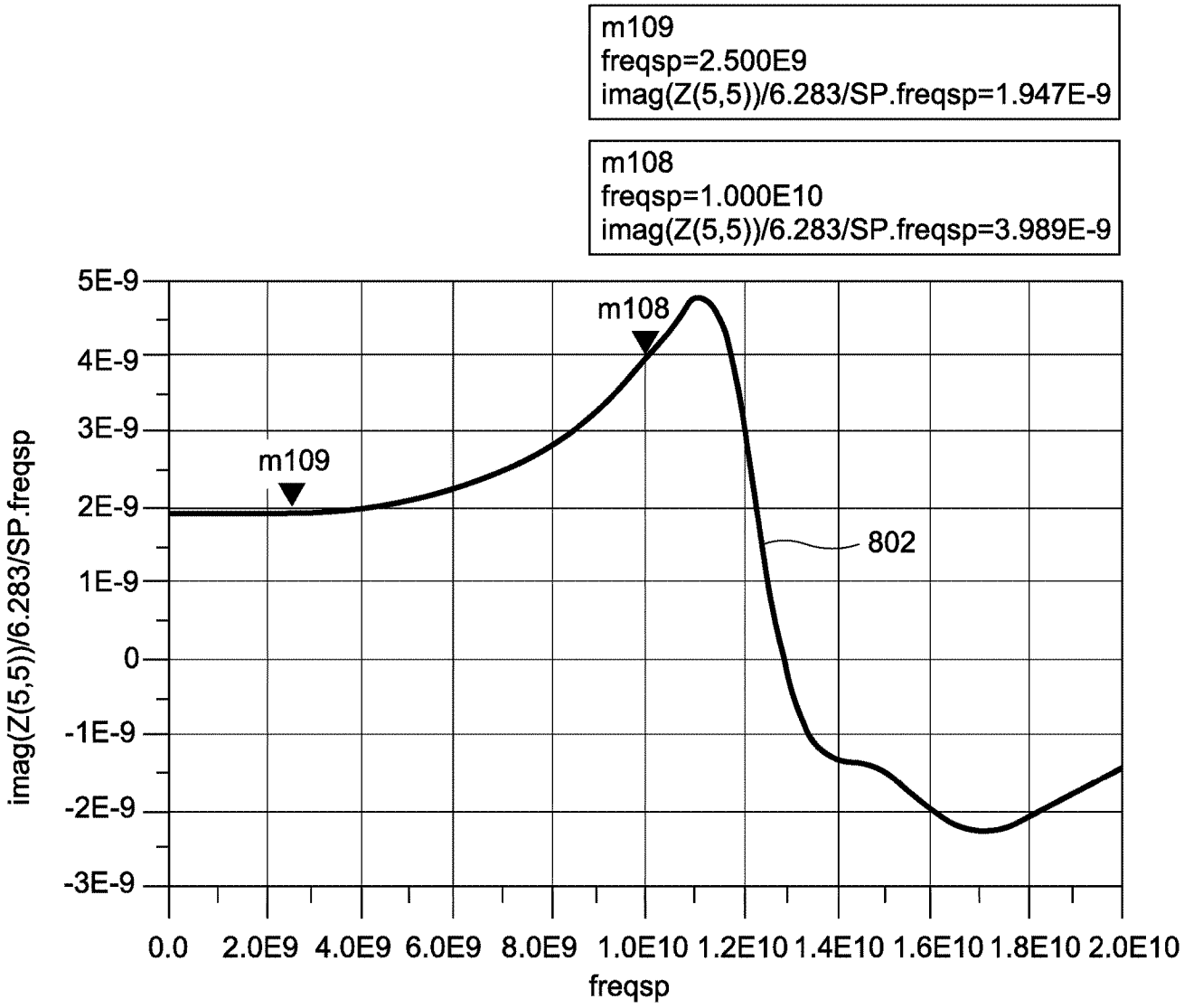
Figure 8C:
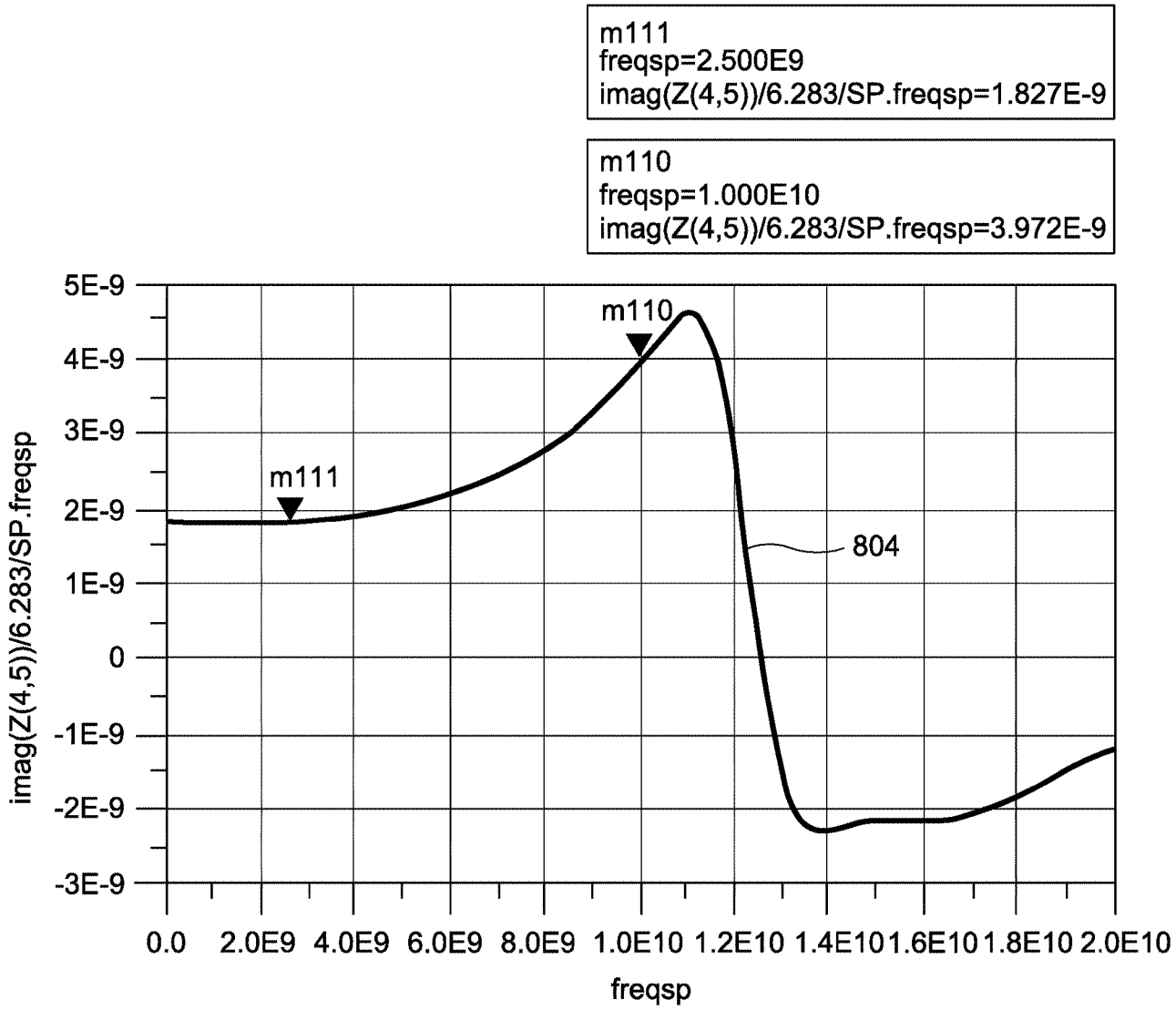
Figure 8D:
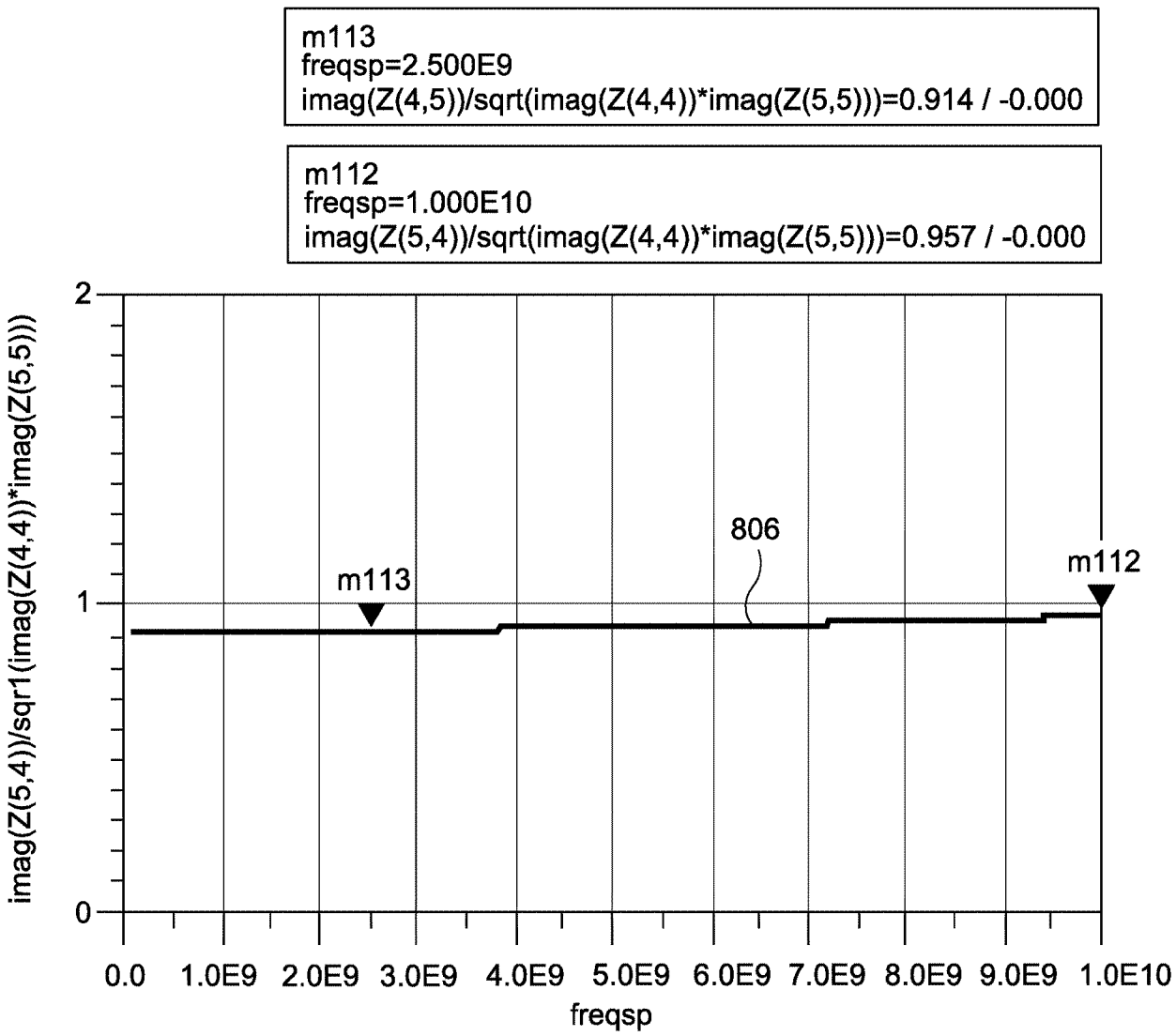

The graphs of FIGS. 8A-8D plot simulated inductance characteristics in [H] of the second embodiment of the transformer 10*b* at different operating frequencies. The simulated results are based on standard CMOS processes using the top two metal layers. More particularly, FIG. 8A includes a first plot 800 of the inductance of the primary winding inductor 12. A marker m106 shows that at approximately 10 GHz, the inductance is approximately 4.3 nH, and a marker m107 shows that at approximately 2.5 GHz, the inductance is approximately 2 nH. The graph of FIG. 8B includes a second plot 802 of the inductance of the secondary winding inductor 14. A marker m108 shows that at approximately 10 GHz, the inductance is approximately 3.9 nH, and a marker m109 shows that at approximately 2.5 GHz, the inductance is approximately 1.9 nH. The graph of FIG. 8C includes a plot 804 of a mutual inductance of the primary winding inductor 12 and the secondary winding inductor 14. A marker m110 indicates that at approximately 10 GHz, the mutual inductance is approximately 3.9 nH, and a marker m111 indicates that at approximately 2.5 GHz, the mutual inductance is approximately 1.8 nH. Furthermore, the graph of FIG. 8D is of the coupling factor of the second embodiment of the transformer 10*b*, which is shown on plot 408. A marker m112 shows that the coupling factor k is 0.957 at 10 GHz, while a marker m113 shows that the coupling factor k is 0.914 at 2.5 GHz.

Figure 9A:
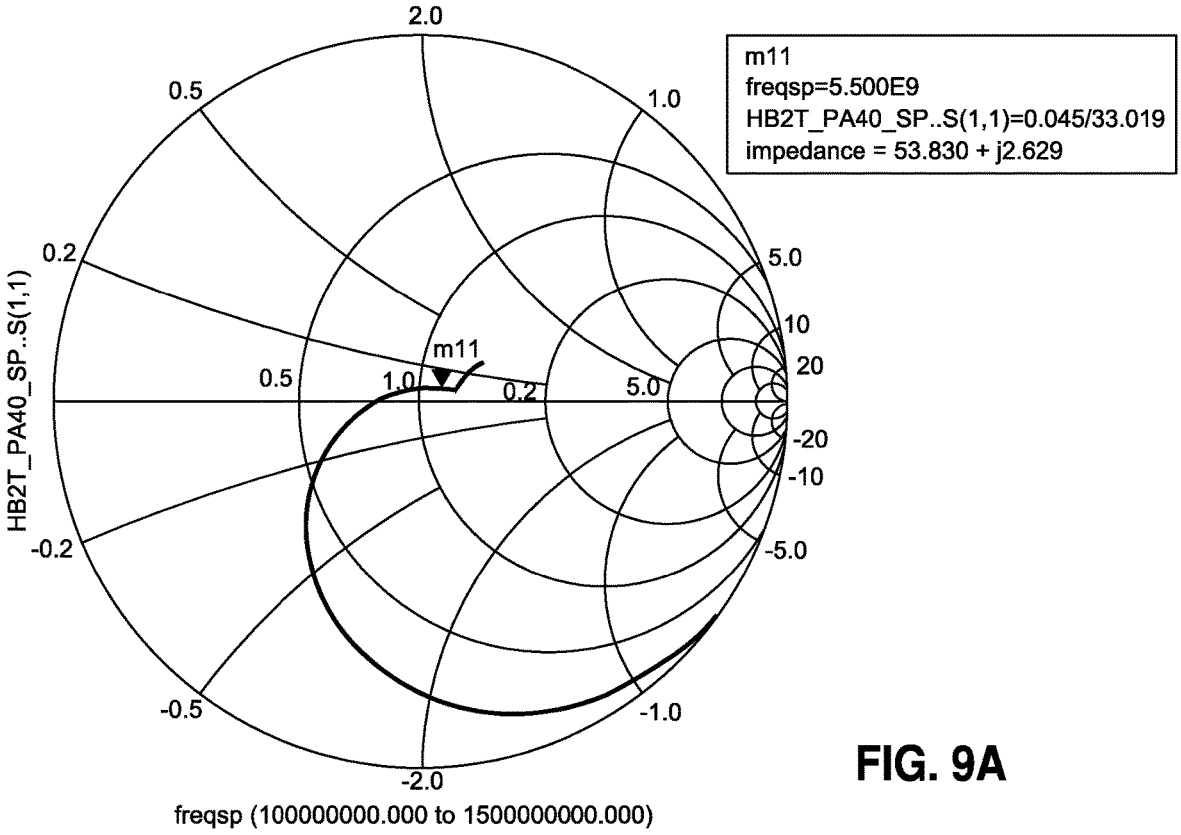
FIGS. 9A-9B are Smith charts showing the simulated S-parameters for the primary windings and the secondary windings, respectively, of the second embodiment of the transformer depicted in FIGS. 7A and 7B across a frequency sweep.
Figure 9B:
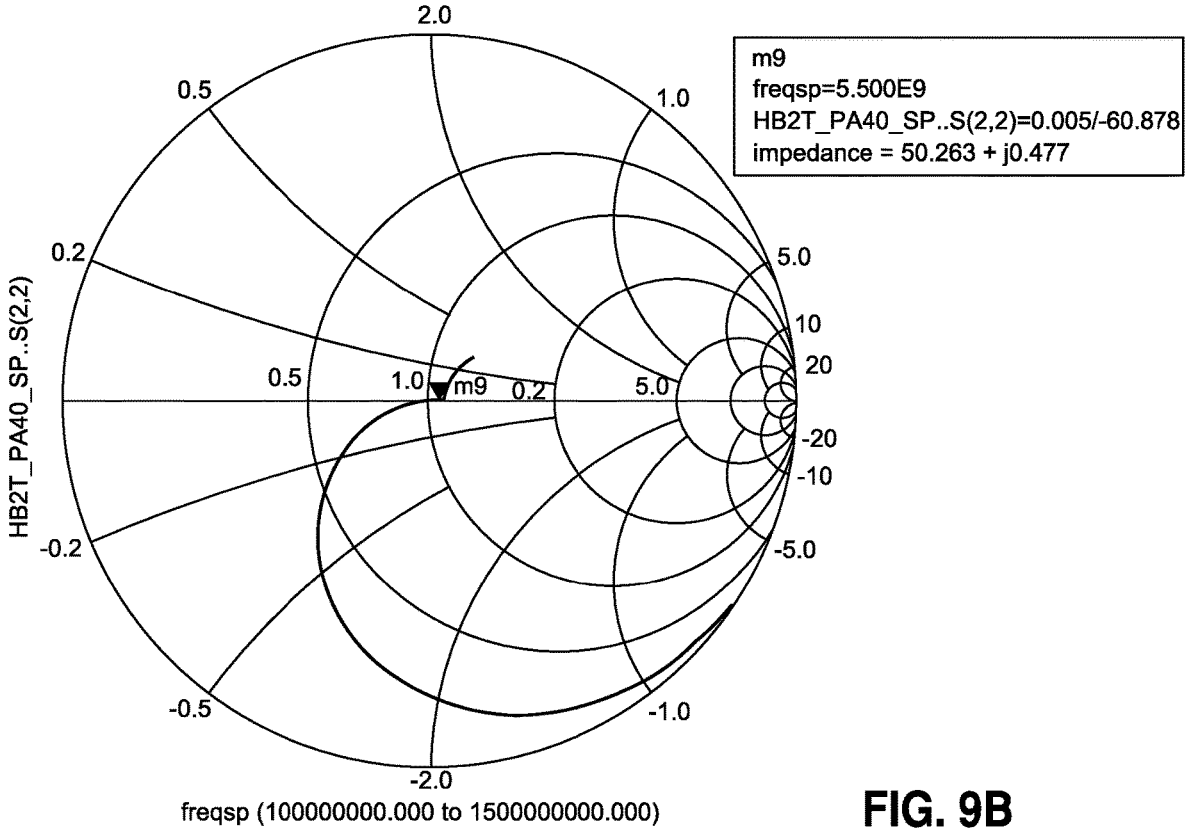
Figure 10:
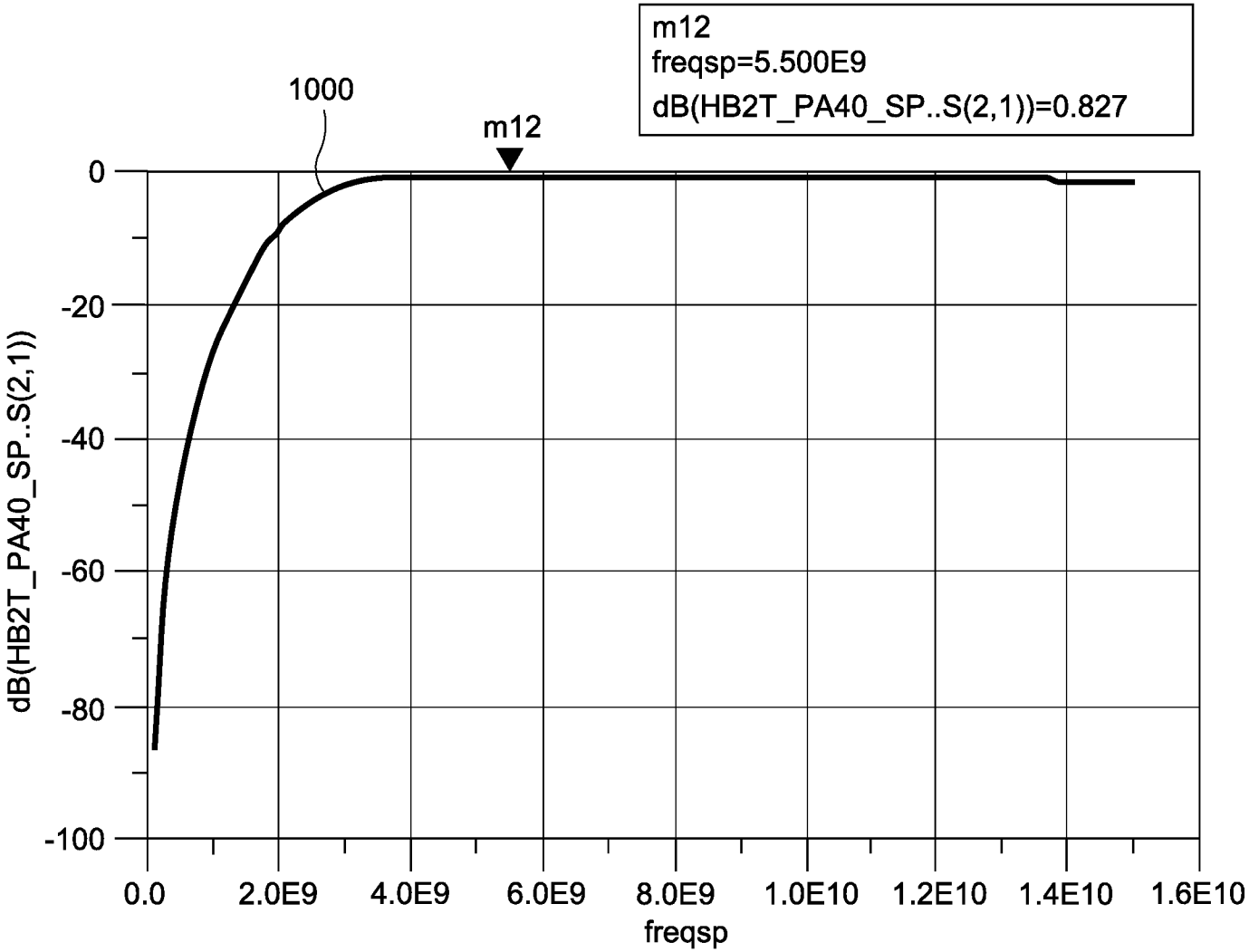
FIG. 10 is a graph showing simulation results of insertion loss of the second embodiment of the transformer depicted in FIGS. 7A and 7B.

The Smith charts of FIGS. 9A and 9B plot the simulated S-parameters of the second embodiment of the transformer 10*b*. Again, the simulations are based on a standard CMOS process using the top two metal layers. More particularly, the Smith chart of FIG. 9A is for the primary winding inductor 12 and the Smith chart of FIG. 9B is for the secondary winding inductor 14. As illustrated, the impedance of the primary winding inductor 12 and the impedance of the secondary winding inductor 14 are both 50 Ohm. Furthermore, the graph of FIG. 10 shows, in a plot 1000, the simulated insertion loss in [dB] of the second embodiment of the transformer 10*b* across a frequency sweep. As indicated by marker m12, at 5.5 GHz, the insertion loss is approximately 0.827 dB.

Figure 11B:
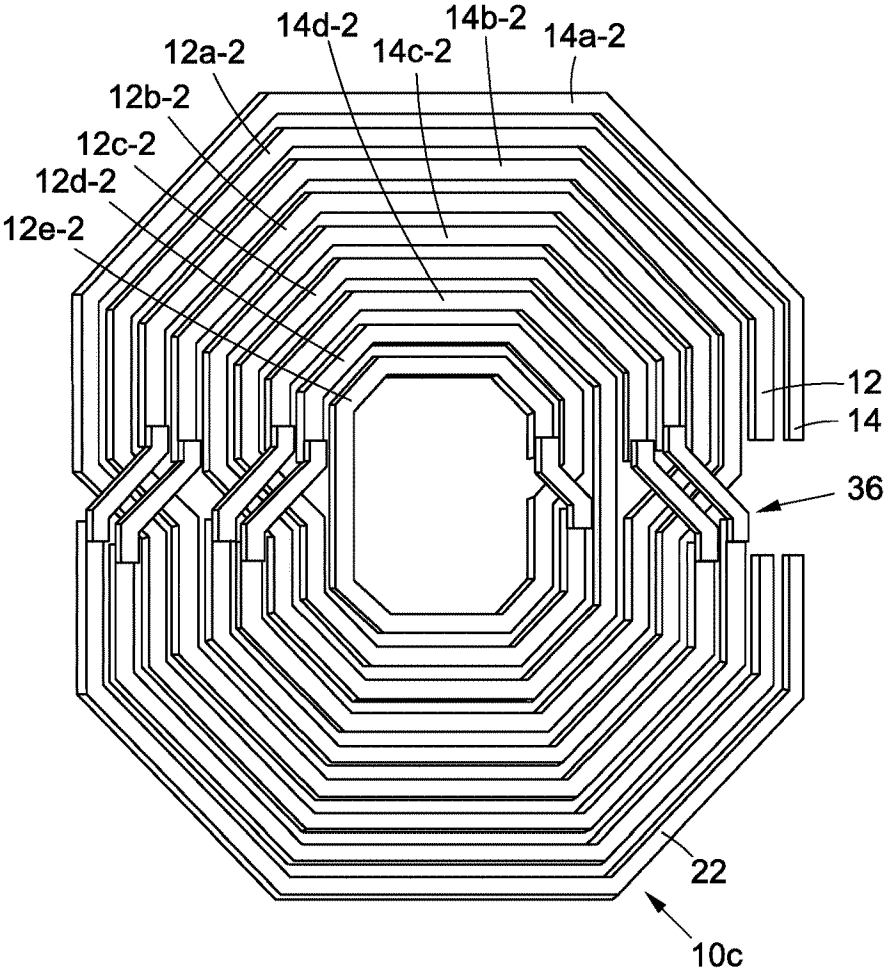
FIGS. 11A-11B are top and bottom plan views, respectively, of a third embodiment of the transformer for balanced to unbalanced signal lines.
Figure 11A:
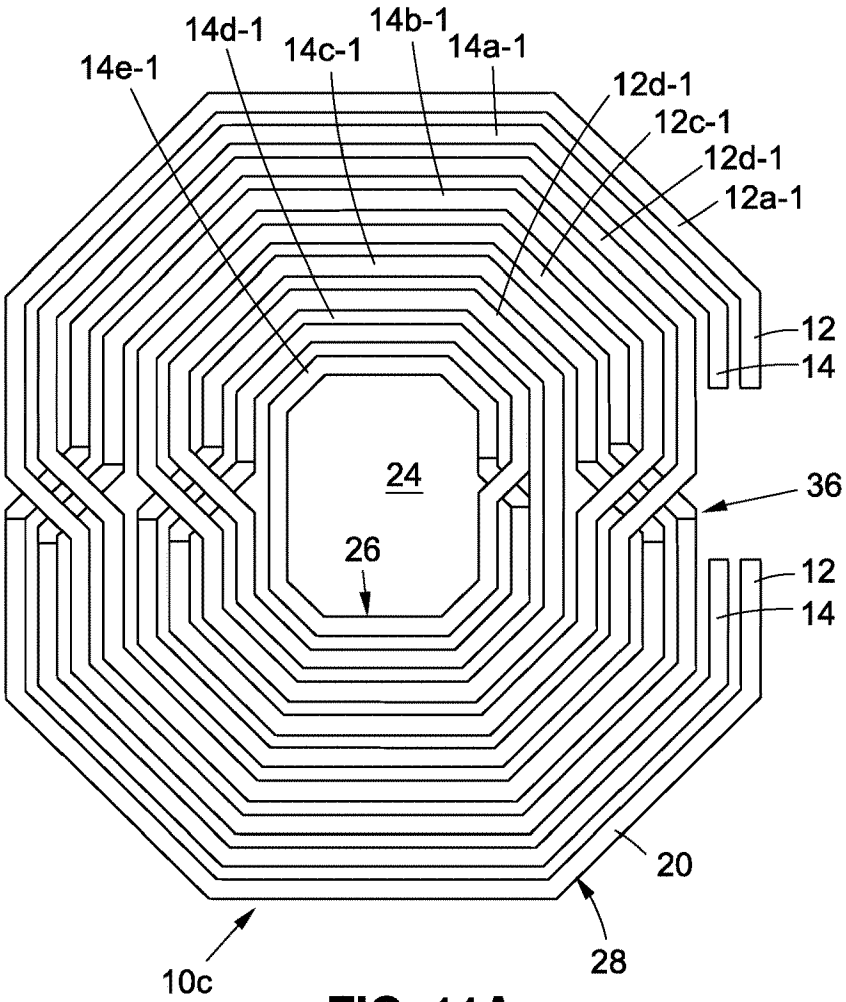
Figure 12A:
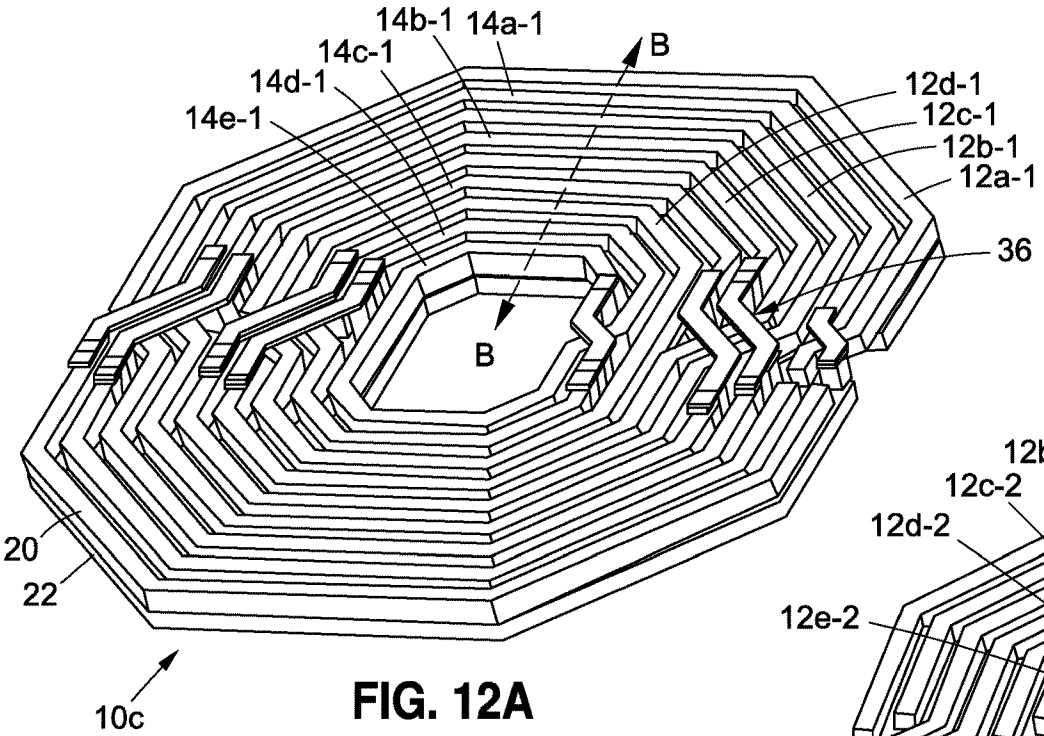
FIGS. 12A-12B are top and bottom perspective views, respectively, of the third embodiment of the transformer.

A third embodiment of the transformer 10*c* that may be utilized as a balanced to unbalanced (balun) transformer will now be described with reference to FIGS. 11A, 11B, 12A, 12B, 13 and 14. By way of example, the third embodiment of the transformer 10*c* may be suitable for differential power amplifiers for 5 GHz 802.11ac applications Like the other embodiments, the third embodiment of the transformer 10*c* is comprised of the primary winding inductor 12 and the secondary winding inductor 14, which span both the first conductive layer 20 and the second conductive layer 22 and have a spiral configuration. Furthermore, the third embodiment of the transformer 10*c* likewise has an annular configuration defined by the outer rim 28 and an inner rim 26, along with the interior opening 24. FIG. 11A is a top plan view of the third embodiment of the transformer 10*c* showing the layout of the conductive signal traces on the first conductive layer 20, while FIG. 11B is a bottom plan view of the same third embodiment of the transformer 10*c* showing the layout of conductive signal traces on the second conductive layer 22. FIG. 12A is a perspective view predominantly showing a top face/first conductive layer 20, and FIG. 12B is a perspective view predominantly showing a bottom face/second conductive layer 22.

Figure 12B:
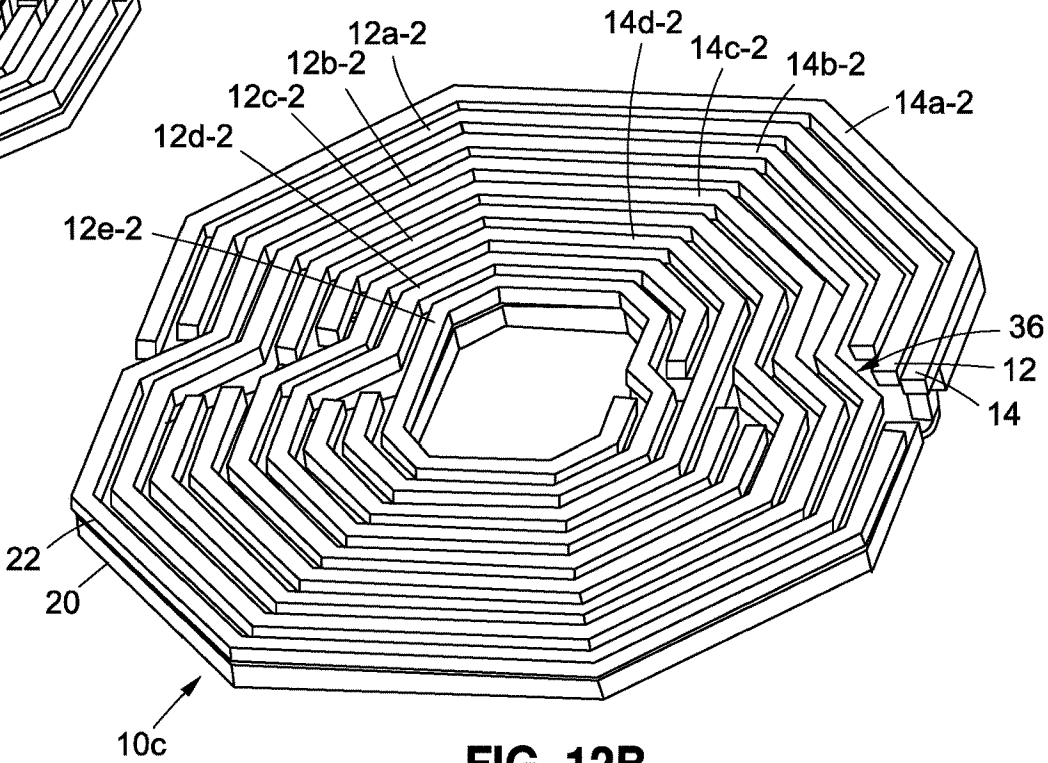
Figure 13:
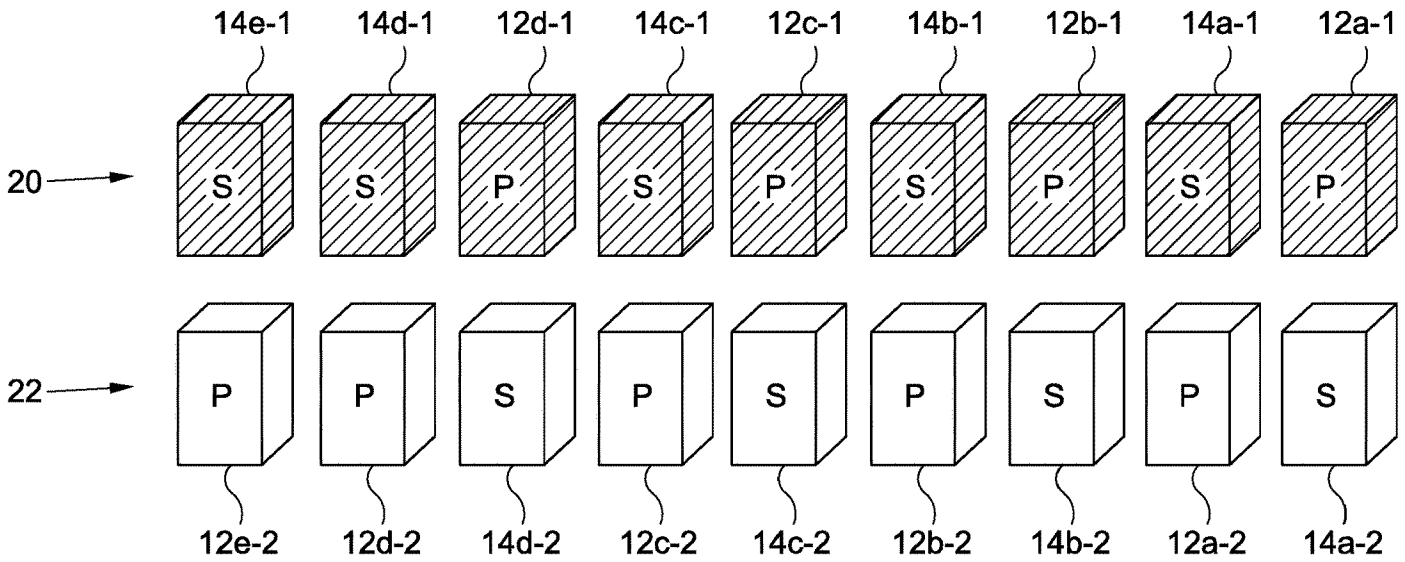
FIG. 13 is a cross-sectional view of the third embodiment of the transformer along axis A-A of FIGS. 12A and B-B of FIG. 12B.

With specific reference to FIGS. 11A, 12B, and 13, the parts of the primary winding inductor 12 that are on the first conductive layer 20 include a first turn 12*a*-1, a second turn 12*b*-1, a third turn 12*c*-1, and a fourth turn 12*d*-1. In embodiments utilizing conventional CMOS fabrication processes, the first conductive layer 20 is understood to be the Aluminum layer (AP). The first turn 12*a*-1 is the outermost portion of the spiral of the primary winding inductor 12, as well as of the overall structure of the third embodiment of the transformer 10*c*.

Certain segments of the secondary winding inductor 14 are also on the first conductive layer 20. These include a first turn 14*a*-1, a second turn 14*b*-1, a third turn 14*c*-1, a fourth turn 14*d*-1, and a fifth turn 14*e*-1. As illustrated, the turns of the primary winding inductor 12 successively alternate with the turns of the secondary winding inductor 14 except for the fifth turn 14*e*-1, which is adjacent to the fourth turn 14*d*-1. For instance, the first turn 12*a*-1 of the primary winding inductor 12 is adjacent to the first turn 14*a*-1 of the secondary winding inductor 14, which in turn is adjacent to the second turn 12*b*-1 of the primary winding inductor 12, and so on. The extra fifth turn 14*e*-1 is added so that the total length of the secondary winding inductor 14 disposed on the first conductive layer 20 is equal to the length of the primary winding inductor 12 also disposed on the first conductive layer 20.

Referring now to FIGS. 11B, 12B and 13, the parts of the primary winding inductor 12 that are on the second conductive layer 22 include a first turn 14*a*-2, a second turn 14*b*-2, a third turn 14*c*-2, and a fourth turn 14*d*-2. In embodiments utilizing conventional CMOS fabrication processes, the second conductive layer 22 is understood to be the metal 8 layer (m8). The first turn 14*a*-2 is the outermost portion of the spiral of the secondary winding inductor 14, as well as of the overall structure of the third embodiment of the transformer 10*c*.

Certain segments of the primary winding inductor 12 are also on the second conductive layer 22. These include a first turn 12*a*-2, a second turn 12*b*-2, a third turn 12*c*-2, a fourth turn 12*d*-2, and a fifth turn 12*e*-2. The turns of the secondary winding inductor 14 successively alternate with the turns of the primary winding inductor 12 except for the fifth turn 12*e*-2, which is adjacent to the fourth turn 12*d*-2. The first turn 14*a*-2 of the secondary winding inductor 14 is adjacent to the first turn 12*a*-2 of the primary winding inductor 12, which in turn is adjacent to the second turn 14*b*-2 of the secondary winding inductor 14, and so on. The extra fifth turn 12*e*-2 is added so that the total length of the primary winding inductor 12 disposed on the second conductive layer 22 is equal to the length of the secondary winding inductor 14 also disposed on the second conductive layer 22.

Like the previously discussed first embodiment of the transformer 10*a*, in the third embodiment of the transformer 10*c*, the primary winding inductor 12 and the secondary winding inductor 14 are also vertically cross-coupled. As shown in FIG. 13, the first turn 12*a*-1 of the primary winding inductor 12 on the first conductive layer 20 overlaps and is vertically offset from the first turn 14*a*-2 of the secondary winding inductor 14 on the second conductive layer 22. Furthermore, the first turn 14*a*-1 of the secondary winding inductor 14 on the first conductive layer 20 overlaps and is vertically offset from the second turn 12*b*-2 of the primary winding inductor 12 on the second conductive layer 22. This configuration continues for the remainder of the turns.

Figure 14:
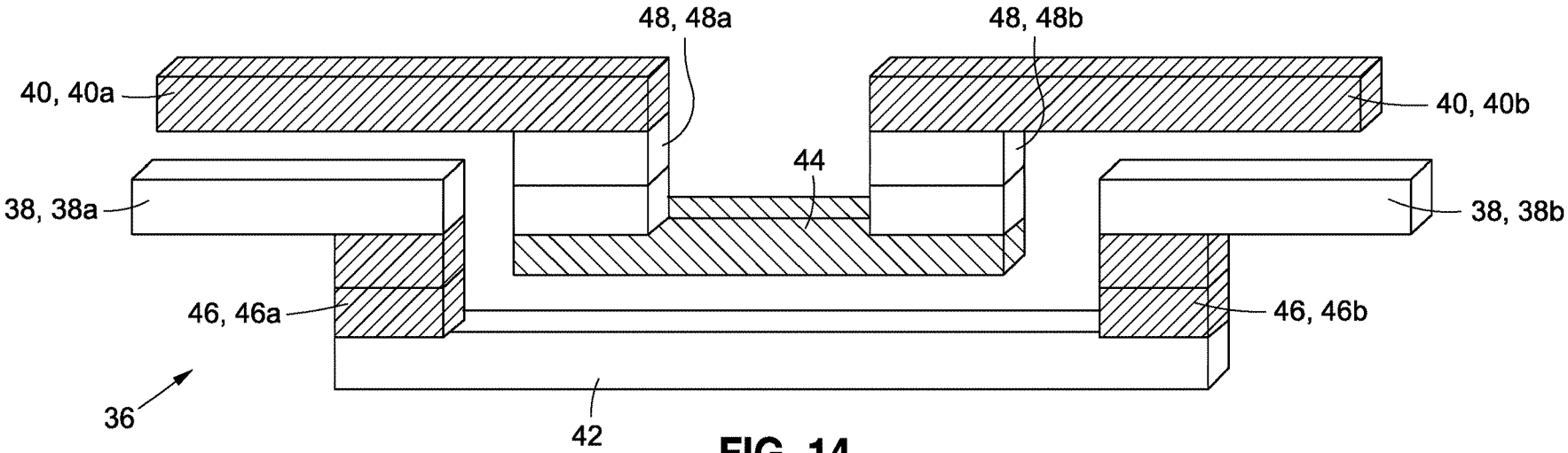
FIG. 14 is a detailed perspective view of an exemplary double bridge interconnect that is utilized in the third embodiment of the transformer.

The routing of multiple alternating horizontal and vertical sequences of the turns of the primary winding inductor 12 and the secondary winding inductor 14 over the first conductive layer 20 and the second conductive layer 22 may be achieved with a double bridge interconnect 36. The primary winding inductor 12 remains electrically isolated from the secondary winding inductor 14 while being electromagnetically coupled. With reference to FIG. 14, the double bridge interconnect 36 is generally comprised of a primary base level trace 38, which is segregated into a first segment 38*a* and a second segment 38*b*, as well as a secondary base level trace 40, which is segregated into a first segment 40*a* and a second segment 40*b*. The primary base level trace 38 is substantially parallel with the secondary base level trace 40, and is vertically offset therefrom by a predefined distance. As referenced herein, substantially parallel refers to the planes on which the respective primary base level trace 38 and secondary base level trace 40 are defined being parallel, and not necessarily to the lengthwise axis of the traces being parallel, as otherwise shown in FIG. 14.

The double bridge interconnect 36 is further comprised of a primary deck level trace 42 and a secondary deck level trace 44, which are substantially parallel to each other. Again, this refers to the places on which the respective deck level traces 42, 44 are defined being parallel, and not lengthwise axis of the traces being parallel, though this is a possibility. The primary base level trace 38 is vertically offset from the primary deck level trace 42 by a primary vertical trace 46, which electrically and mechanically connects the primary base level trace 38 to the primary deck level trace 42. Specifically, there is a first primary vertical trace 46*a* that connects the first segment 38*a* to the primary deck level trace 42, as well as a second primary vertical trace 46*b* that connects the second segment 38*b* to the primary deck level trace. Along these lines, the secondary base level trace 40 is vertically offset from the secondary deck level trace 44 by a secondary vertical trace 48. Likewise, there is a first secondary vertical trace 48*a* that connects the first segment 40*a* to the secondary deck level trace 44, and a second secondary vertical trace 48*b* that connects the second segment 40*b* to the secondary deck level trace 44.

Although the description of the double bridge interconnect 36 makes reference to "primary" and "secondary" traces, these are not intended to be limiting to the primary winding inductor 12 and the secondary winding inductor 14. That is, the primary base level trace 38, the primary deck level trace 42, and the primary vertical trace 46 may also be electrically connected to the secondary winding inductor 14, depending on the part of the transformer 10 in which it is being utilized.

Electromagnetic coupling is maintained through the length of the double bridge interconnect 36, including between the primary base level trace 38 and the secondary base level trace 40, between the primary deck level trace 42 and the secondary deck level trace 44, and between the respective segments of the primary vertical trace 46 and the secondary vertical trace 48.

The balun transformer that is the third embodiment of the transformer 10*c* in accordance with the present disclosure is understood to have a 1:1 ratio for use in connection with differential power amplifiers, the configuration may also be referred to as differential input matching shunt coupled inductors. Thus, the length and/or the number of turns of the primary winding inductor 12 and the secondary winding inductor 14 are understood to be equivalent or substantially equivalent. As understood, substantially equivalent refers to such dimensions as one of ordinary skill in the art would deem equivalent, or within acceptable ranges of tolerance of being equivalent. The size of the third embodiment of the transformer 10*c* is understood to be approximately 127 μm by 118 μm, with the inner size (which corresponds to the interior opening 24) being approximately 37 μm by 30 μm. However, any other suitable size may be readily substituted without departing from the present disclosure.

Figure 15A:
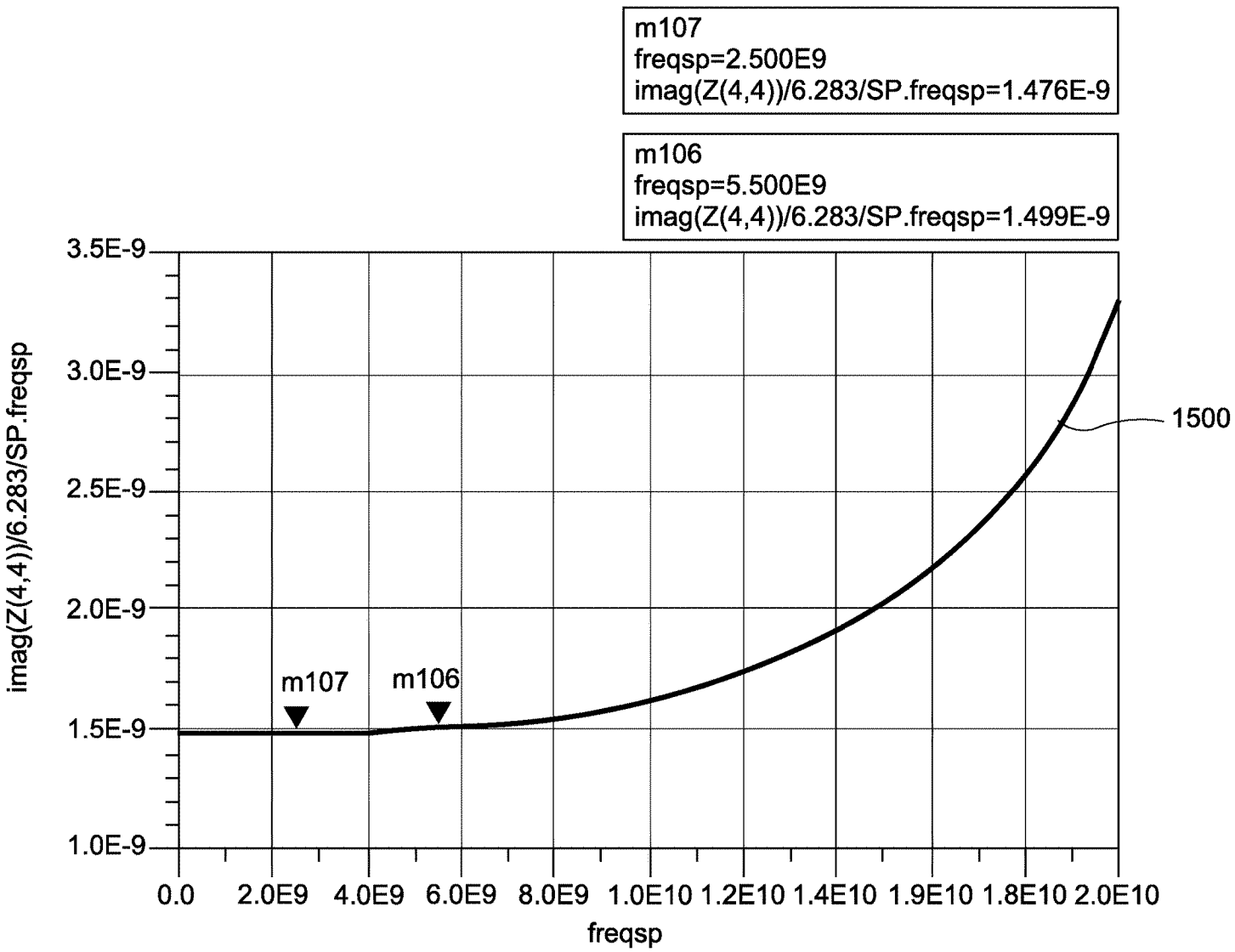
FIGS. 15A-15D are graphs showing simulation results of a primary winding inductance, a secondary winding inductance, a mutual inductance, and a coupling factor, respectively, of a primary winding inductor and a secondary winding inductor on one of the conductive layers as implemented in the third embodiment of the transformer, as shown in FIG. 11A, across a frequency sweep.
Figure 15B:
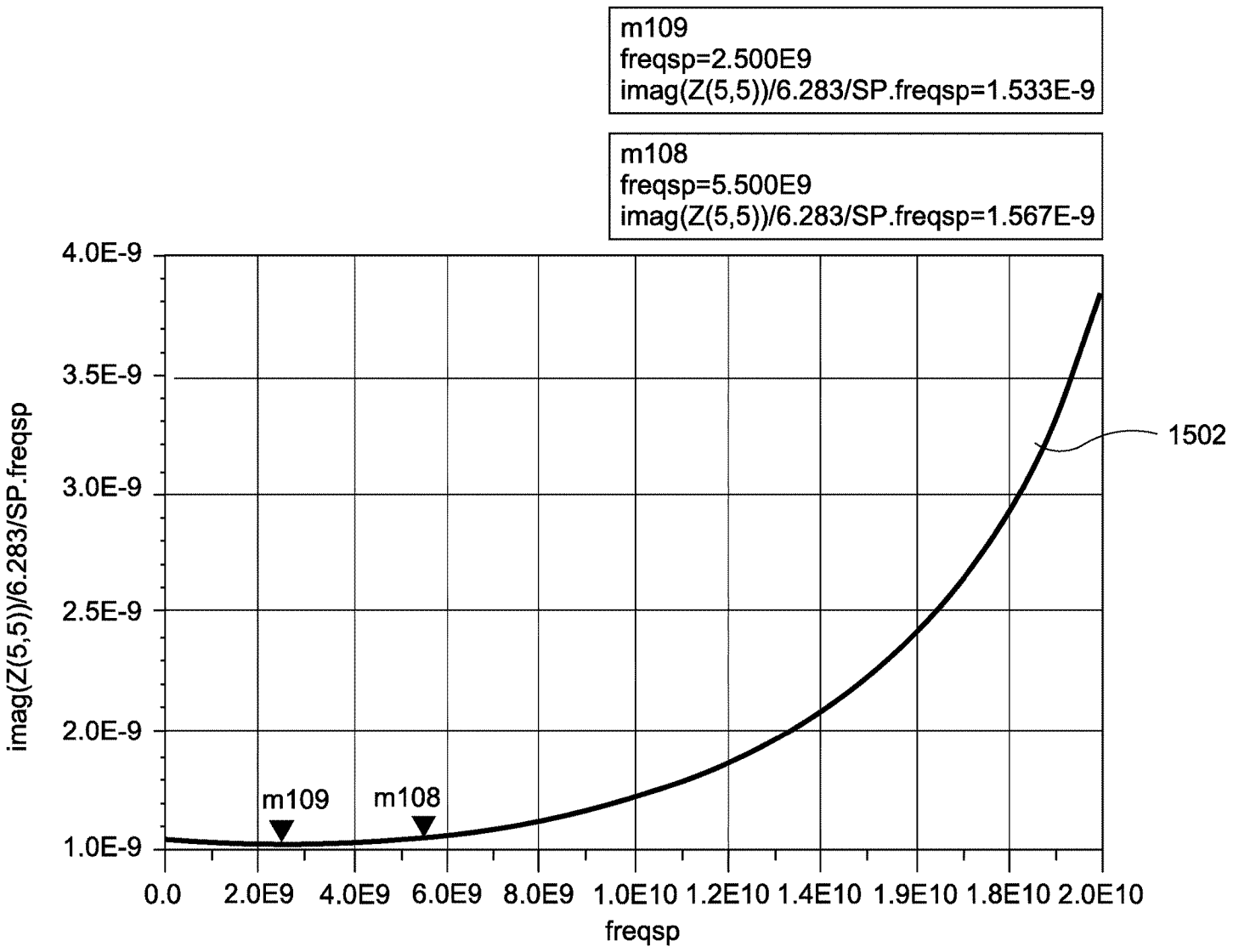
Figure 15C:
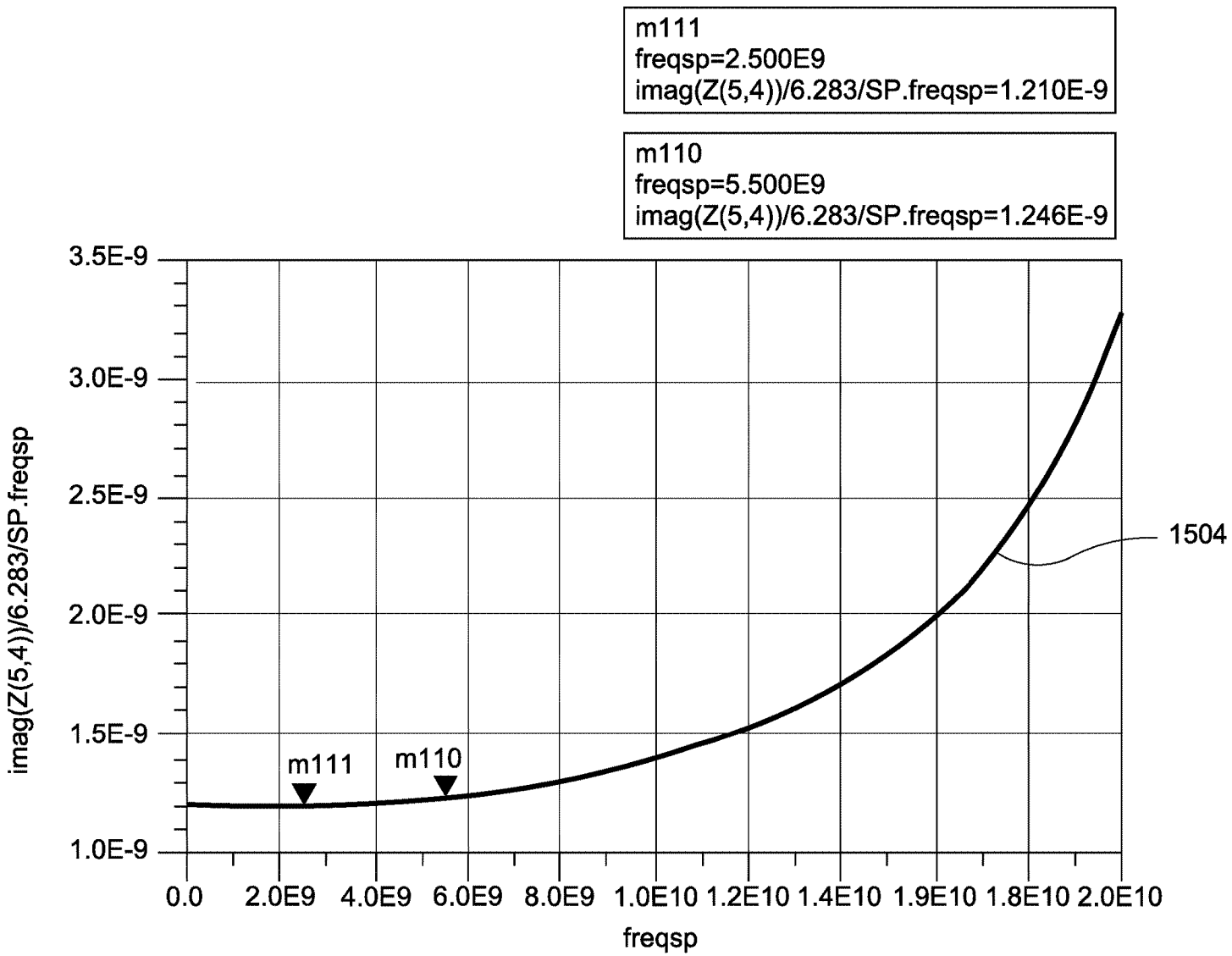
Figure 15D:
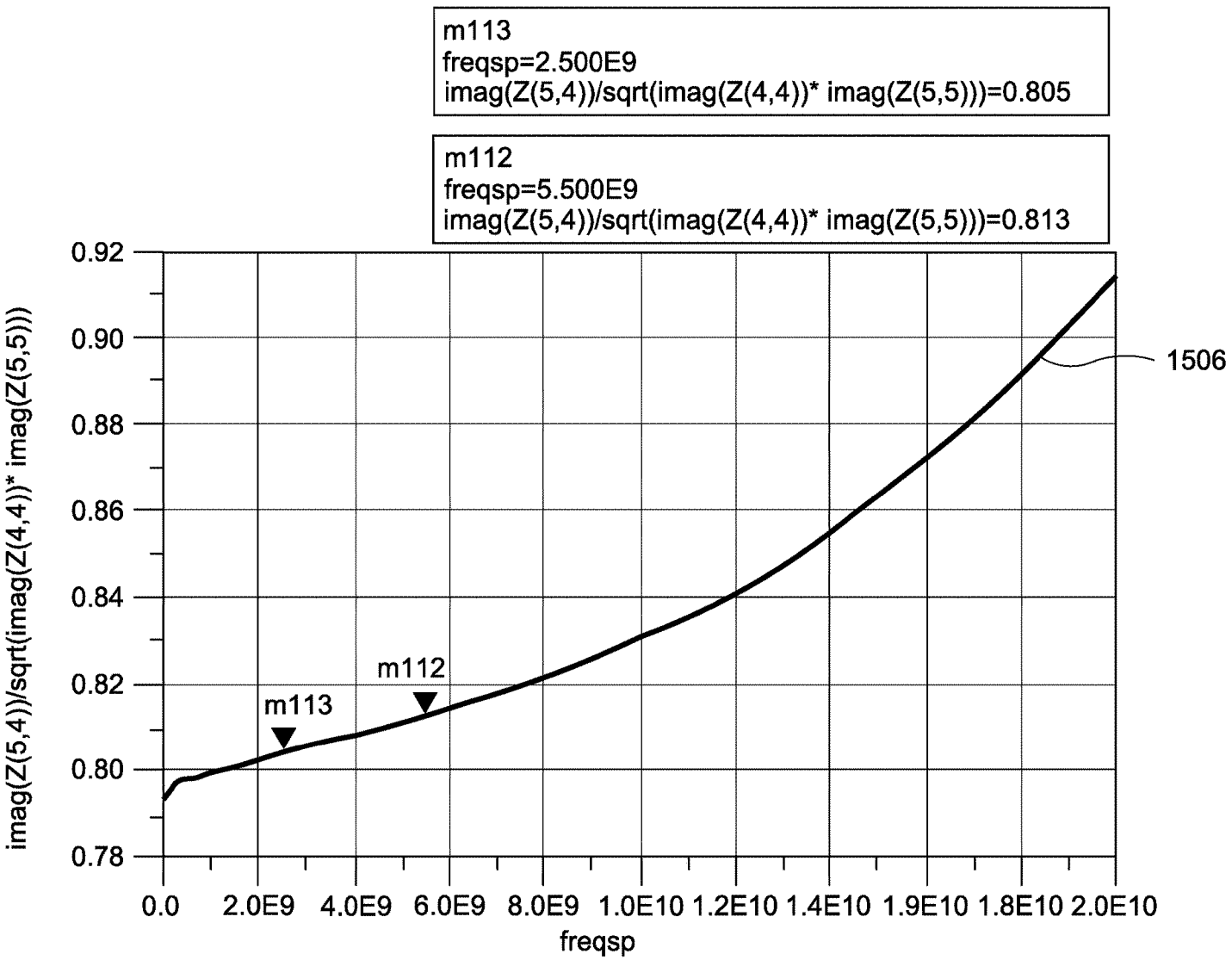

The graphs of FIGS. 15A-15D plot simulated inductance characteristics in [H] of one of the conductive layers utilized in the third embodiment of the transformer 10*c*, without it being connected to the primary winding inductor 12/secondary winding inductor 14 on the other conductive layer. FIG. 15A includes a first plot 1500 of the inductance of the primary winding inductor 12 on the first conductive layer 20 configured as shown in FIG. 11A. A marker m106 shows that at approximately 5.5 GHz, the inductance is approximately 1.499 nH, and a marker m107 shows that at approximately 2.5 GHz, the inductance is approximately 1.476 nH. The graph of FIG. 15B shows a second plot 1502 of the inductance of the secondary winding inductor 14 on the first conductive layer 20 also configured as shown in FIG. 11A. A marker m108 shows that at approximately 5.5 GHz, the inductance is approximately 1.567 nH, and a marker m109 shows that at approximately 2.5 GHz, the inductance is approximately 1.533 nH. The graph of FIG. 15C includes a plot 1504 of a mutual inductance of the primary winding inductor 12 and the secondary winding inductor 14 on the first conductive layer 20 configured as shown in FIG. 11A. A marker m110 indicates that at approximately 5.5 GHz, the mutual inductance is approximately 1.246 nH, and a marker m111 indicates that at approximately 2.5 GHz, the mutual inductance is approximately 1.210 nH. The graph of FIG. 15D is of the coupling factor of the primary winding inductor 12 and the secondary winding inductor 14 on the first conductive layer 20, shown as plot 1506. A marker m112 shows that the coupling factor k is 0.813 at 5.5 GHz, and a marker m113 shows that the coupling factor k is 0.805 at 2.5 GHz.

In comparison, with the primary winding inductor 12 and the secondary winding inductor 14 of both the first conductive layer 20 and the second conductive layer 22 as implemented in accordance with the third embodiment of the transformer 10*c* such that there is both horizontal and vertical mutual inductance, overall coupling is significantly increased. Additionally, insertional loss is minimal. The graphs of FIGS. 16A-16D plot simulated inductance characteristics in [H] of this third embodiment of the transformer 10*c* at different operating frequencies. Again, the simulated results are based on CMOS processes with a substrate resistivity of 10-Ohm·cm, using the top two metal layers.

Figure 16A:
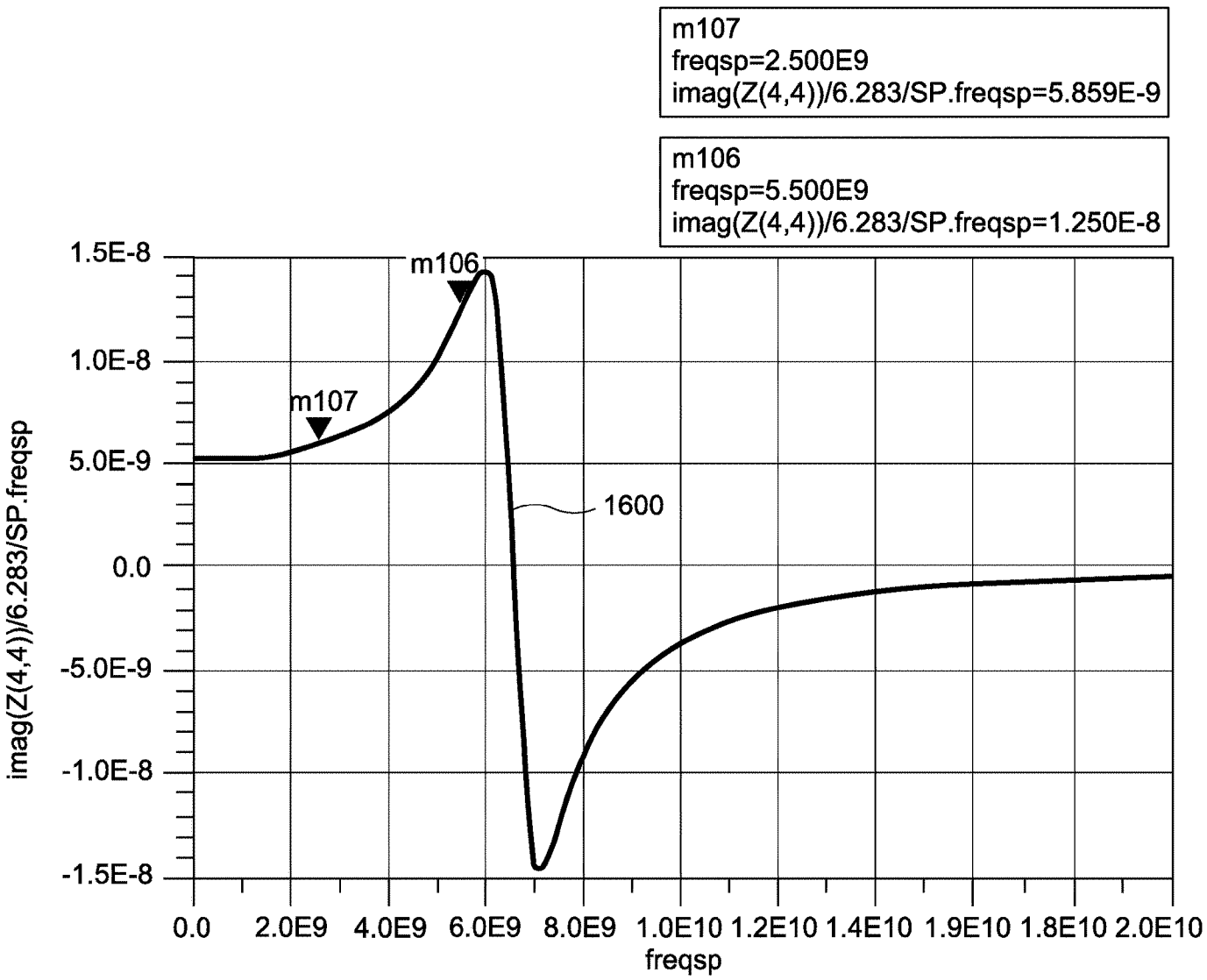
FIGS. 16A-16D are graphs showing simulation results of a primary winding inductance, a secondary winding inductance, a mutual inductance, and a coupling factor, respectively, of the third embodiment of the transformer depicted in FIGS. 12A and 12B across a frequency sweep.
Figure 16B:
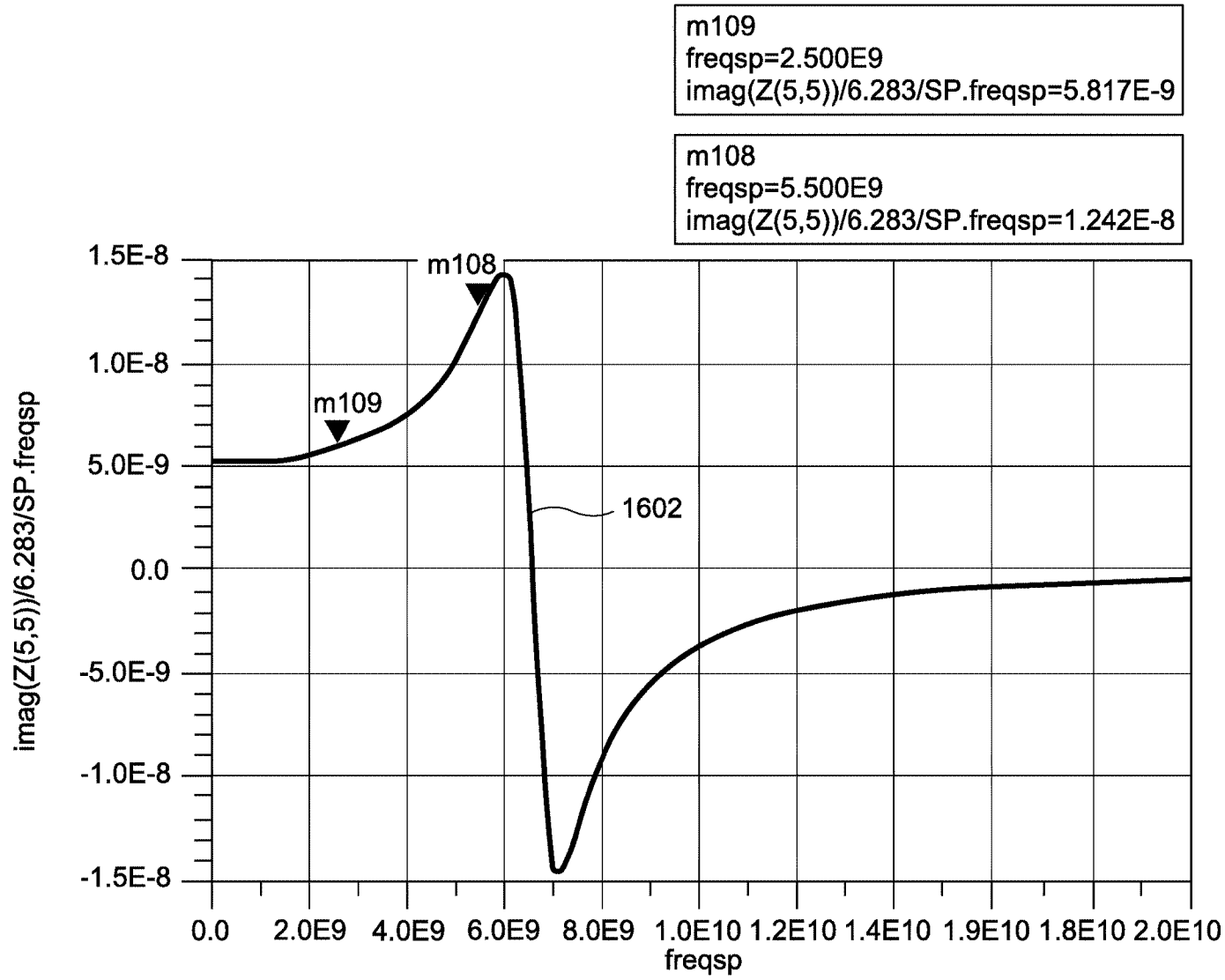
Figure 16C:
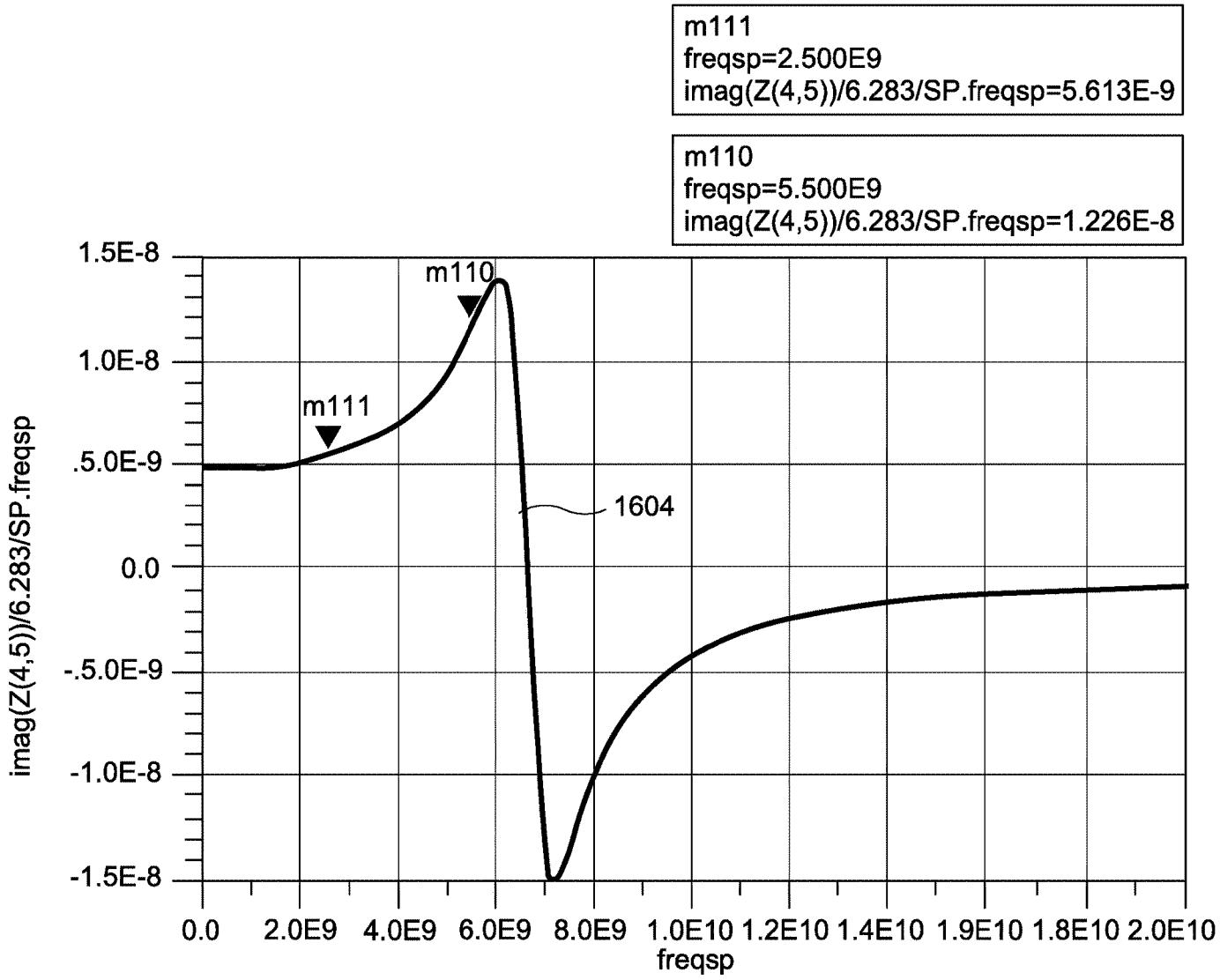
Figure 16D:
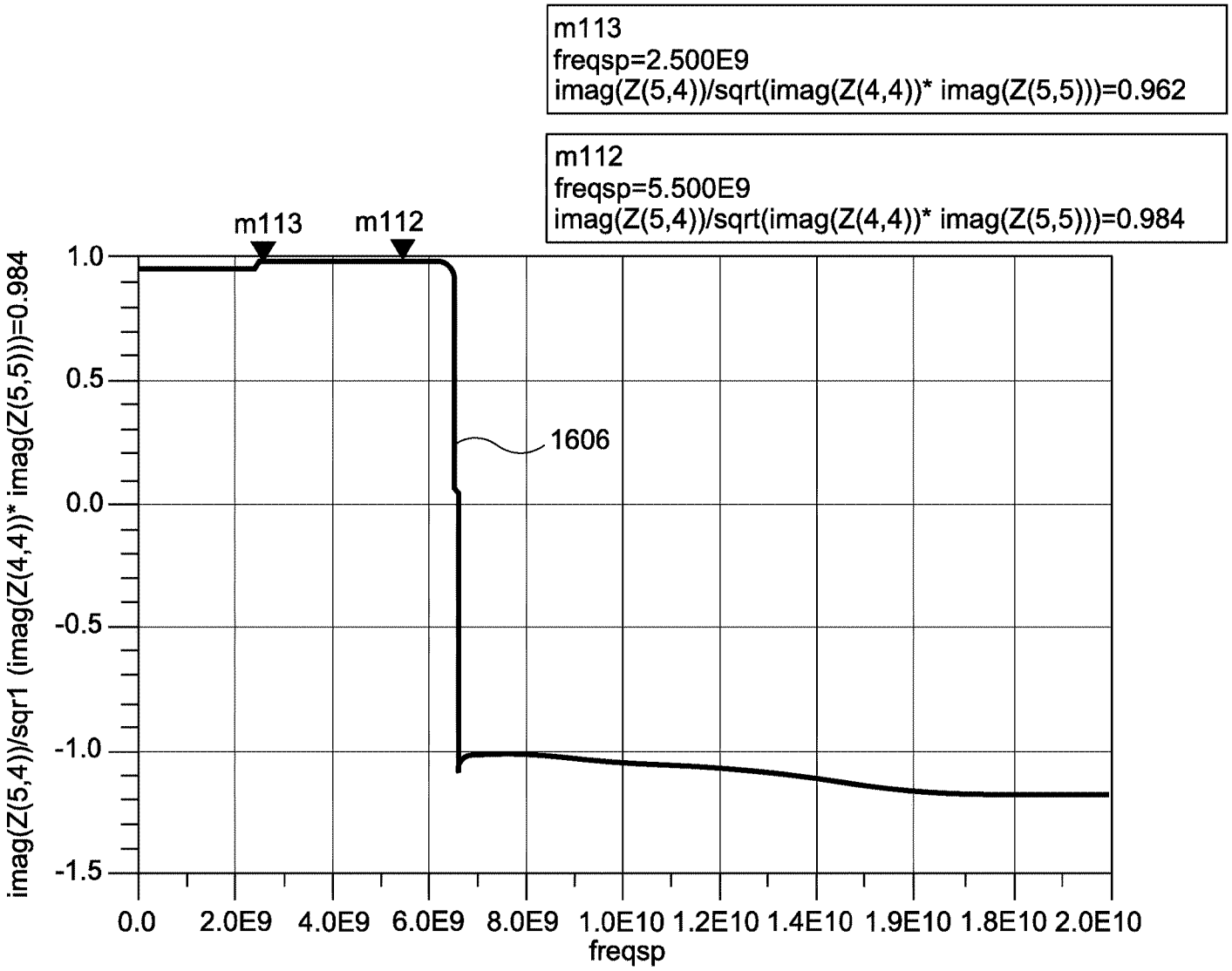

FIG. 16A includes a first plot 1600 of the inductance of the primary winding inductor 12. A marker m106 shows that at approximately 5.5 GHz, the inductance is approximately 12.5 nH, and a marker m107 shows that at approximately 2.5 GHz, the inductance is approximately 5.859 nH. The graph of FIG. 16B includes a second plot 1602 of the inductance of the secondary winding inductor 14. A marker m108 shows that at approximately 5.5 GHz, the inductance is approximately 12.42 nH, and a marker m109 shows that at approximately 2.5 GHz, the inductance is approximately 5.817 nH. The graph of FIG. 16C includes a plot 1604 of a mutual inductance of the primary winding inductor 12 and the secondary winding inductor 14. A marker m110 indicates that at approximately 5.5 GHz, the mutual inductance is approximately 12.26 nH, and a marker m111 indicates that at approximately 2.5 GHz, the mutual inductance is approximately 5.613 nH. Furthermore, the graph of FIG. 16D is of the coupling factor of the third embodiment of the transformer 10*c*, which is shown on plot 1606. A marker m112 shows that the coupling factor k is 0.984 at 5.5 GHz, while a marker m113 shows that the coupling factor k is 0.962 at 2.5 GHz.

Figure 17B:
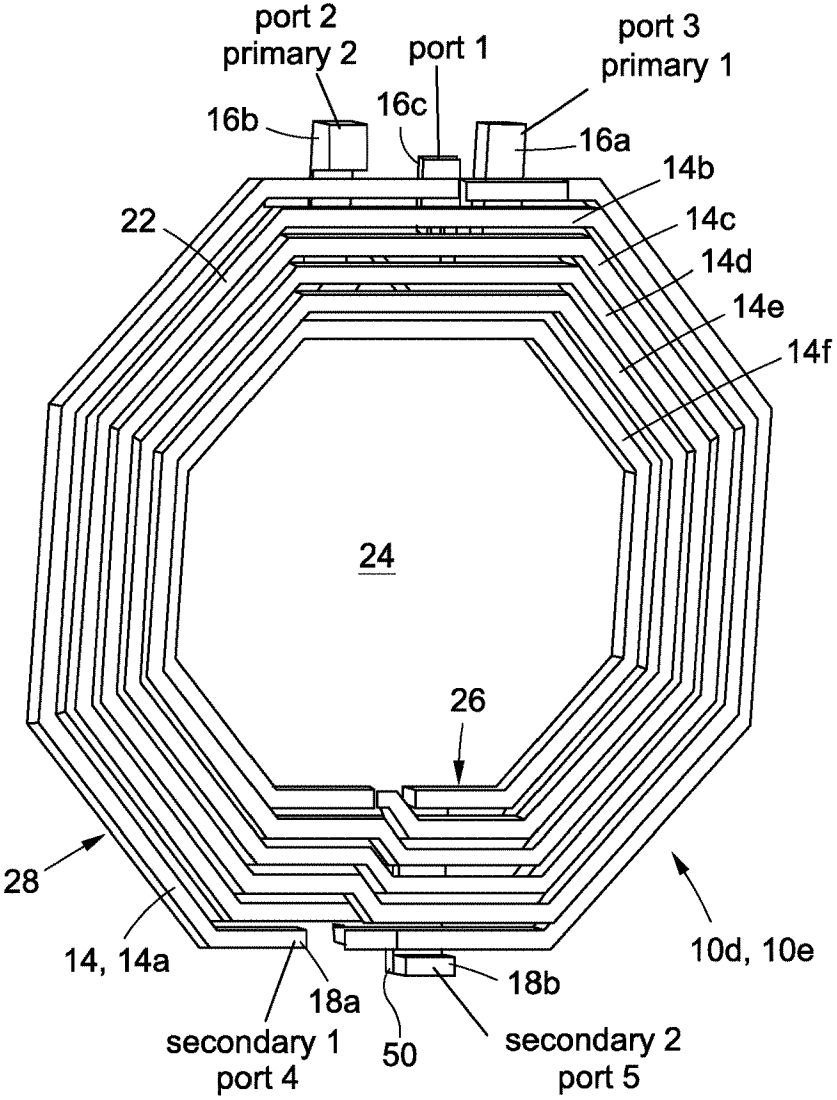
FIGS. 17A-17B are top and bottom perspective views, respectively, of a fourth embodiment of the transformer.
Figure 17A:
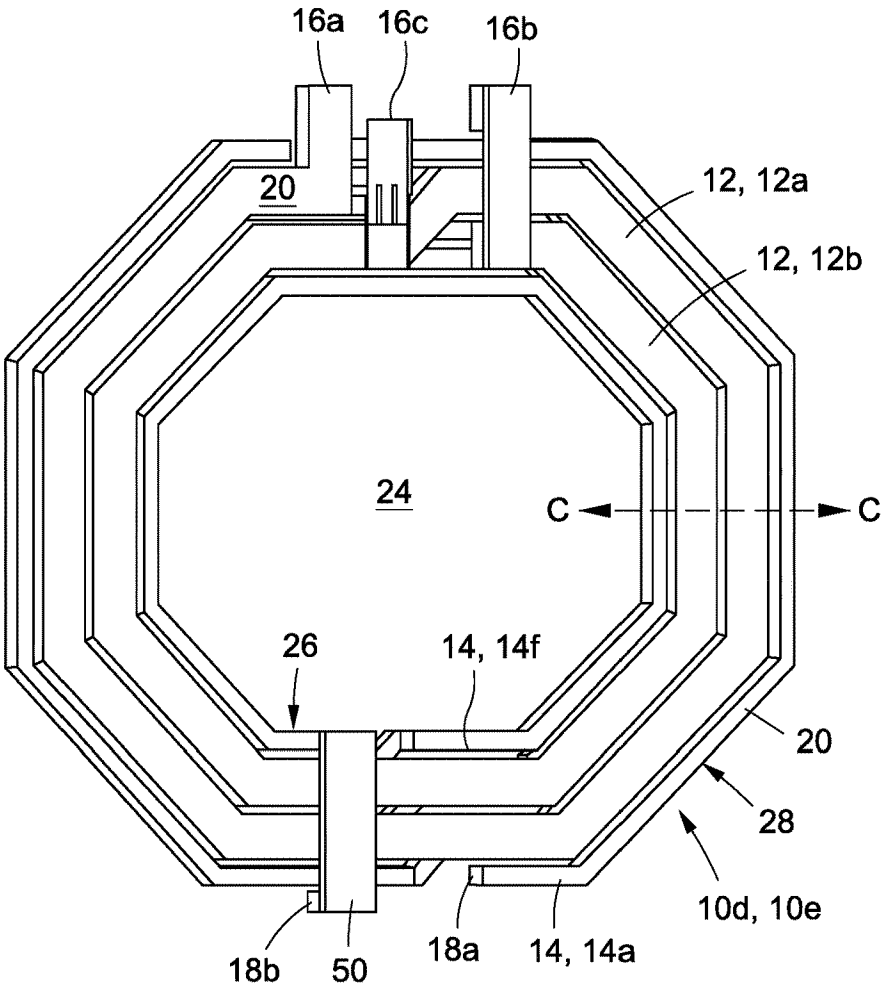

With reference to FIGS. 17A and 17B, a fourth embodiment of the transformer 10*d* likewise includes the primary winding inductor 12 and the secondary winding inductor 14. FIG. 17A depicts a top or first side of the transformer 10*d*, and FIG. 17B depicts a bottom or second side of the same. The other embodiments of the transformer 10 discussed above involved configurations in which the turn ratio was 1:1. Alternative turn ratios of 1:n are also contemplated; where n is less than 1, the transformer is of the step-down type, and where n is greater than 1, the transformer is of the step-up type. Impedance transformations and impedance matching is possible by utilizing such transformers or coupled inductors, and either the source or load impedance may be transformed to its optimal value to achieve maximum power transfer to a subsequent stage or to the antenna.

The primary winding inductor 12 has one end that corresponds to the first terminal 16*a*, and another end that corresponds to the second terminal 16*b*. Generally, the primary winding inductor 12 has a spiral configuration comprised of a first turn 12*a* and a second turn 12*b*. In this exemplary configuration, the turn ratio is 2:6, where there are two turns of the primary winding inductor 12 for six turns of the secondary winding inductor 14. At a center between the opposed ends of the primary winding inductor 12, there is a center tap 16*c*. The primary winding inductor 12 is disposed on the first conductive layer 20.

The secondary winding inductor 14, or at least a section thereof, is disposed on the first conductive layer 20 as well. Additionally, the secondary winding inductor 14 is routed to and disposed on the second conductive layer 22, which is best shown in FIG. 17B. One end of the secondary winding inductor 14 includes the first terminal 18*a*, and the other end includes the second terminal 18*b*. The secondary winding inductor 14 likewise has a spiral configuration defined by a plurality of windings, the first one 14*a* of which is defined on the first conductive layer 20. The first turn 14*a* defines the outer rim 28 of the transformer 10*d*, and following one loop, there is a connection to the second turn 14*b* that is disposed on the second conductive layer 22. There are four additional turns, i.e., the second turn 14*b*, the third turn 14*c*, the fourth turn 14*d*, and the fifth turn 14*e* that are disposed on the second conductive layer 22. Following the fifth turn 14*e*, there is an interconnection back to the first conductive layer 20, where the secondary winding inductor 14 defines a sixth turn 14*f*. At this juncture, the secondary winding inductor 14 is toward the interior opening 24, and so the connection is routed to the outer region via an interconnect 50, where the second terminal 18*b* is located.

Figure 18:
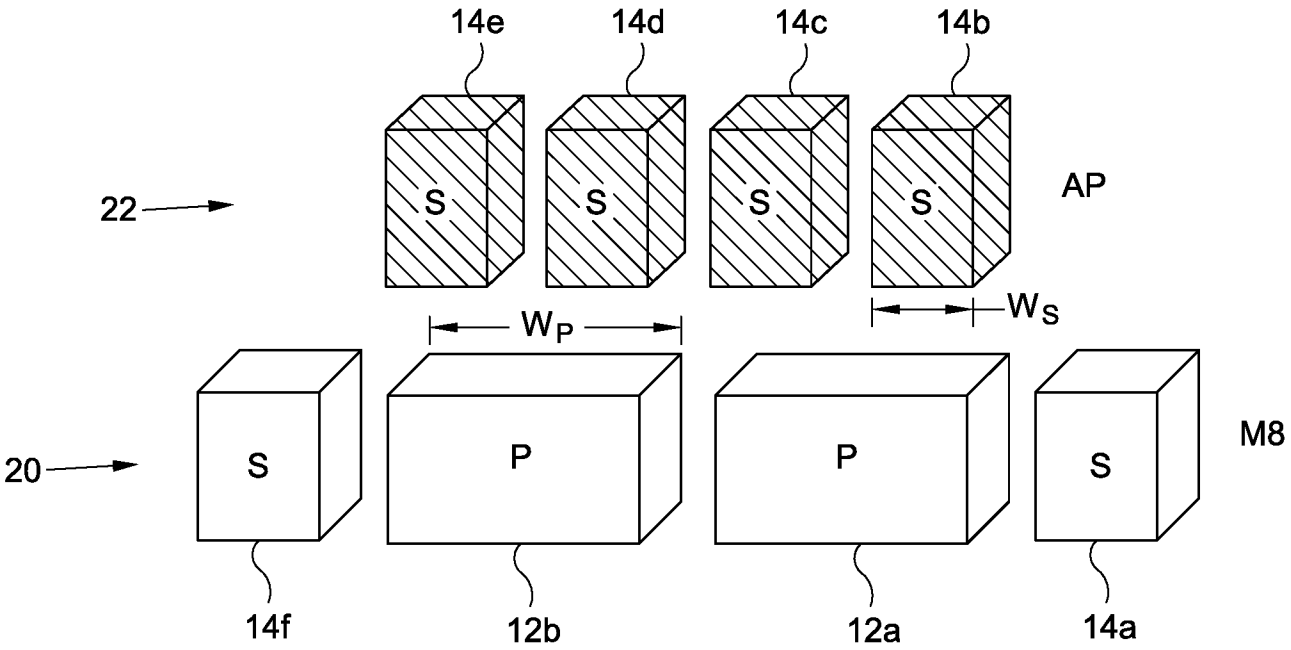
FIG. 18 is a cross sectional view of an exemplary winding structure with different primary and secondary winding widths in the fourth embodiment of the transformer configured as a step-up transformer.

FIG. 18 is a cross sectional view of the fourth embodiment of the transformer 10*d* taken along axis C-C as shown in FIG. 17A. Again, on the first conductive layer 20 there is the primary winding inductor 12, and specifically the first turn 12*a* and the second turn 12*b* thereof. Surrounding the primary winding inductor 12 on both sides on the first conductive layer 20 is the secondary winding inductor 14, and specifically the first turn 14*a* and the sixth turn 14*f* thereof. Disposed on the second conductive layer 22 are the remaining segments of the primary winding inductor 12—the second turn 14*b*, the third turn 14*c*, the fourth turn 14*d*, and the fifth turn 14*e*.

The primary winding inductor 12 has a first predefined width $w_p$ and the secondary winding inductor 14 has a predefined width $w_s$. According to the illustrated embodiment, the predefined width $w_p$ is greater than the predefined width $w_s$, that is, the primary winding inductor 12 has a wider trace than the secondary winding inductor 14. The overall dimensions of the fourth embodiment of the transformer 10*d* is, by way of example, 190 μm×200 μm.

Figure 19A:
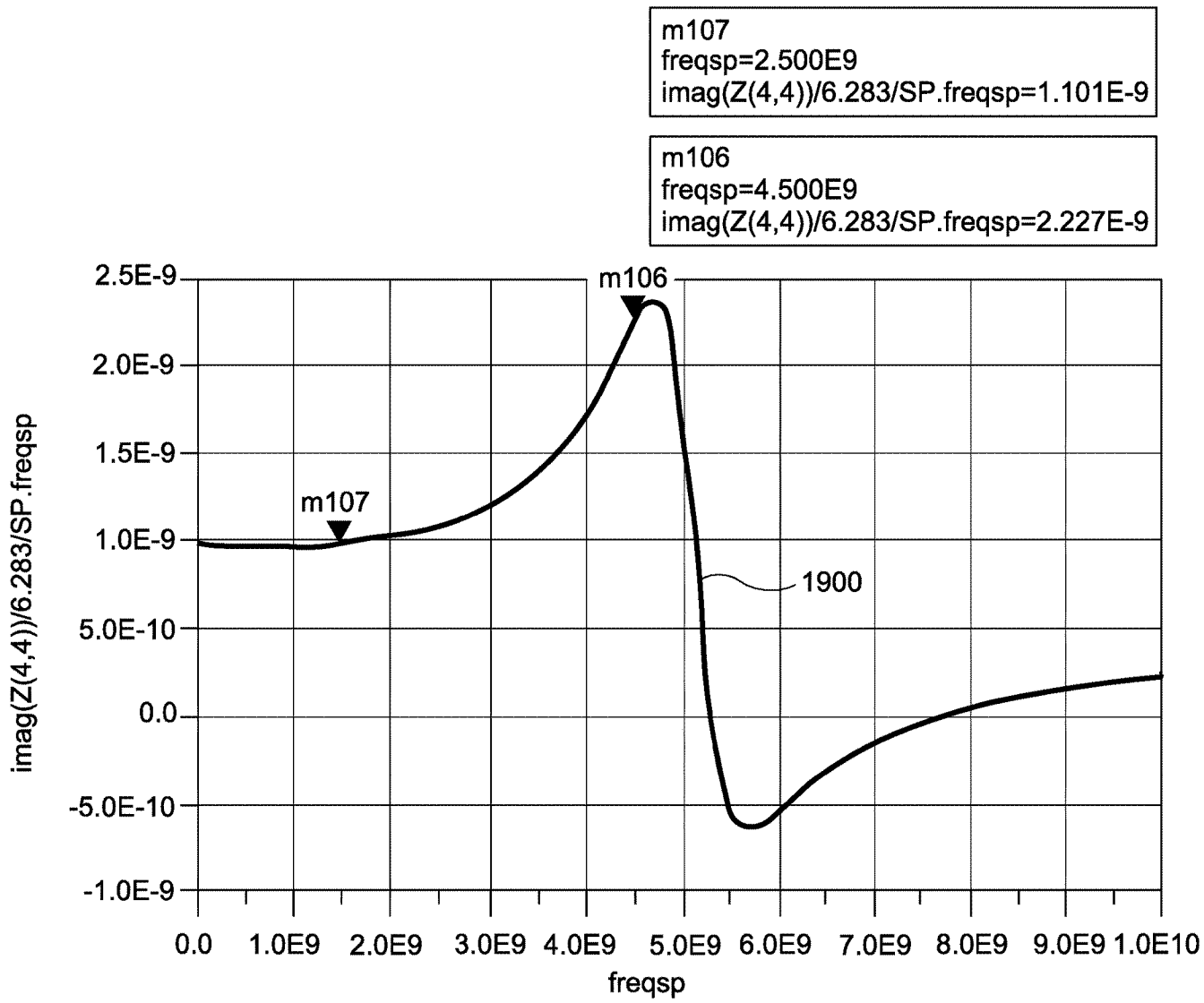
FIGS. 19A-19D are graphs showing simulation results of a primary winding inductance, a secondary winding inductance, a mutual inductance, and a coupling factor, respectively, of the fourth embodiment of the transformer depicted in FIGS. 17A and 17B across a frequency sweep, the transformer being configured as step-up transformer.
Figure 19B:
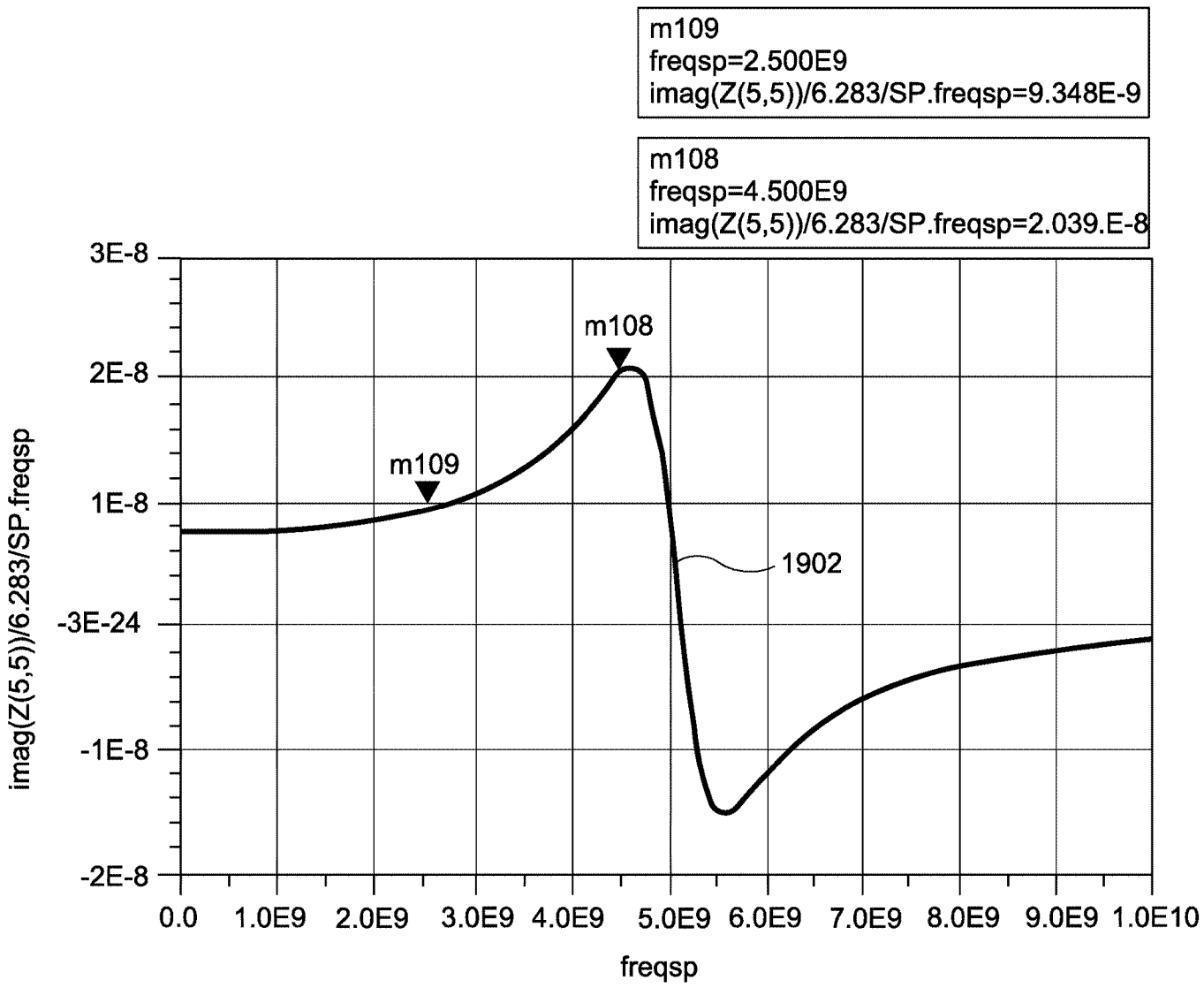
Figure 19C:
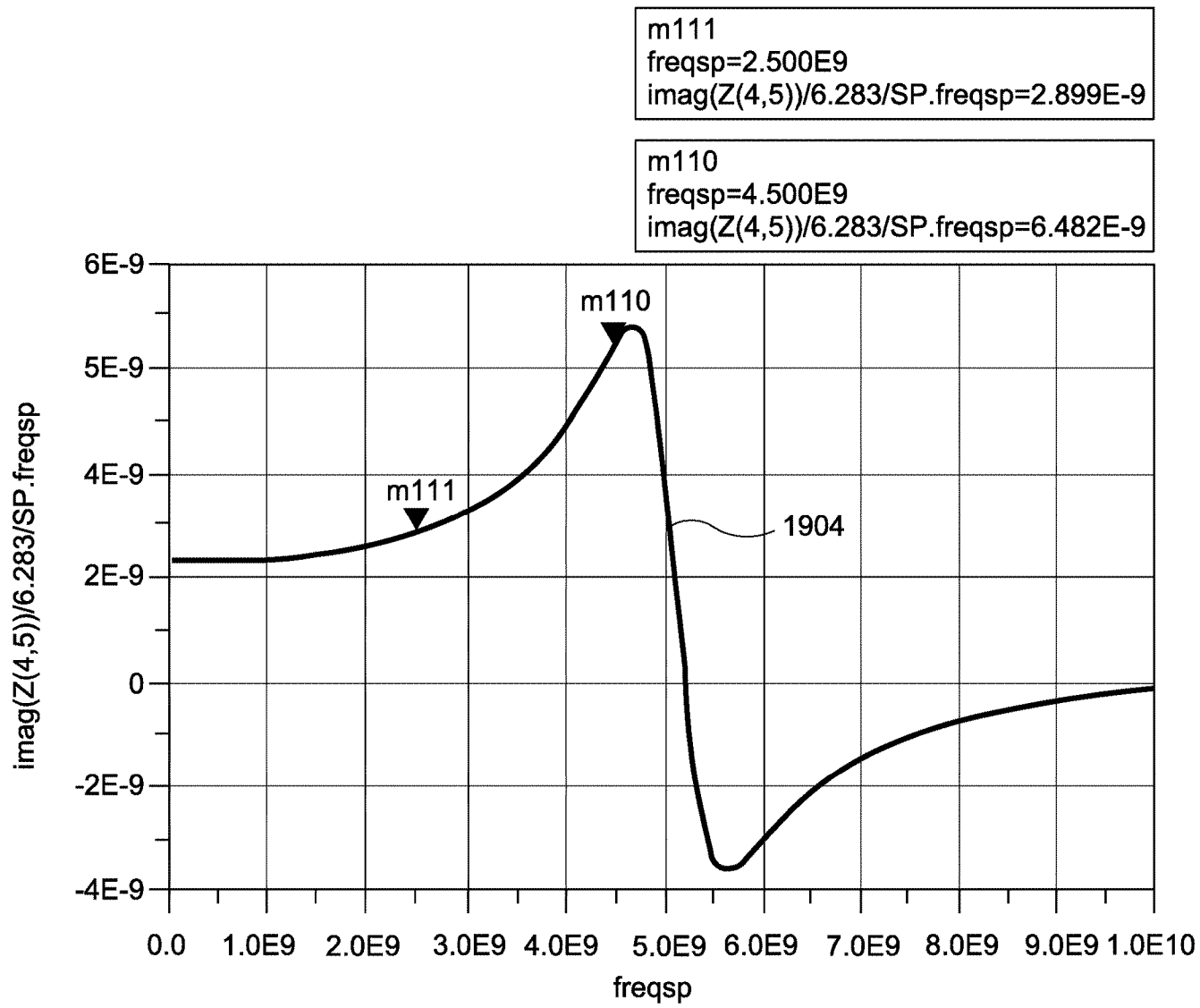
Figure 19D:
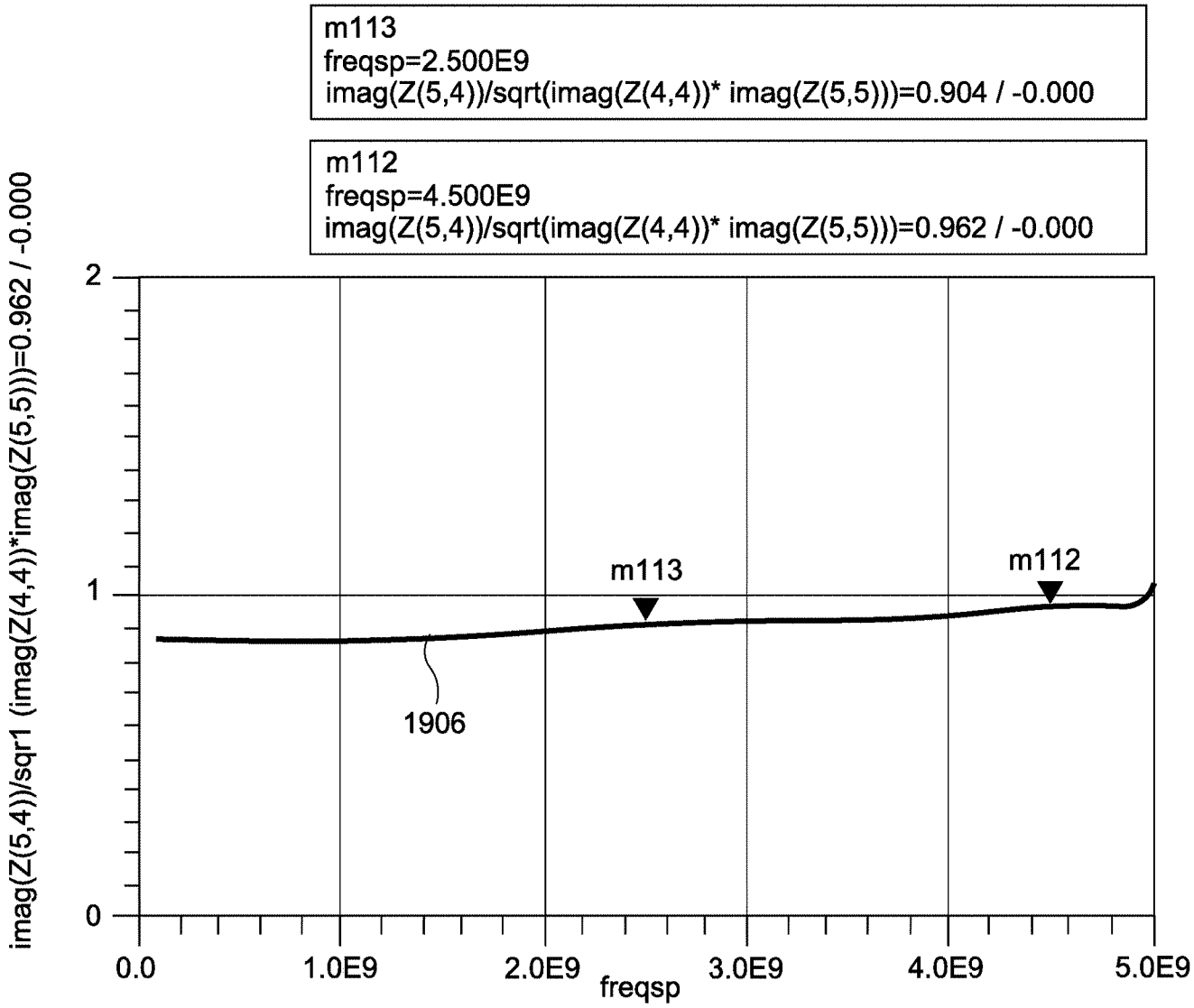

The graphs of FIGS. 19A-19D plot simulated inductance characteristics in [H] of the fourth embodiment of the transformer 10*d* at different operating frequencies. FIG. 19A includes a first plot 1900 of the inductance of the primary winding inductor 12. A marker m106 shows that at approximately 4.5 GHz, the inductance is approximately 2.227 nH, and a marker m107 shows that at approximately 2.5 GHz, the inductance is approximately 1.101 nH. The graph of FIG. 19B includes a second plot 1902 of the inductance of the secondary winding inductor 14. A marker m108 shows that at approximately 5.9 GHz, the inductance is approximately 2.039 nH, and a marker m109 shows that at approximately 2.5 GHz, the inductance is approximately 9.348 nH. The graph of FIG. 19C includes a plot 1904 of a mutual inductance of the primary winding inductor 12 and the secondary winding inductor 14. A marker m110 indicates that at approximately 4.5 GHz, the mutual inductance is approximately 6.482 nH, and a marker m111 indicates that at approximately 2.5 GHz, the mutual inductance is approximately 2.899 nH. Furthermore, the graph of FIG. 19D is of the coupling factor of the fourth embodiment of the transformer 10*d*, which is shown on plot 1906. A marker m112 shows that the coupling factor k is 0.962 at 4.5 GHz, while a marker m113 shows that the coupling factor k is 0.904 at 2.5 GHz. As indicated above, the turn ratio of the fourth embodiment of the transformer 10*d* to which these simulation results pertain is 1:3.

Figure 20A:
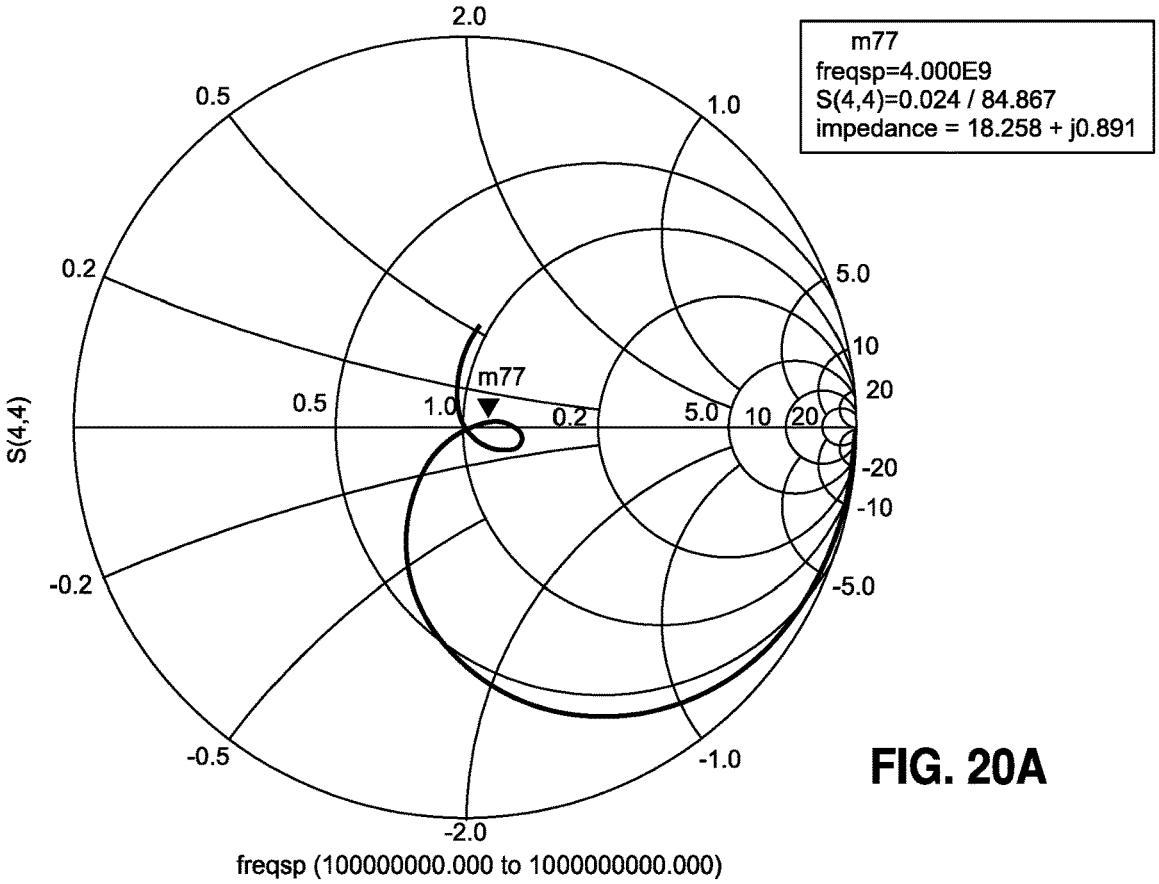
FIGS. 20A-20B are Smith charts showing the simulated S-parameters for the primary windings and the secondary windings, respectively, of the fourth embodiment of the transformer depicted in FIGS. 17A and 17B across a frequency sweep.
Figure 20B:
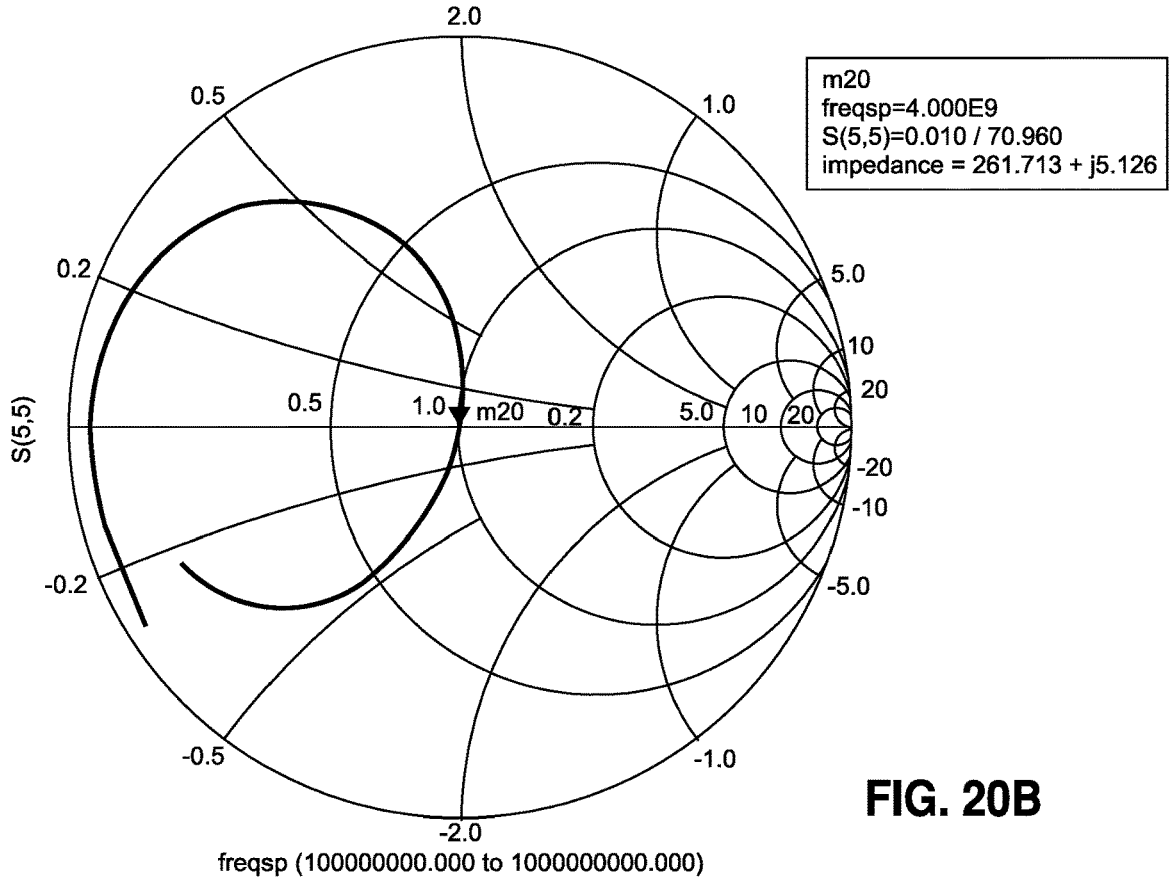
Figure 21:
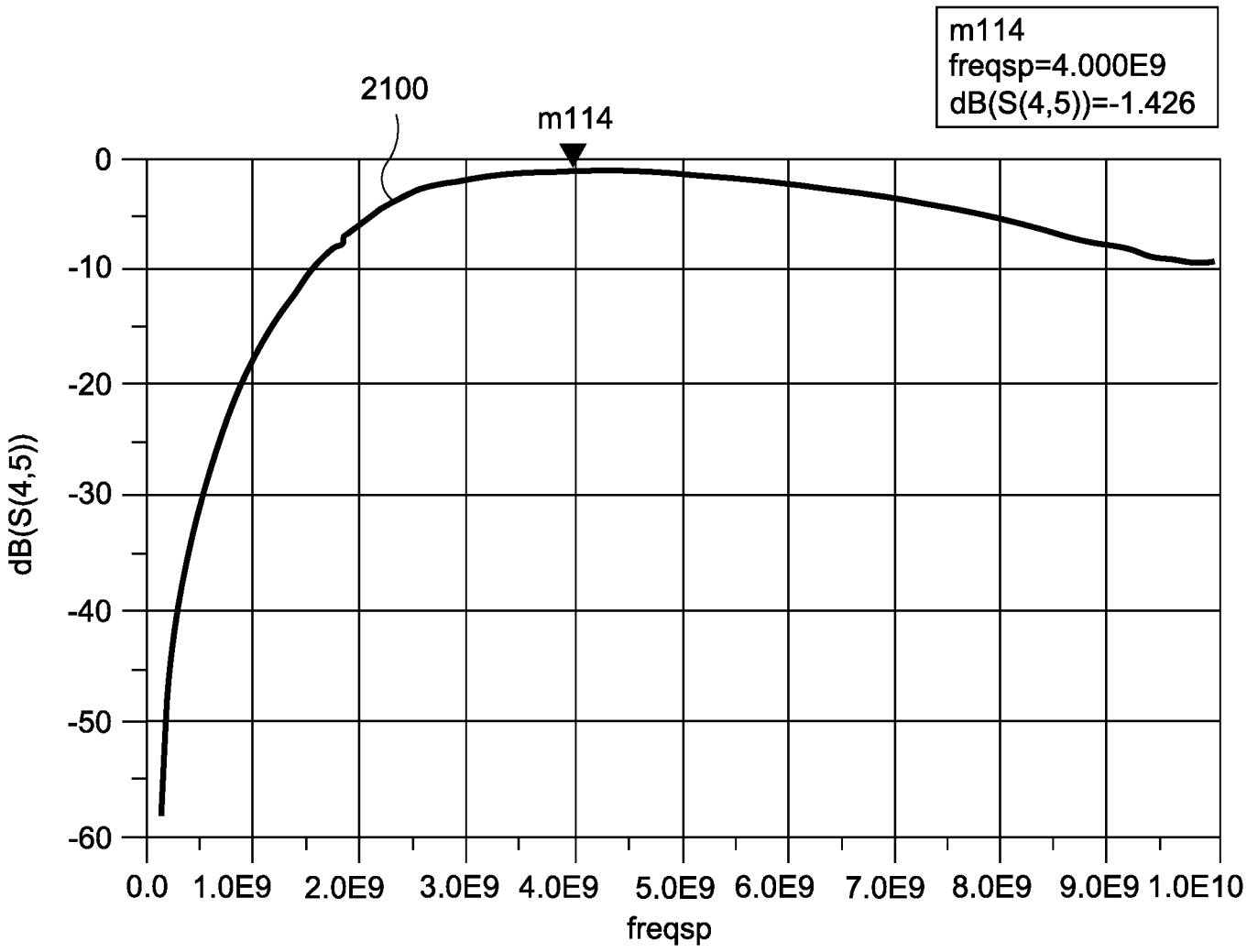
FIG. 21 is a graph showing simulation results of insertion loss of the fourth embodiment of the transformer depicted in FIGS. 17A and 17B.

The Smith charts of FIGS. 20A and 20B plot the simulated S-parameters of the fourth embodiment of the transformer 10*d*. The simulations are based on a standard CMOS process using the top two metal layers. The Smith chart of FIG. 20A is for the primary winding inductor 12 and the Smith chart of FIG. 20B is for the secondary winding inductor 14. As illustrated, the impedance of the primary winding inductor 12 is matched to 18.2 Ohm, and the secondary impedance is stepped up to 261 Ohm. The graph of FIG. 21 shows, in a plot 2100, the simulated matching loss in [dB] of the fourth embodiment of the transformer 10*d* across a frequency sweep. As indicated by marker m114, at 4 GHz, the matching loss is approximately 1.4 dB.

In accordance with another, fifth embodiment of the transformer 10*e*, the same configuration of the fourth embodiment of the transformer 10*d* may be adapted to accommodate a higher operation frequency. Instead of the overall dimensions of 190 μm×200 μm as in the fourth embodiment of the transformer 10*d*, in the fifth embodiment the overall dimensions are contemplated to be 150 μm×180 μm. The impedance step-up is still at a ratio of 2:6/1:3.

Figure 22A:
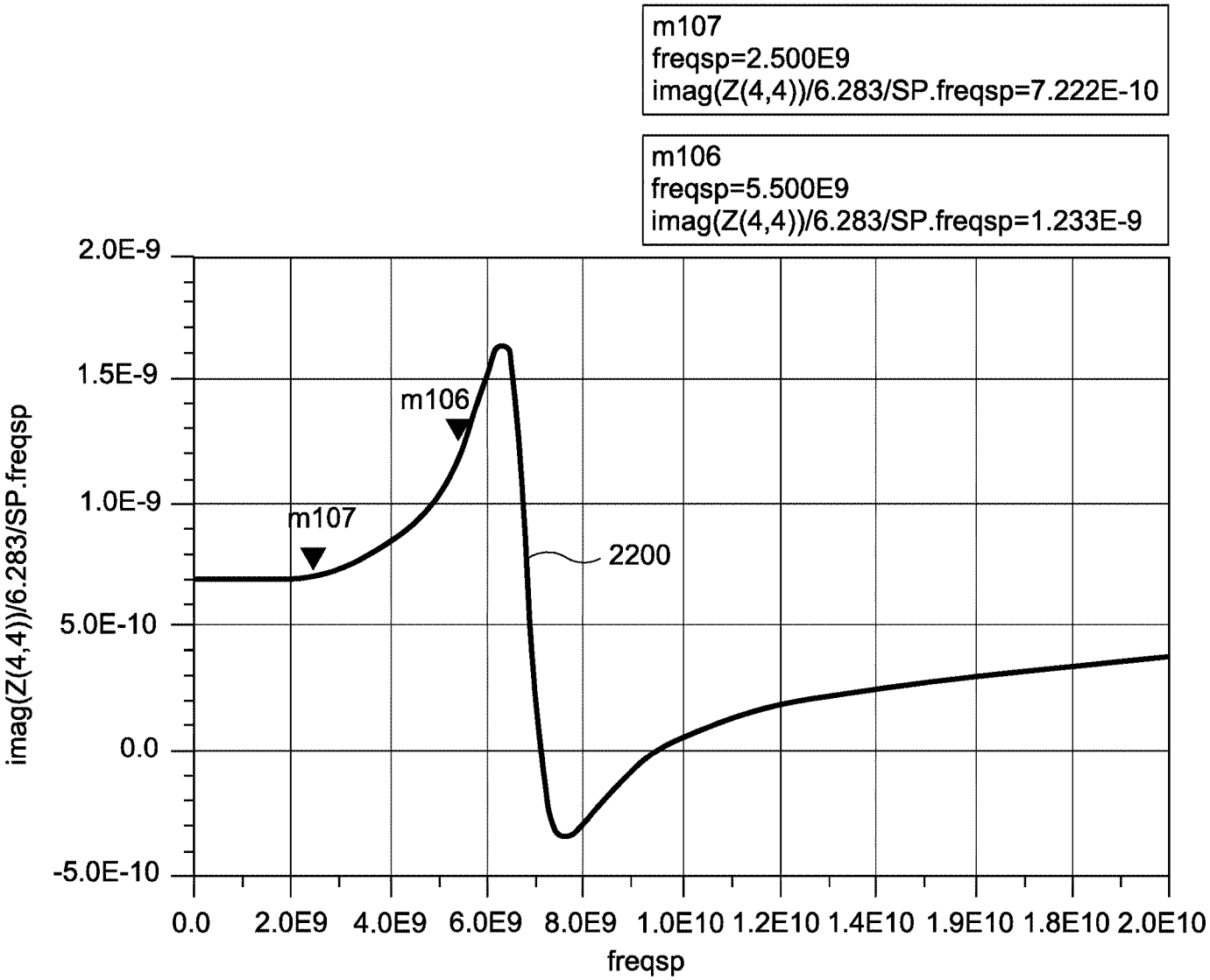
FIGS. 22A-22D are graphs showing simulation results of a primary winding inductance, a secondary winding inductance, a mutual inductance, and a coupling factor, respectively, of a fifth embodiment of the transformer across a frequency sweep, the transformer being configured as step-up transformer for a higher operation frequency than the fourth embodiment.
Figure 22B:
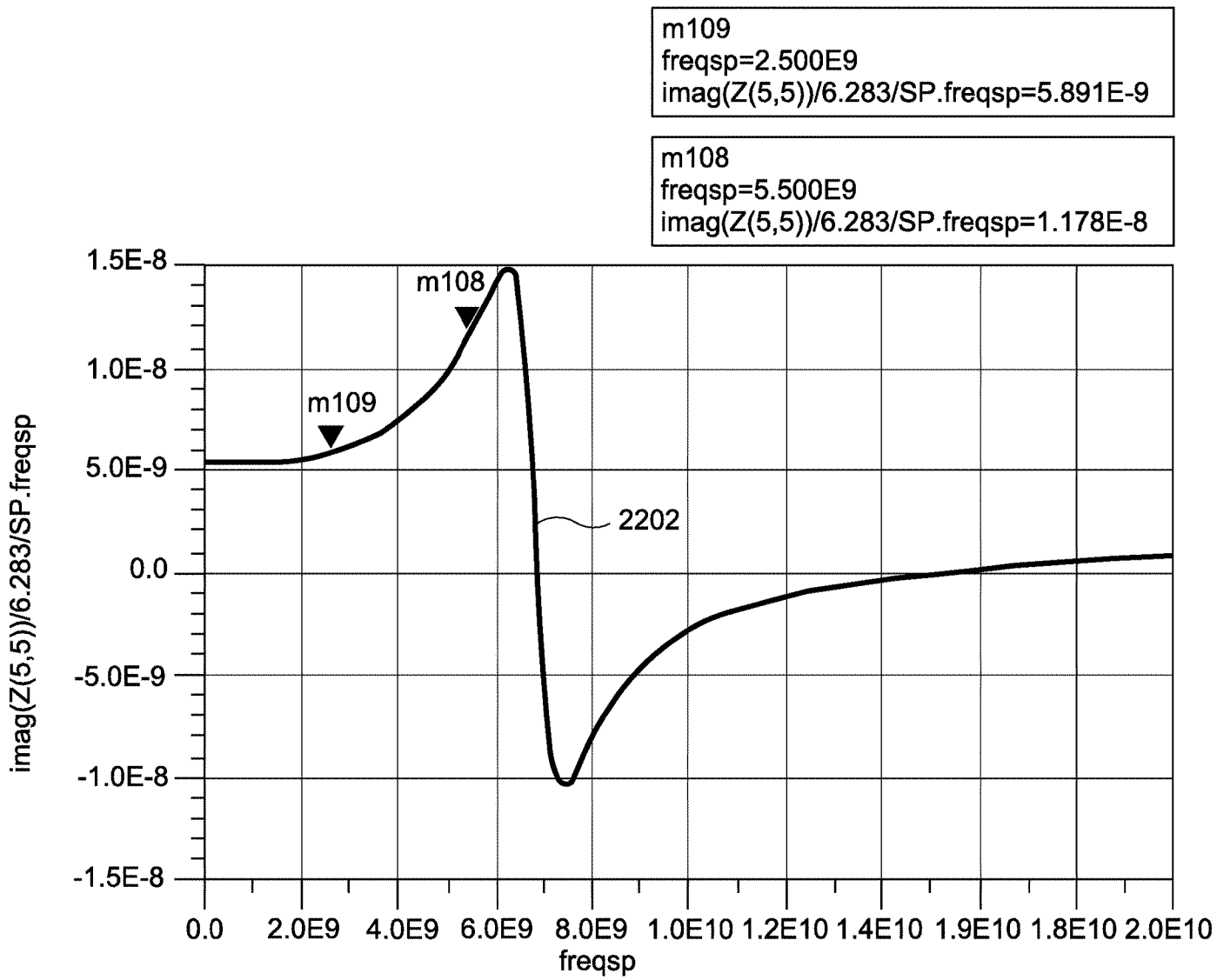
Figure 22C:
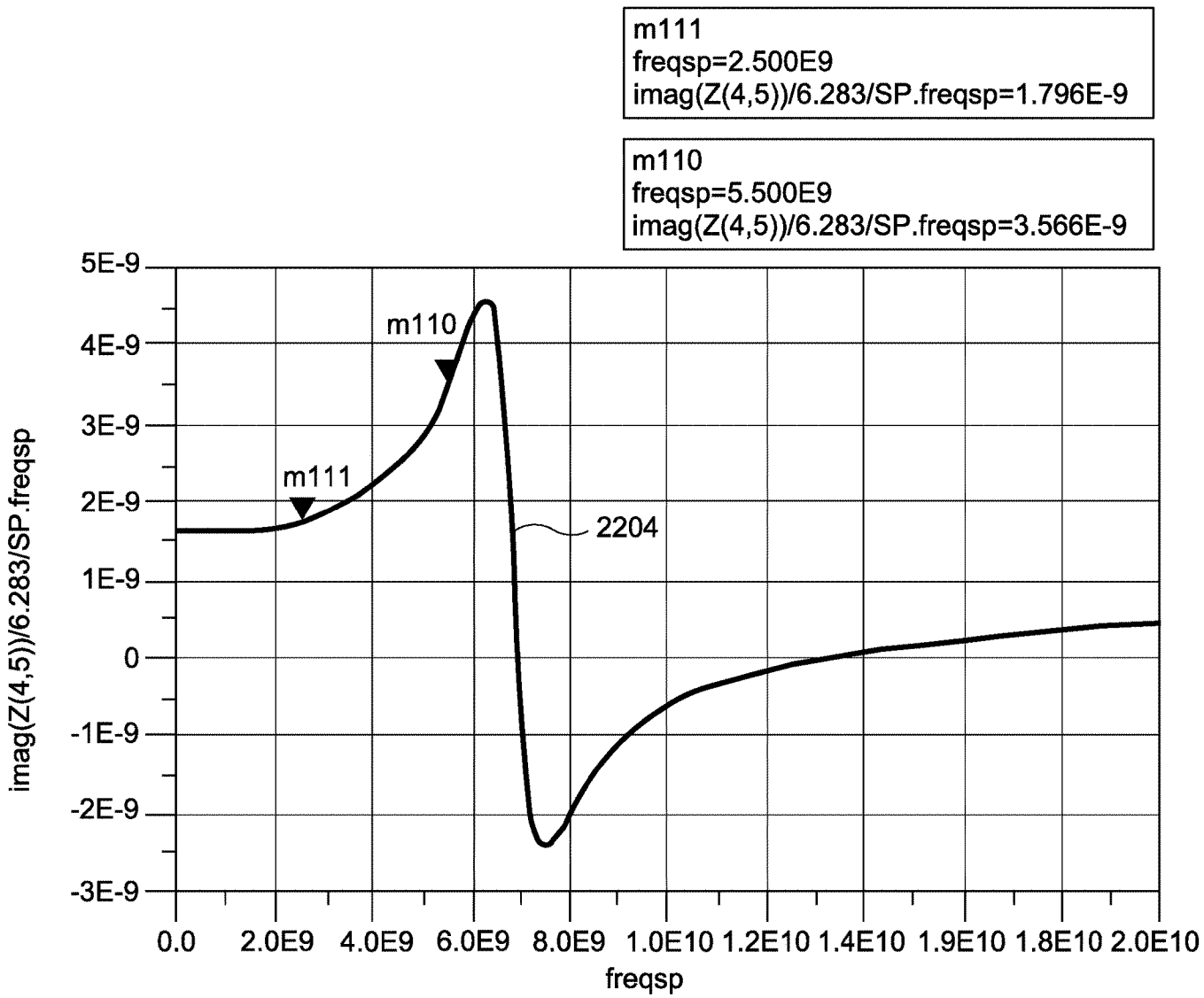
Figure 22D:
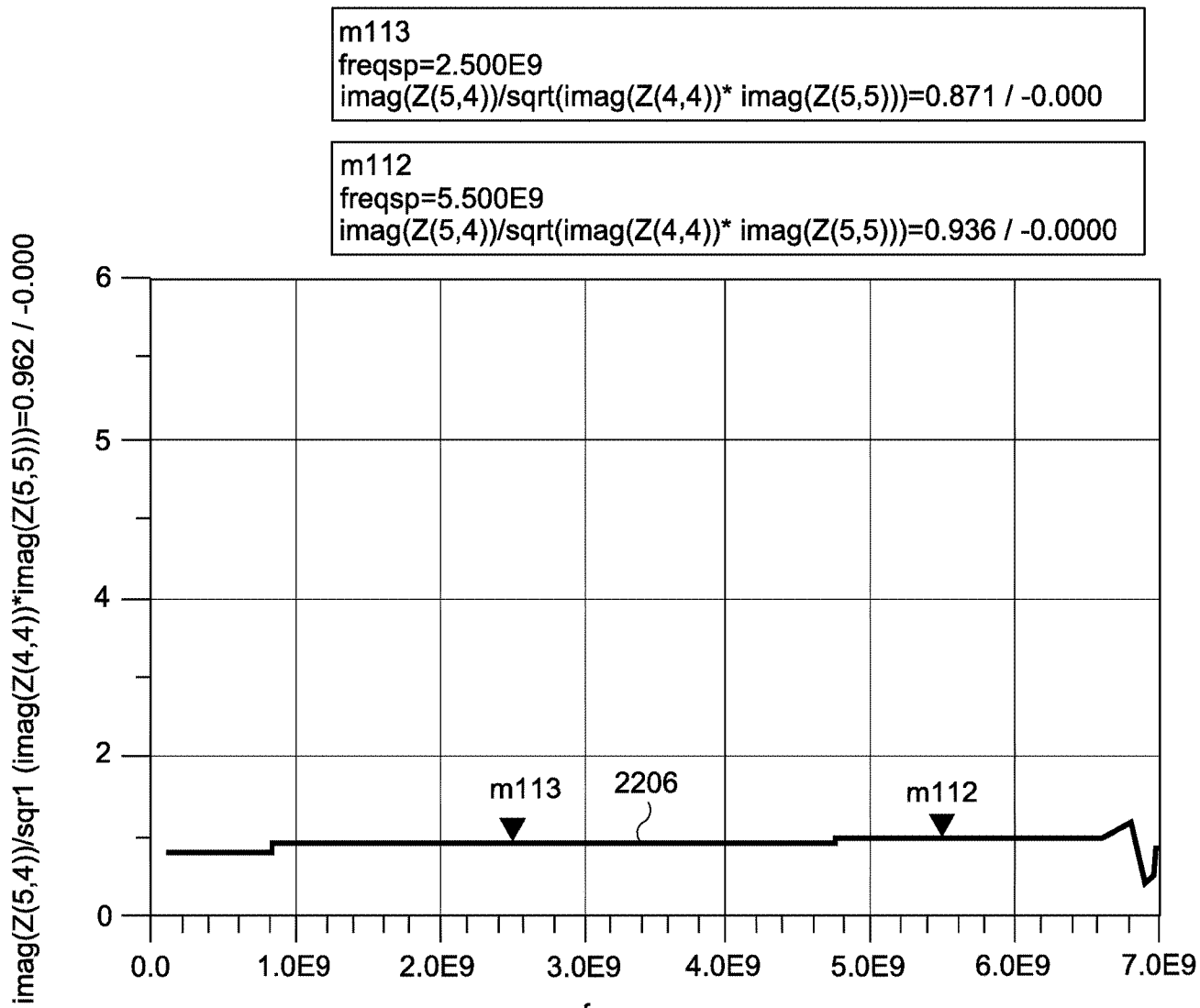

The graphs of FIGS. 22A-229D plot simulated inductance characteristics in [H] of the fifth embodiment of the transformer 10*e* at different operating frequencies. FIG. 22A includes a first plot 2200 of the inductance of the primary winding inductor 12. A marker m106 shows that at approximately 5.5 GHz, the inductance is approximately 1.233 nH, and a marker m107 shows that at approximately 2.5 GHz, the inductance is approximately 0.722 nH. The graph of FIG. 22B includes a second plot 2202 of the inductance of the secondary winding inductor 14. A marker m108 shows that at approximately 5.5 GHz, the inductance is approximately 11.78 nH, and a marker m109 shows that at approximately 2.5 GHz, the inductance is approximately 5.891 nH. The graph of FIG. 22C includes a plot 2204 of a mutual inductance of the primary winding inductor 12 and the secondary winding inductor 14. A marker m110 indicates that at approximately 5.5 GHz, the mutual inductance is approximately 3.566 nH, and a marker m111 indicates that at approximately 2.5 GHz, the mutual inductance is approximately 1.796 nH. The graph of FIG. 22D is of the coupling factor of the fifth embodiment of the transformer which is shown on plot 2206. A marker m112 shows that the coupling factor k is 0.932 at 5.5 GHz, while a marker m113 shows that the coupling factor k is 0.871 at 2.5 GHz.

Figure 23A:
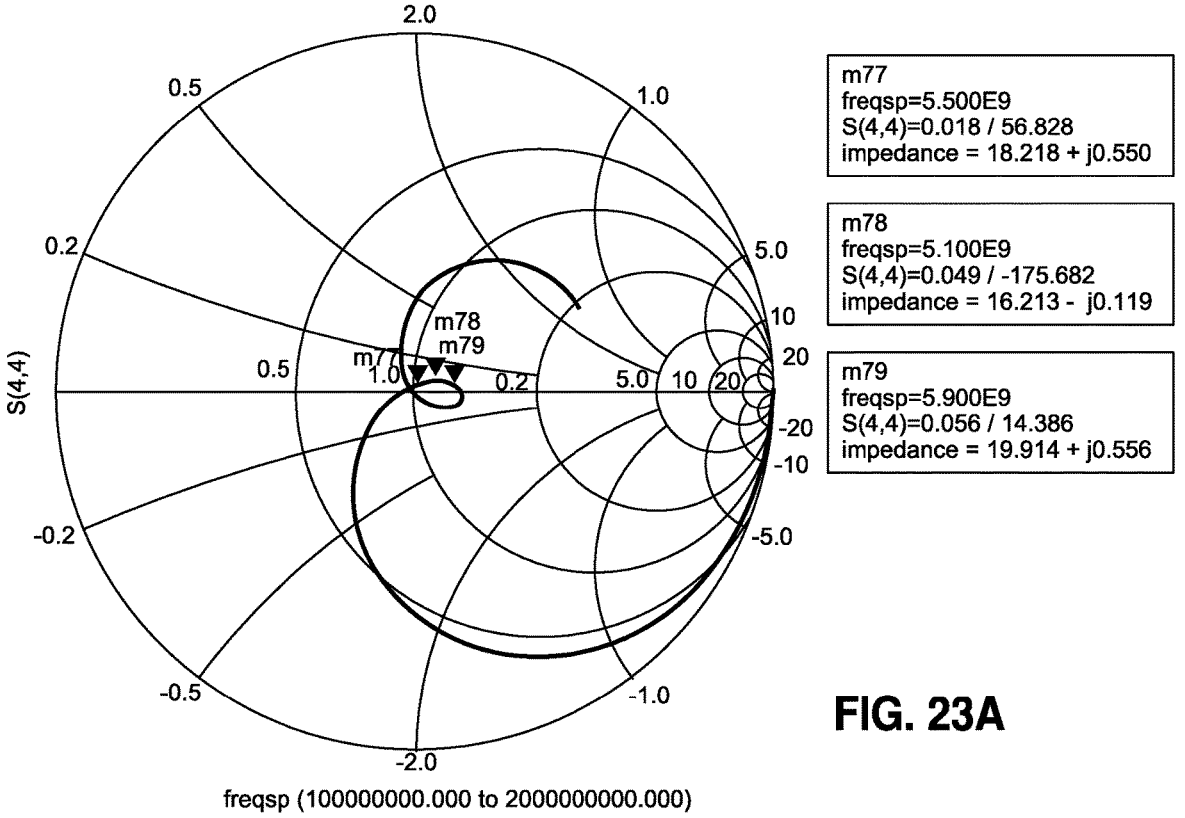
FIGS. 23A-23B are Smith charts showing the simulated S-parameters for the primary windings and the secondary windings, respectively, of the fifth embodiment of the transformer across a frequency sweep.
Figure 23B:
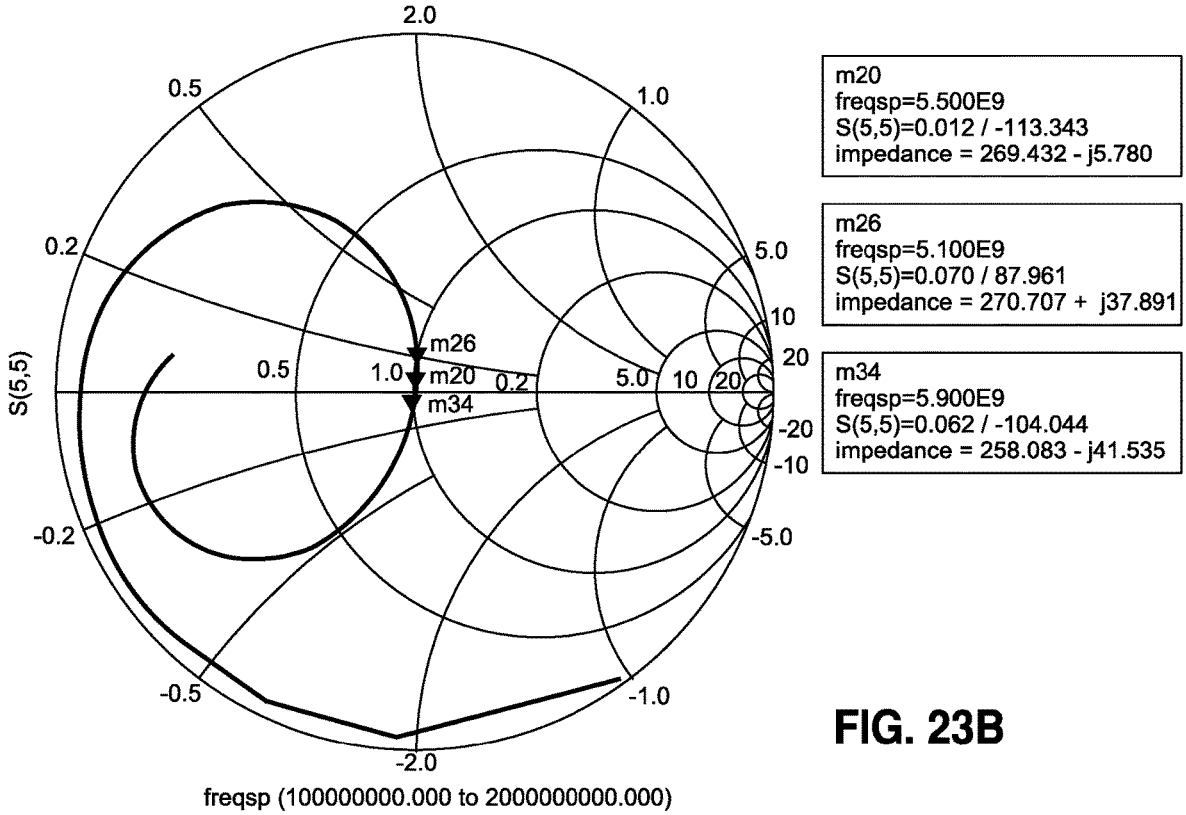
Figure 24:
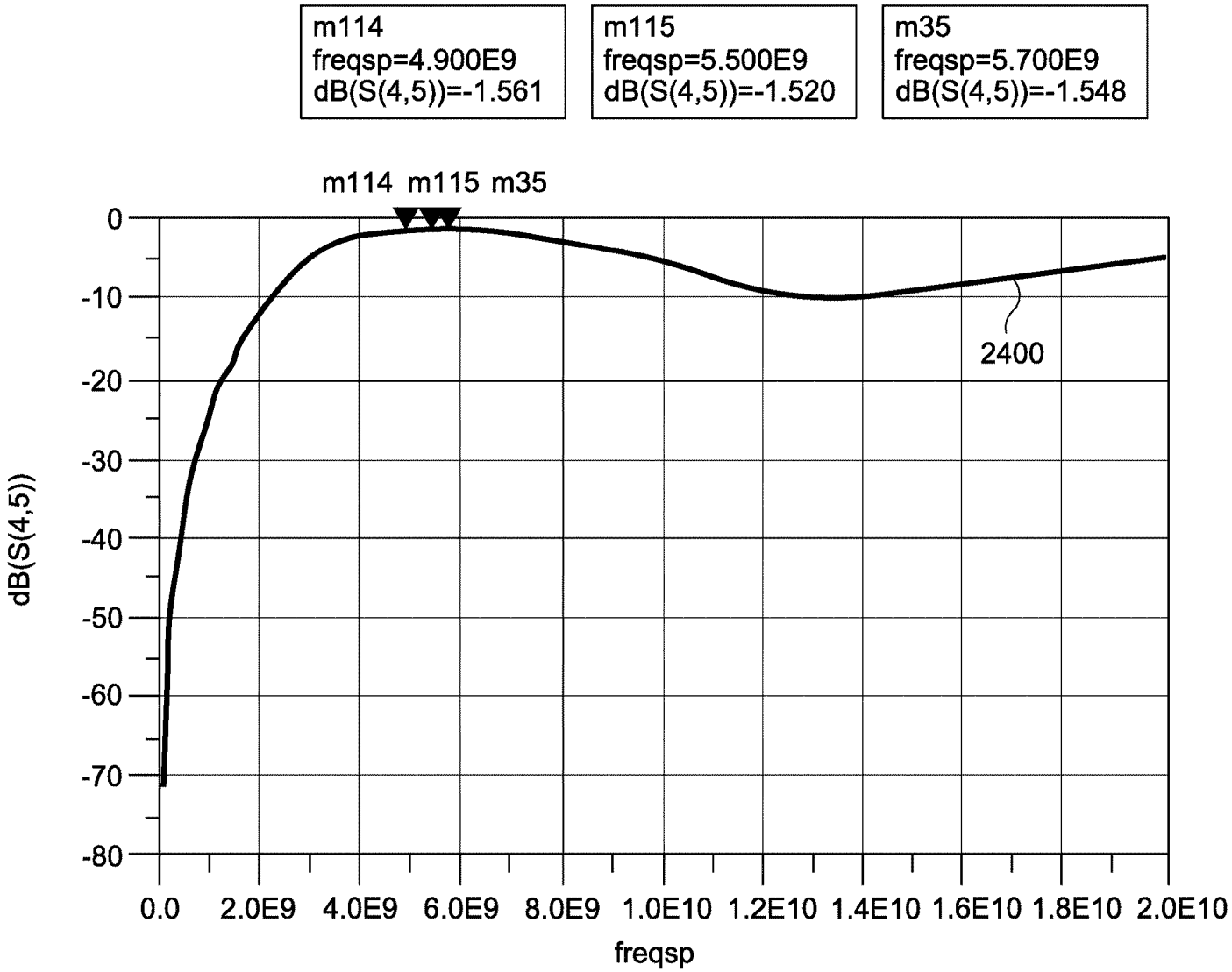
FIG. 24 is a graph showing simulation results of insertion loss of the fifth embodiment of the transformer.

The Smith charts of FIGS. 23A and 23B plot the simulated S-parameters of the fifth embodiment of the transformer 10*e* with the alternative dimensions. The simulations are based on a standard CMOS process using the top two metal layers. The Smith chart of FIG. 23A is for the primary winding inductor 12 and the Smith chart of FIG. 23B is for the secondary winding inductor 14. As illustrated, the impedance of the primary winding inductor 12 is matched to 18.2 Ohm, and the secondary impedance is stepped up to 269 Ohm. The graph of FIG. 24 shows, in a plot 2400, the simulated matching loss in [dB] of the fifth embodiment of the transformer 10*e* across a frequency sweep. As indicated by marker m115, at 5.5 GHz, the matching loss is approximately 1.52 dB. Furthermore, marker m114 shows that the matching loss is also approximately 1.561 dB at 4.9 GHz, and marker m36 shows that the matching loss is 1.548 dB at 5.7 GHz.

The foregoing embodiments of the transformer 10 are understood to have ultra-high coupling factors. The disclosed structures are envisioned to have insertion losses of approximately 0.8 dB, which is understood to be low for the 40 nm bulk-CMOS process, which has 10-Ohm·cm substrate resistivity. Additionally, coupling factors of up to 0.98 are possible even on these substrates. Various turn ratios are also contemplated. The transformer 10 is understood to be particularly suitable for small form factor integrated circuits such as those utilized in mobile communications devices.

The particulars shown herein are by way of example and for purposes of illustrative discussion of the embodiments of the present disclosure only and are presented in the cause of providing what is believed to be the most useful and readily understood description of the principles and conceptual aspects of the present disclosure. In this regard, no attempt is made to show details of the various embodiments of the present disclosure with more particularity than is necessary for the fundamental understanding thereof, the description taken with the drawings making apparent to those skilled in the art how the several forms of the present disclosure may be embodied in practice.

What is claimed is:

1. A balun transformer, comprising:

a primary winding inductor defined by a primary conductive trace with a plurality of turns;

a secondary winding inductor defined by a secondary conductive trace with a plurality of turns; and a double bridge interconnect of a segment of the primary conductive trace crossing over a segment of the secondary conductive trace, the primary conductive trace being electrically isolated from the secondary conductive trace while being electromagnetically coupled, the double bridge interconnect being defined by a primary base level trace coplanar with the primary conductive trace, a secondary base level trace coplanar with the secondary conductive trace and vertically offset from the primary base level trace by a predefined distance, the secondary base level trace and the primary base level trace defining a mutual electromagnetic coupling, a primary deck level trace vertically offset from the primary base level trace, a secondary deck level trace vertically offset from the secondary base level trace, the secondary deck level trace being vertically offset from the primary deck level trace by the predefined distance, the primary deck level trace and the secondary deck level trace defining a mutual electromagnetic coupling, a primary vertical offset trace interconnecting the primary base level trace to the primary deck level trace, and a secondary vertical offset trace interconnecting the secondary base level trace to the secondary deck level trace.

2. The balun transformer of claim 1 wherein the primary vertical offset trace and the secondary vertical offset trace define a mutual electromagnetic coupling.

3. A transformer comprising:

a primary winding inductor spanning a first conductive layer and a second conductive layer;

a secondary winding inductor spanning the first conductive layer and the second conductive layer, the secondary winding inductor being electrically isolated from and electromagnetically coupled to the primary winding inductor; and a double bridge interconnect connecting first and second segments of the primary winding inductor in the first conductive layer and connecting first and second segments of the secondary winding inductor in the second conductive layer, the double bridge interconnect crossing over the secondary winding inductor in the first conductive layer and the primary winding inductor in the second conductive layer, the double bridge interconnect including a primary deck level trace vertically offset from the first conductive layer by a predefined distance, a secondary deck level trace vertically offset from the second conductive layer by the predefined distance, the primary deck level trace and the secondary deck level trace defining a mutual electromagnetic coupling, a first primary vertical offset trace connecting the first segment of the primary winding inductor in the first conductive layer to the primary deck level trace, a second primary vertical offset trace connecting the primary deck level trace to the second segment of the primary winding inductor in the first conductive layer, a first secondary vertical offset trace connecting the first segment of the secondary winding inductor in the second conductive layer to the secondary deck level trace, and a second secondary vertical offset trace connecting the secondary deck level trace to the second segment of the secondary winding inductor in the second conductive layer.

4. The transformer of claim 3 wherein the first primary vertical offset trace and the first secondary vertical offset trace define a mutual electromagnetic coupling, and the second primary vertical offset trace and the second secondary vertical offset trace define a mutual electromagnetic coupling.

5. The transformer of claim 3 wherein the primary deck level trace and the secondary deck level trace are in substantially parallel planes.

6. The transformer of claim 5 wherein the first and second conductive layers are in substantially parallel planes.

7. The transformer of claim 3 wherein the primary winding inductor and the secondary winding inductor have a spiral configuration.

8. The transformer of claim 7 wherein an outermost turn of the primary winding inductor on the first conductive layer defines an outer rim of the transformer, and an innermost turn of the secondary winding inductor on the first conductive layer defines an inner rim of the transformer.

9. The transformer of claim 8 wherein turns of the primary winding inductor alternate with turns of the secondary winding inductor on the first conductive layer except that the innermost turn of the secondary winding inductor is adjacent to another turn of the secondary winding inductor.

10. The transformer of claim 9 wherein a total length of the secondary winding inductor on the first conductive layer is equal to a total length of the primary winding inductor on the first conductive layer.

11. The transformer of claim 9 wherein an outermost turn of the secondary winding inductor on the second conductive layer defines the outer rim of the transformer, and an innermost turn of the primary winding inductor on the second conductive layer defines the inner rim of the transformer.

12. The transformer of claim 11 wherein turns of the secondary winding inductor alternate with turns of the primary winding inductor on the second conductive layer except that the innermost turn of the primary winding inductor is adjacent to another turn of the primary winding inductor.

13. The transformer of claim 12 wherein a total length of the primary winding inductor on the second conductive layer is equal to a total length of the secondary winding inductor on the second conductive layer.

14. The transformer of claim 3 wherein the first conductive layer is an aluminum layer.

15. The transformer of claim 14 wherein the second conductive layer is a metal 8 layer.

16. The transformer of claim 3 wherein the transformer has a 1:1 ratio for use in connection with differential power amplifiers.

17. The transformer of claim 3 wherein the primary winding inductor and the secondary winding inductor have equal length.

18. The transformer of claim 3 wherein the primary winding inductor and the secondary winding inductor have an equal number of turns.

* * * * *